US008319711B2

(12) United States Patent
Shirasaki et al.

(10) Patent No.: US 8,319,711 B2
(45) Date of Patent: Nov. 27, 2012

(54) EMISSION APPARATUS AND DRIVE METHOD THEREFOR

(75) Inventors: Tomoyuki Shirasaki, Higashiyamato (JP); Jun Ogura, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 1281 days.

(21) Appl. No.: 12/079,286

(22) Filed: Mar. 26, 2008

(65) Prior Publication Data

US 2008/0246785 A1 Oct. 9, 2008

(30) Foreign Application Priority Data

Mar. 26, 2007 (JP) ..... 2007-078394

(51) Int. Cl.
*G09G 3/30* (2006.01)

(52) U.S. Cl. ..... 345/77; 345/83; 345/92

(58) Field of Classification Search ..... 345/76–84, 345/87, 92, 211
See application file for complete search history.

(56) References Cited

U.S. PATENT DOCUMENTS

| | | | | |
|---|---|---|---|---|
| 7,012,586 | B2 * | 3/2006 | Kageyama et al. | 345/77 |
| 7,583,261 | B2 * | 9/2009 | Shirasaki et al. | 345/212 |
| 7,701,421 | B2 * | 4/2010 | Ogura | 345/77 |
| 7,719,492 | B2 * | 5/2010 | Childs | 345/76 |
| 7,760,168 | B2 * | 7/2010 | Ogura | 345/77 |
| 7,907,105 | B2 * | 3/2011 | Shirasaki et al. | 345/77 |
| 7,907,137 | B2 * | 3/2011 | Shirasaki et al. | 345/212 |
| 7,969,398 | B2 * | 6/2011 | Shirasaki et al. | 345/89 |
| 2004/0017161 | A1 * | 1/2004 | Choi | 315/169.3 |
| 2004/0239596 | A1 * | 12/2004 | Ono et al. | 345/76 |
| 2005/0088103 | A1 * | 4/2005 | Kageyama et al. | 315/169.3 |
| 2006/0221015 | A1 * | 10/2006 | Shirasaki et al. | 345/77 |
| 2007/0164959 | A1 * | 7/2007 | Childs | 345/92 |
| 2008/0238953 | A1 * | 10/2008 | Ogura | 345/697 |
| 2008/0246785 | A1 * | 10/2008 | Shirasaki et al. | 345/690 |

FOREIGN PATENT DOCUMENTS

| | | | |
|---|---|---|---|
| JP | 08-330600 | A | 12/1996 |
| JP | 2004-4673 | A | 1/2004 |
| JP | 2005-115144 | * | 4/2005 |

OTHER PUBLICATIONS

Japanese Office Action dated Mar. 6, 2009 (6 pages), and English translation thereof (6 pages) issued in counterpart Japanese Application No. 2007-078394.

* cited by examiner

*Primary Examiner* — Seokyun Moon
(74) *Attorney, Agent, or Firm* — Holtz, Holtz, Goodman & Chick, PC

(57) ABSTRACT

An emission apparatus includes an emission element, a pixel drive circuit connected to the emission element, a data line connected to the pixel drive circuit, and an emission drive apparatus that, in a selection period, lets a reference current with a predetermined current value flow to the pixel drive circuit via the data line, derives a compensation voltage which is a difference between a potential which varies according to a unique characteristic of the pixel drive circuit and a predetermined reference potential, and generates a correction gradation voltage to be applied to the pixel drive circuit based on the compensation voltage for causing the emission element to emit light at an appropriate luminance gradation.

5 Claims, 29 Drawing Sheets

EMISSION APPARATUS AND DRIVE METHOD THEREFOR

BACKGROUND OF THE INVENTION

1. Field of the Invention

The present invention relates to an emission apparatus and a drive method therefor, and, particularly, to an emission apparatus with an emission area (emission pixel array) having an array of a plurality of current driven type (or current controlled type) emission elements each of which emits light at an appropriate luminance gradation as a current according to emission data is supplied thereto, and a drive method for the same.

2. Description of the Related Art

Recently, there are active studies and developments on emission element type emission apparatuses (emission element type displays) each having an emission area with a matrix array of current driven type emission elements, such as organic electroluminescence devices (organic EL devices), inorganic electroluminescence devices (inorganic EL devices) or light emitting diodes (LEDs), as the next generation display devices to the liquid crystal display apparatus.

Particularly, an emission element type display adopting an active matrix drive system has a very superior feature of being able to become flatter and lighter that it can have a faster display response speed and less dependency on the angle of visibility, can have higher luminance, higher contrast, and higher definition of the display image quality, and need no backlight or light guide plate, as compared with the known liquid crystal display apparatuses. Therefore, there is an expectation that application of such an emission element type display to various electronic devices can be expected.

As such an emission element type displays employing the matrix drive system, there is known an organic EL emission apparatus using organic EL devices as emission elements, which employs a drive system to control the luminance gradation by controlling the current flowing to the emission elements based on a voltage signal.

In this case, at each emission pixel, there are provided a current control thin film transistor which has a gate applied with a voltage signal according to emission data and lets a current having a current value according to the voltage value of the voltage signal flow to an emission element, and a switching thin film transistor which performs switching to supply a voltage signal according to the emission data to the gate of the current controlling thin film transistor.

In such an organic EL emission apparatus which controls the luminance gradation by setting the current value of the current flowing to the emission elements based on the voltage value of the voltage signal applied according to emission data, however, the threshold value in the electric characteristic of the current controlling thin film transistor or the like may change with time. When such a change in threshold value occurs, the current value of the current flowing to the emission element varies even with the same voltage value of the voltage signal to be applied according to emission data, so that the emission luminance of the emission element changes, which may impair the emitting characteristic.

SUMMARY OF THE INVENTION

Accordingly, it is an advantage of the present invention to provide an emission drive apparatus which can compensate for a change in device characteristic of a drive element for emission pixels to allow an emission element to emit light at an adequate luminance gradation according to emission data, an emission apparatus using the emission drive apparatus, and a drive method therefor, so that the emission apparatus and drive method have an advantage of providing an excellent emission quality over a long period of time.

An emission apparatus according to a first aspect of the present invention includes:

an emission element;

a pixel drive circuit connected to the emission element;

a data line connected to the pixel drive circuit; and an emission drive apparatus that, in a selection period, lets a reference current with a predetermined current value flow to the pixel drive circuit via the data line, derives a compensation voltage which is a difference between a potential which varies according to a unique characteristic of the pixel drive circuit and a predetermined reference potential, and generates a correction gradation voltage to be applied to the pixel drive circuit based on the compensation voltage for causing the emission element to emit light at an appropriate luminance gradation.

The emission drive apparatus has a voltage setting unit that computes the correction gradation voltage by adding a gradation voltage according to predetermined emission data and the compensation voltage.

The emission drive apparatus has a voltage subtracting unit that computes the compensation voltage by computing a difference between a potential generated at the data line when the reference current is let to flow into the pixel drive circuit and the reference potential.

The emission drive apparatus has a voltage latch unit that temporarily holds the compensation voltage computed by the voltage subtracting unit.

The emission drive apparatus has a current source that lets the reference current flow into the pixel drive circuit.

The emission drive apparatus has a changeover switch that selectively connects the voltage setting unit and the current source to the data line.

The emission apparatus has an emission area where a plurality of emission pixels each having a set of the emission element and the pixel drive circuit are arrayed.

The pixel drive circuit has a drive transistor connected in series to the emission element.

An emission apparatus according to a second aspect of the invention includes:

an emission element;

a pixel drive circuit connected to the emission element;

a data line connected to the pixel drive circuit; and an emission drive apparatus that, in a selection period, applies a detection voltage with a predetermined voltage value to the pixel drive circuit via the data line to detect a current value which varies according to a unique characteristic of the pixel drive circuit, and modulates and sets the voltage value of the detection voltage in such a way that the current value is approximated to a predetermined reference current value.

In the emission apparatus according to the second aspect, the emission drive apparatus has a voltage setting unit that computes the detection voltage by adding a gradation voltage according to predetermined emission data and a compensation voltage set based on the current value which varies according to the unique characteristic of the pixel drive circuit.

In the emission apparatus according to the second aspect, the emission drive apparatus has a current comparing unit that compares a current value of a current flowing to the data line when the detection voltage computed by the voltage setting unit is applied to the pixel drive circuit, with the predetermined reference current value.

In the emission apparatus according to the second aspect, the emission drive apparatus has a compensation voltage generating unit that generates the compensation voltage based on a result of comparison performed by the current comparing unit current, and the compensation voltage generating unit modulates the compensation voltage when the current comparing unit determines that the current value of the current flowing to the data line when the detection voltage is applied to the pixel drive circuit is smaller than the predetermined reference current value.

The emission apparatus according to the second aspect has an emission area where a plurality of emission pixels each having a set of the emission element and the pixel drive circuit are arrayed.

In the emission apparatus according to the second aspect, the pixel drive circuit has a drive transistor connected in series to the emission element.

In the emission apparatus according to the second aspect, the pixel drive circuit has a select transistor connected between the drive transistor and the data line, and a diode connecting transistor that sets the drive transistor in a diode connected state.

According to a third aspect of the invention, there is provided a drive method for an emission apparatus including an emission element, a pixel drive circuit connected to the emission element, an emission drive apparatus having a voltage subtracting unit and a voltage setting unit, and a data line connecting the emission drive apparatus to the pixel drive circuit, the drive method comprising:

in a selection period, causing the voltage subtracting unit to derive a compensation voltage which is a difference between a potential which varies according to a unique characteristic of the pixel drive circuit and a predetermined reference potential, when a reference current with a predetermined current value is let to flow to the pixel drive circuit via the data line;

in the selection period, causing the voltage setting unit to derive a correction gradation voltage in accordance with both of a gradation voltage corresponding to predetermined emission data and the compensation voltage; and causing the emission element to emit light at by applying the correction gradation voltage to the pixel drive circuit via the data line.

According to a fourth aspect of the invention, there is provided a drive method for an emission apparatus including an emission element, a pixel drive circuit connected to the emission element, an emission drive apparatus, and a data line connecting the emission drive apparatus to the pixel drive circuit, wherein the emission drive apparatus applies a detection voltage with a predetermined voltage value to the pixel drive circuit via the data line to detect a current value which varies according to a unique characteristic of the pixel drive circuit, and modulates and sets the voltage value of the detection voltage in such a way that the current value is approximated to a predetermined reference current value.

In the drive method emission according to the fourth aspect, the emission drive apparatus of the emission apparatus has a current comparing unit and a voltage setting unit, the current comparing unit compares a current value of a current flowing to the data line when the detection voltage is applied to the pixel drive circuit, with the predetermined reference current value, and the voltage setting unit computes the detection voltage by adding a gradation voltage according to predetermined emission data and a compensation voltage which is set according to the current value that varies corresponding to the unique characteristic of the pixel drive circuit, the current value is generated based on a result of comparison performed by the current comparing unit.

The emission apparatus and drive method according to the present invention can allow an emission element to emit light at an adequate luminance gradation according to emission data and can achieve an excellent and uniform emission image quality.

DETAILED DESCRIPTION OF THE PREFERRED EMBODIMENTS

An emission drive apparatus according to the present invention and a drive method therefor, and an emission apparatus according to the invention and a drive method therefor will be described in detail by way of embodiments.

<Structure of Essential Portion of Emission Pixel>

To begin with, the structure of the essential portion of an emission pixel to be applied to an emission apparatus according to the present invention and a control operation for the emission pixel will be described with reference to the accompanying drawings.

Figure 1:
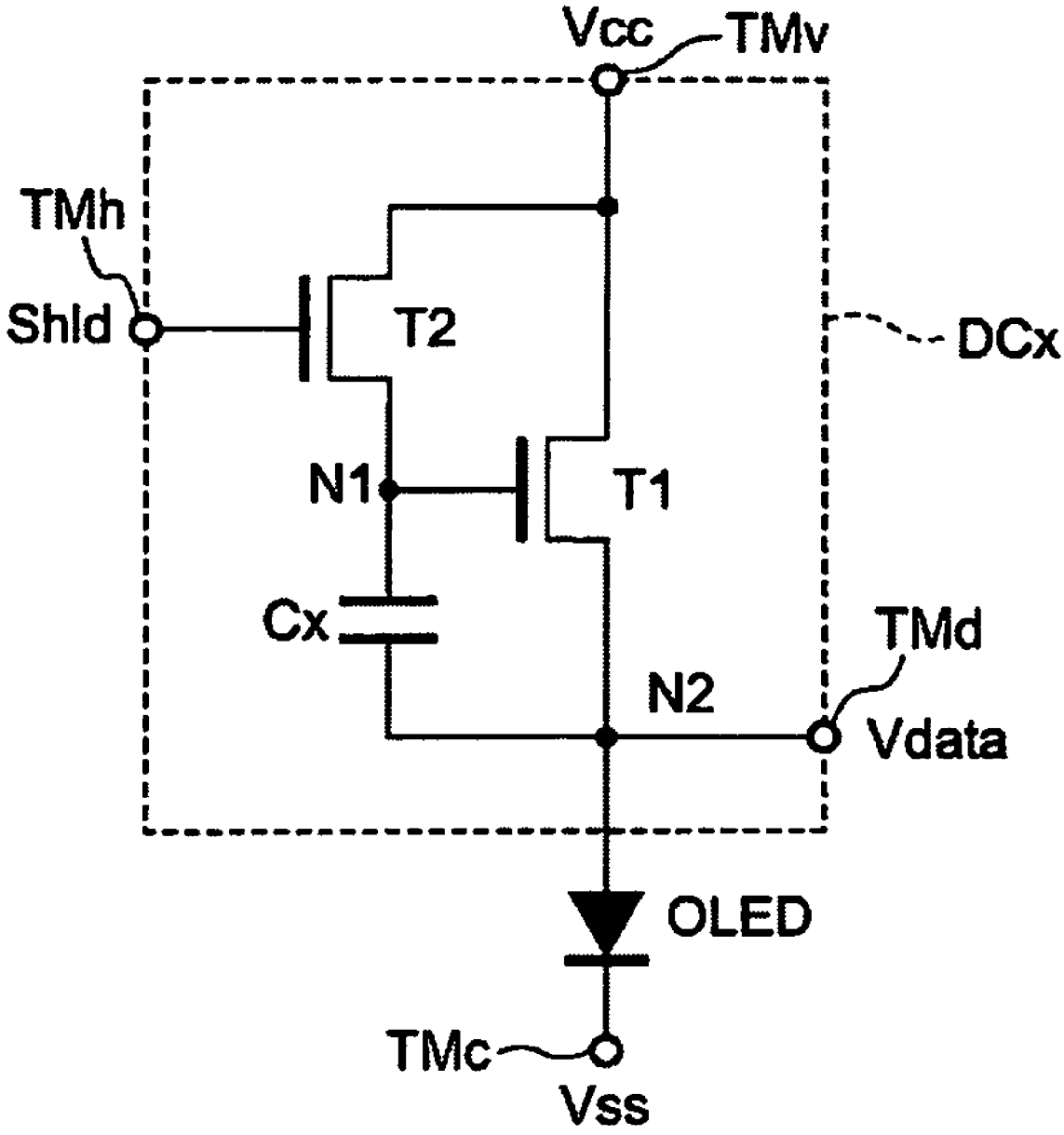
FIG. 1 is an equivalent circuit diagram showing the essential structure of an emission pixel to be applied to an emission apparatus according to the present invention.

FIG. 1 is an equivalent circuit diagram showing the essential structure of an emission pixel to be applied to the emission apparatus according to the present invention. The following description will be given of an example where an organic EL device is applied to a current drive type emission element provided at an emission pixel for the sake of convenience.

The emission pixel to be applied to the emission apparatus according to the present invention, as shown in FIG. 1, has a circuit configuration having a pixel circuit section (equivalent to a pixel drive circuit DC) DCx and an organic EL device OLED which is a current drive type emission element. The pixel circuit section DCx includes a drive transistor T1 having, for example, a drain terminal and a source terminal respectively connected to a power supply terminal TMv, which is applied with a supply voltage Vcc, and a node N2, and a gate terminal connected to a node N1, a hold transistor T2 having a drain terminal and a source terminal respectively connected to the power supply terminal TMv (drain terminal of the drive transistor T1), and the node N1, and a gate terminal connected to a control terminal TMh, and a capacitor Cx connected between the gate and source terminals of the drive transistor T1 (between the node N1 and node N2). The organic EL device OLED has an anode terminal connected to the node N2, and a cathode terminal TMc applied with a voltage Vss.

As will be given in the description of the control operation to be described later, a supply voltage Vcc having a voltage value which differs according to an operational state is applied to the power supply terminal TMv according to the operational state of the emission pixel (pixel circuit section DCx), a constant voltage (reference voltage) Vss is applied to the cathode terminal TMc of the organic EL device OLED, a hold control signal Shld is applied to the control terminal TMh, and a data voltage Vdata corresponding to a gradation value of emission data is applied to a data terminal TMd connected to the node N2.

The capacitor Cx may be a parasitic capacitor formed between gate and source terminals of the drive transistor T1 or a capacitive element formed between the node N1 and the node N2 in addition to the parasitic capacitor. The device structures, characteristics and so forth of the drive transistor T1 and the hold transistor T2, which are not particularly limited, are those of an n-channel thin film transistor applied thereto herein.

<Control Operation of Emission Pixel>

Next, the control operation (control method) for an emission pixel (pixel circuit section DCx and organic EL device OLED) having the foregoing circuit structure will be described.

Figure 2:
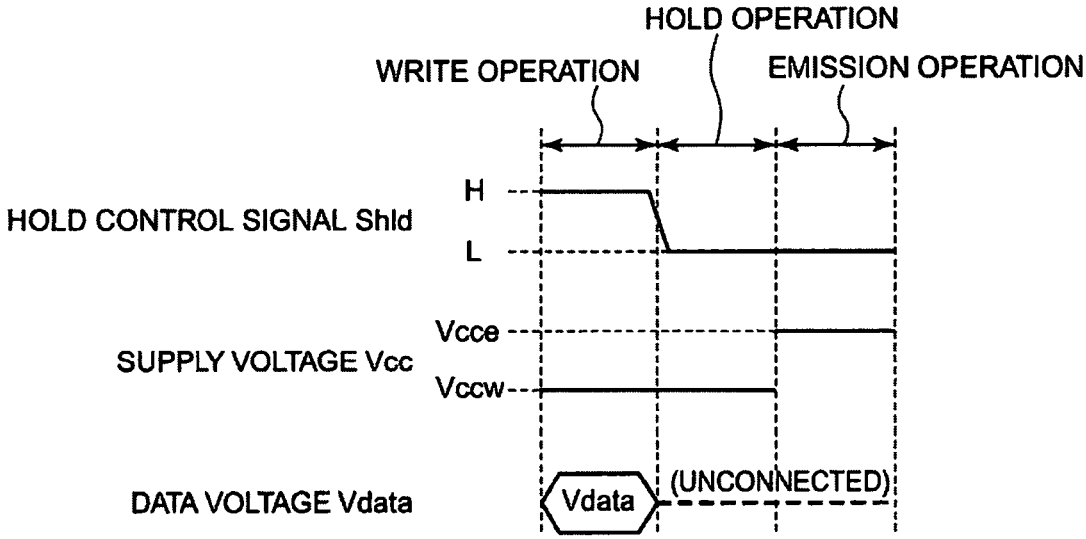
FIG. 2 is a signal waveform diagram showing the control operation of the emission pixel to be applied to the emission apparatus according to the invention.

FIG. 2 is a signal waveform diagram showing the control operation of the emission pixel to be applied to the emission apparatus according to the invention.

As shown in FIG. 2, the operational state of the emission pixel (pixel circuit section DCx) having the circuit structure as shown in FIG. 1 can be roughly divided into a write operation of writing a voltage component according to the gradation value of emission data in the capacitor Cx, a hold operation of holding the voltage component, written in the write operation, in the capacitor Cx, and an emission operation of letting an emission drive current according to the gradation value of emission data flow to the organic EL device OLED based on the voltage component held in the hold operation and causing the organic EL device OLED to emit light at a luminance gradation according to the emission data. The individual operational states will be specifically explained below referring to the timing chart shown in FIG. 2.

(Write Operation)

In the write operation, an operation of writing a voltage component according to the gradation value of emission data in the capacitor Cx is performed in a light-OFF state where the organic EL device OLED does not emit light.

Figure 3B:
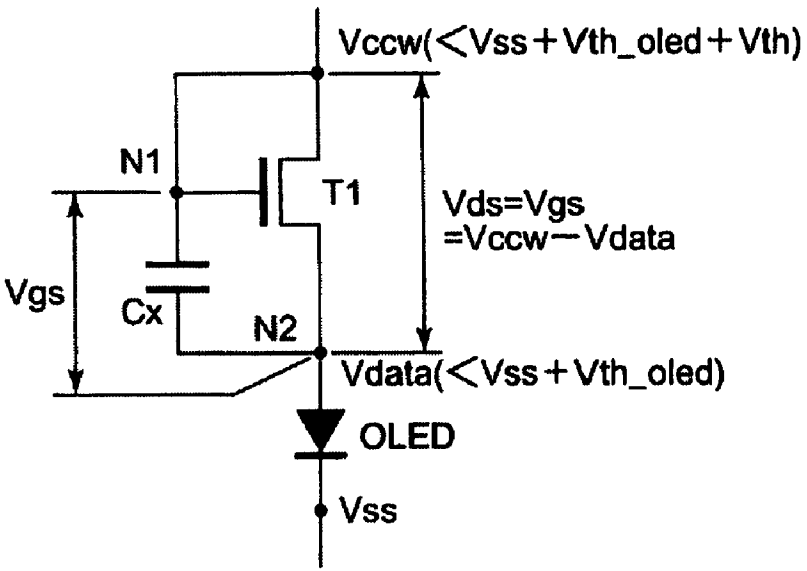
FIGS. 3A and 3B are schematic explanatory diagrams showing operational states when the emission pixel is in write operation.
Figure 3A:
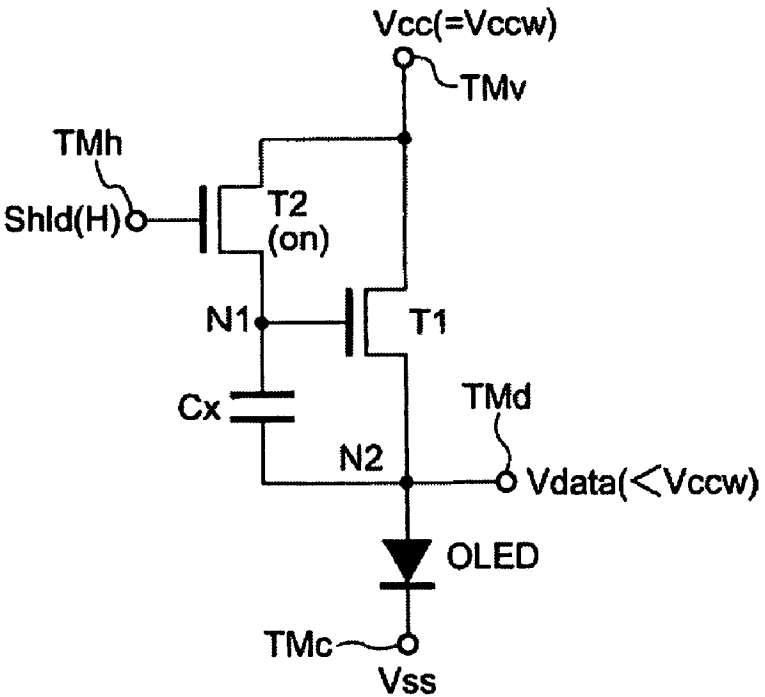

FIGS. 3A and 3B are schematic explanatory diagrams showing the operational states when the emission pixel is in write operation.

Figure 4A:
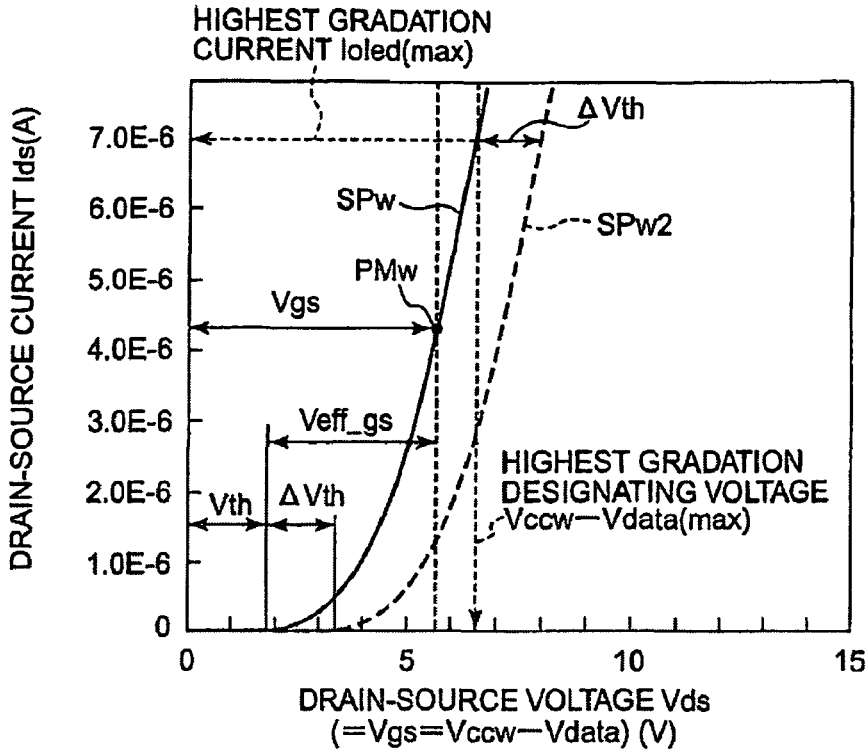
FIGS. 4A and 4B are respectively a characteristic diagram showing the operational characteristic of a drive transistor when the emission pixel is in write operation, and a characteristic diagram showing the relationship between a drive current and a drive voltage of an organic EL device.
Figure 4B:
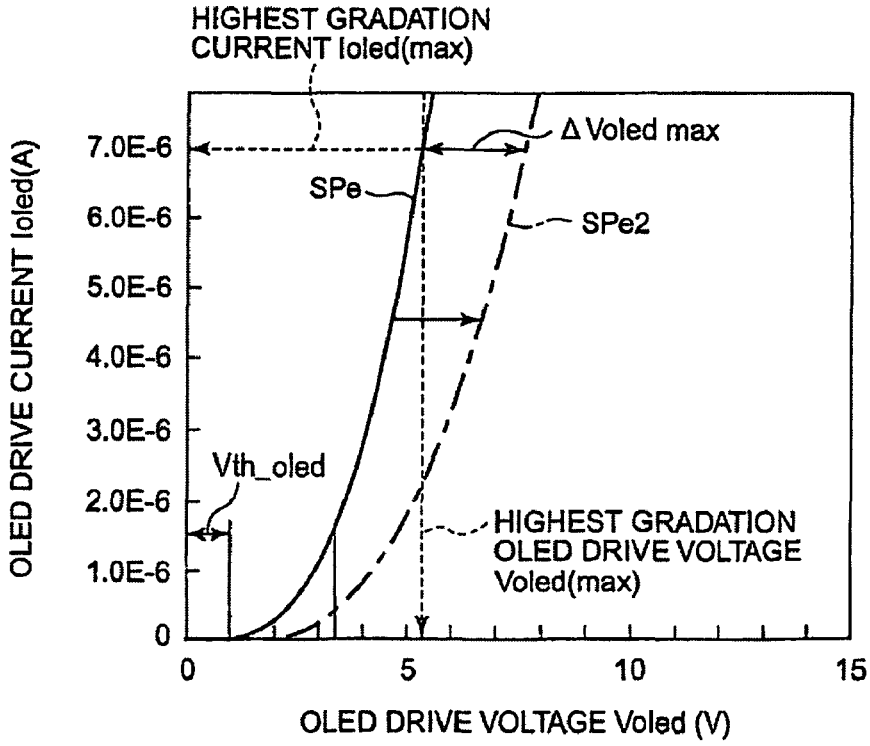

FIG. 4A is a characteristic diagram showing the operational characteristic of the drive transistor when the emission pixel is in write operation, and FIG. 4B is a characteristic diagram showing the relationship between the drive current and drive voltage of the organic EL device.

A solid line SPw shown in FIG. 4A is a characteristic curve showing the relationship between a drain-source voltage Vds and a drain-source current Ids in an initial state when an n-channel type thin film transistor is adopted as the drive transistor T1 and is diode-connected. A broken line SPw2 shows one example of the characteristic curve of the drive transistor T1 when the characteristic thereof changes according to a drive history. The details will be given later. A point PMw on the characteristic curve SPw indicates an operational point of the drive transistor T1.

As shown in FIG. 4A, a threshold voltage Vth (gate-source threshold voltage=drain-source threshold voltage) of the drive transistor T1 lies on the characteristic curve SPw, and the drain-source current Ids increases non-linearly according to an increase in drain-source voltage Vds when the drain-source voltage Vds exceeds the threshold voltage Vth. That is, of the drain-source voltage Vds, a voltage denoted by Veff_gs in FIG. 4A is a voltage component which effectively forms the drain-source current Ids, and the drain-source voltage Vds becomes the sum of the threshold voltage Vth and the voltage component Veff_gs as given by an equation 1 below.

$$Vds=Vth+Veff_gs \quad (1)$$

A solid line SPe shown in FIG. 4B is a characteristic curve showing the relationship between a drive voltage Voled to be applied between the anode and cathode of the organic EL device OLED in an initial state, and a drive current Ioled which flows between the anode and cathode of the organic EL device OLED. A one-dot chain line SPe2 shows one example of the characteristic curve of the organic EL device OLED when the characteristic thereof changes according to a drive history. The details will be given later. A threshold voltage Vth_oled lies on the characteristic curve SPe, and the drive current Ioled increases non-linearly according to an increase in drive voltage Voled when the drive voltage Voled exceeds the threshold voltage Vth_oled.

In the write operation, first, an ON-level (high-level) hold control signal Shld is applied to the control terminal TMh of the hold transistor T2 to turn on the hold transistor T2 as shown in FIGS. 2 and 3A. Accordingly, the gate and drain terminals of the drive transistor T1 are connected together (short-circuited) to set the drive transistor T1 in a diode-connected state.

Subsequently, a first supply voltage Vccw for the write operation is applied to the power supply terminal TMv, and the data voltage Vdata corresponding to the gradation value of emission data is applied to the data terminal TMd. At this time, the current Ids according to a potential difference (Vccw−Vdata) between the drain and source terminals of the drive transistor T1 flows between the drain and source terminals thereof. The data voltage Vdata is set to a voltage value for the organic EL device OLED to emit light at a luminance gradation according to the emission data.

Because the drive transistor T1 is diode-connected at this time, as shown in FIG. 3B, the drain-source voltage Vds of the drive transistor T1 becomes equal to the gate-source voltage Vgs as given by an equation 2 below.

$$Vds=Vgs=Vccw-V\mathrm{data} \quad (2)$$

Then, the gate-source voltage Vgs is written (charged) in the capacitor Cx.

Conditions necessary for the first supply voltage Vccw will be described. As the drive transistor T1 is of an n-channel type, for the drain-source current Ids to flow, the gate potential of the drive transistor T1 should be positive (high potential) to the source potential, and a relationship given by the following equation 3 should be fulfilled for the gate potential is equal to the drain potential or the first supply voltage Vccw, and the source potential is the data voltage Vdata.

$$\mathrm{Vdata}<\mathrm{Vccw} \quad (3)$$

With the node N2 connected to the data terminal TMd and the anode terminal of the organic EL device OLED, the potential difference between the potential at the node N2 (data voltage Vdata) and the voltage Vss at the cathode terminal TMc of the organic EL device OLED should be equal to or less than the emission threshold voltage Vth_oled of the organic EL device OLED to set the organic EL device OLED in a light-OFF state at the time of writing. Therefore, the potential at the node N2 (data voltage Vdata) should fulfill an equation 4 below.

$$V\mathrm{data}-Vss\leqq Vth_oled \quad (4)$$

With Vss set to a ground potential of 0 V, the equation becomes an equation 5 below.

$$\mathrm{Vdata}\leqq\mathrm{Vth_oled} \quad (5)$$

Next, an equation 6 is derived from the equations 2 and 5.

$$Vccw-Vgs\leqq Vth_oled \quad (6)$$

For Vgs=Vds=Vth+Veff_gs from the equation 1, the following equation 7 is derived.

$$Vccw\leqq Vth_oled+Vth+Veff_gs \quad (7)$$

The equation 7 should be satisfied even for Veff_gs=0, so that Veff_gs=0 being set, an equation 8 below is derived.

$$V\mathrm{data}<Vccw\leqq Vth_oled+Vth \quad (8)$$

That is, in the write operation, the value of the first supply voltage Vccw in a diode-connected state should be set to a value which satisfies the relationship of the equation 8. Next, the influence of changes in the characteristics of the drive transistor T1 and the organic EL device OLED according to the drive history will be described. It is known that the threshold voltage Vth of the drive transistor T1 increases according to the drive history. The characteristic curve SPw2 shown in FIG. 4A shows one example of the characteristic curve when the drive-history originated change has occurred, and ΔVth shows the amount of a change in threshold voltage Vth. As illustrated, the characteristic change according to the drive history of the drive transistor T1 changes substantially in the form of the parallel shift of the initial characteristic curve. Therefore, the value of the data voltage Vdata needed to acquire the emission drive current (drain-source current Ids) according to the gradation value of the emission data should be increased by the change ΔVth of the threshold voltage Vth.

It is also known that the resistance of the organic EL device OLED is increased according to the drive history. A one-dot chain line SPe2 shown in FIG. 4B shows one example of a characteristic curve when the characteristic changes according to the drive history. A change in the characteristic caused by an increase in the resistance of the organic EL device OLED according to the drive history changes approximately in a direction of reducing the increasing ratio of the drive current Ioled to the drive voltage Voled with respect to the initial characteristic curve. That is, the drive voltage Voled for allowing the drive current Ioled needed for the organic EL device OLED to emit light at a luminance gradation according to emission data increases by the characteristic curve SPe2 minus the characteristic curve SPe. The amount of the change becomes maximum at the highest luminance where the drive current Ioled becomes a maximum value Ioled(max) as indicated by ΔVoled max in FIG. 4B.

(Hold Operation)

Figure 5A:
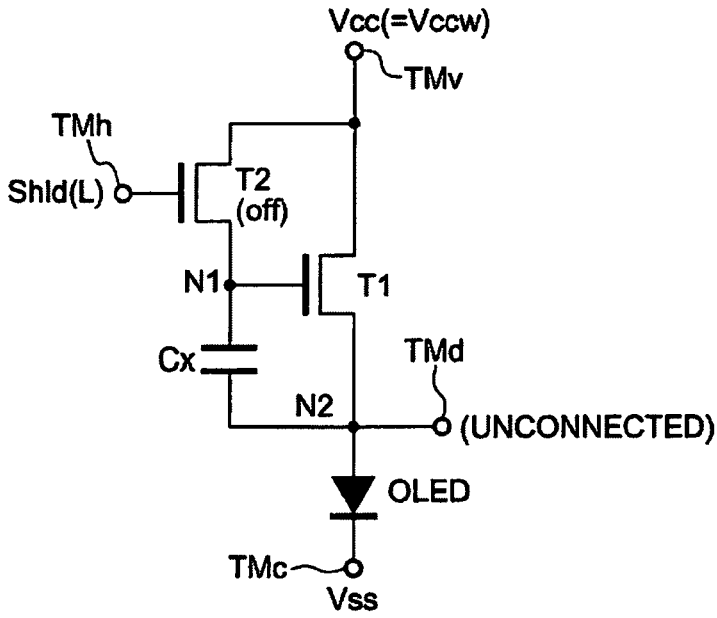
FIGS. 5A and 5B are schematic explanatory diagrams showing operational states when the emission pixel is in hold operation.
Figure 5B:
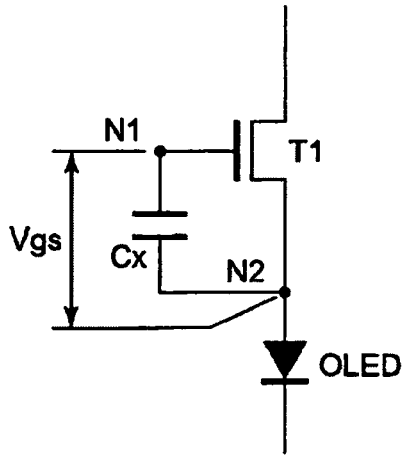

FIGS. 5A and 5B are schematic explanatory diagrams showing operational states when the emission pixel is in hold operation.

Figure 6:
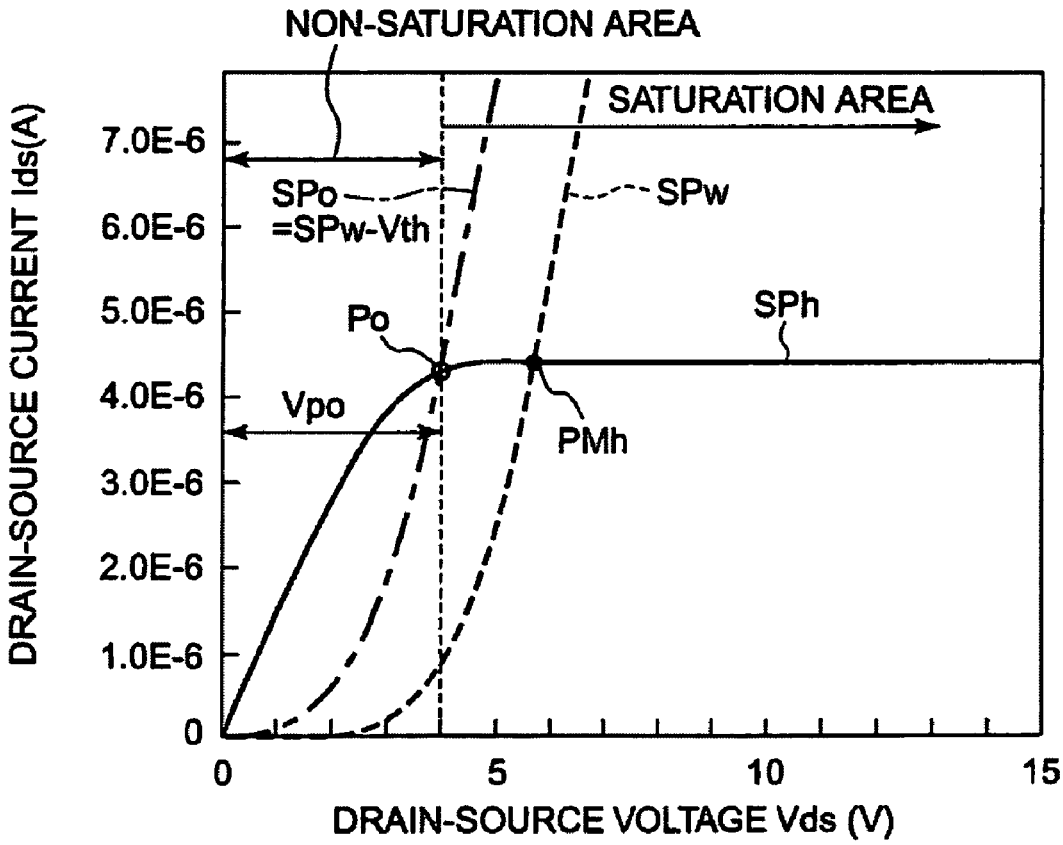
FIG. 6 is a characteristic diagram showing the operational characteristic of the drive transistor when the emission pixel is in hold operation.

FIG. 6 is a characteristic diagram showing the operational characteristic of the drive transistor when the emission pixel is in hold operation.

In the hold operation, as shown in FIGS. 2 and 5A, the OFF-level (low-level) hold control signal Shld is applied to the control terminal TMh to turn off the hold transistor T2, thereby blocking off (setting in a disconnected state) the gate and drain terminals of the drive transistor T1 to release the diode connection. As a result, as shown in FIG. 5B, the drain-source voltage Vds (=gate-source voltage Vgs) of the drive transistor T1 which is charged in the capacitor Cx in the write operation is held.

A solid line SPh shown in FIG. 6 is a characteristic curve when the diode connection of the drive transistor T1 is released to set the gate-source voltage Vgs to a constant voltage (e.g., voltage held in the capacitor Cx in the hold operation period). A broken line SPw shown in FIG. 6 is a characteristic curve when the drive transistor T1 is diode-connected. An operational point PMh in hold operation mode is the intersection between the characteristic curve SPw when diode connection is established and the characteristic curve SPh when diode connection is released.

A one-dot chain line SPo shown in FIG. 6 is derived as a characteristic curve SPw-Vth, and an intersection Po between the one-dot chain line SPo and the characteristic curve SPh indicates a pinch-off voltage Vpo. As shown in FIG. 6, an area in the characteristic curve SPh from a point where the drain-source voltage Vds is 0 V to a point where it is the pinch-off voltage Vpo becomes an non-saturation area, and an area where the drain-source voltage Vds exceeds the pinch-off voltage Vpo becomes a saturation area.

(Emission Operation)

Figure 7B:
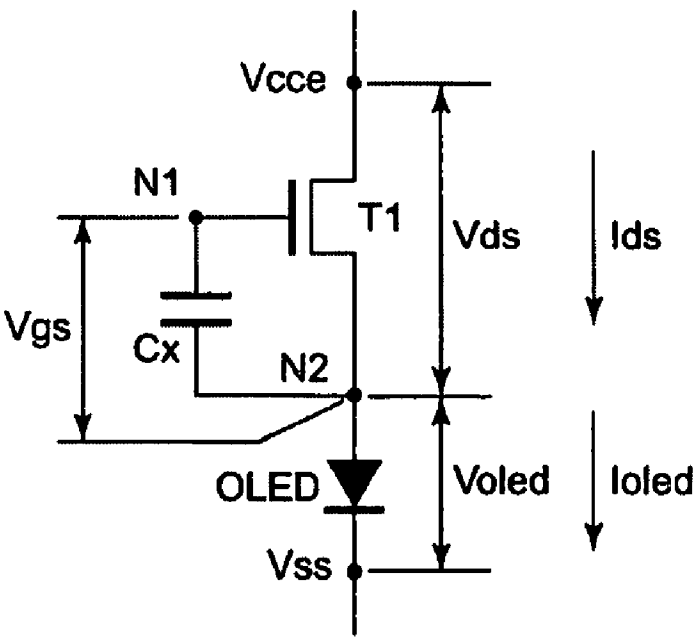
FIGS. 7A and 7B are schematic explanatory diagrams showing operational states when the emission pixel is in emission operation.
Figure 7A:
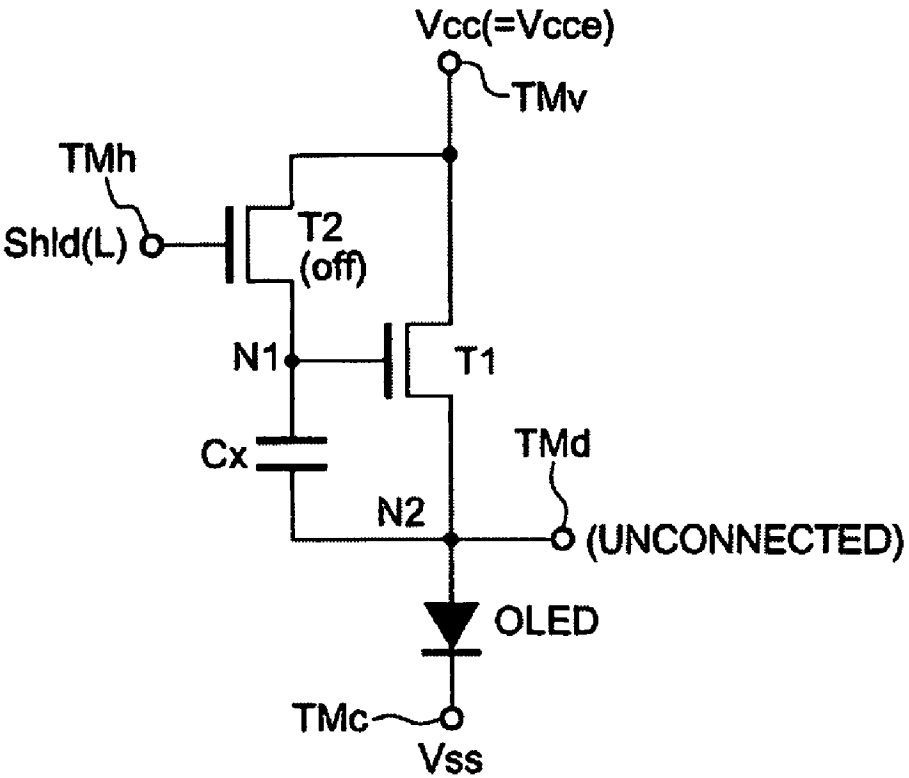

FIGS. 7A and 7B are schematic explanatory diagrams showing operational states when the emission pixel is in emission operation.

Figure 8A:
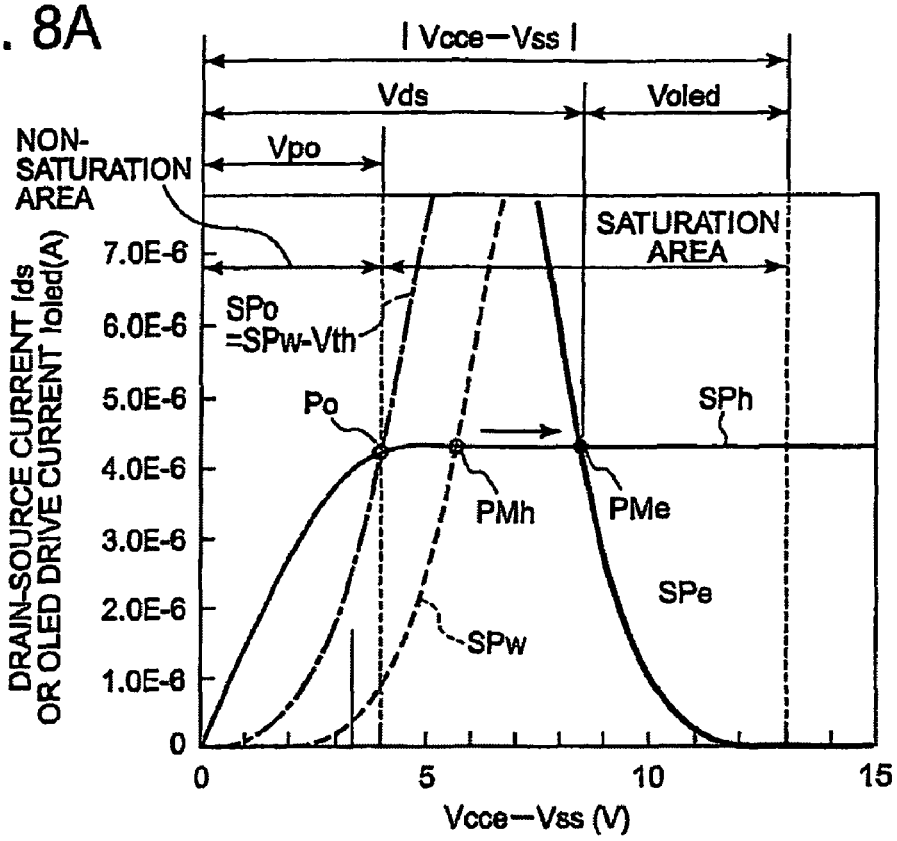
FIGS. 8A and 8B are respectively a characteristic diagram showing the operational characteristic of the drive transistor when the emission pixel is in emission operation, and a characteristic diagram showing the load characteristic of the organic EL device.
Figure 8B:
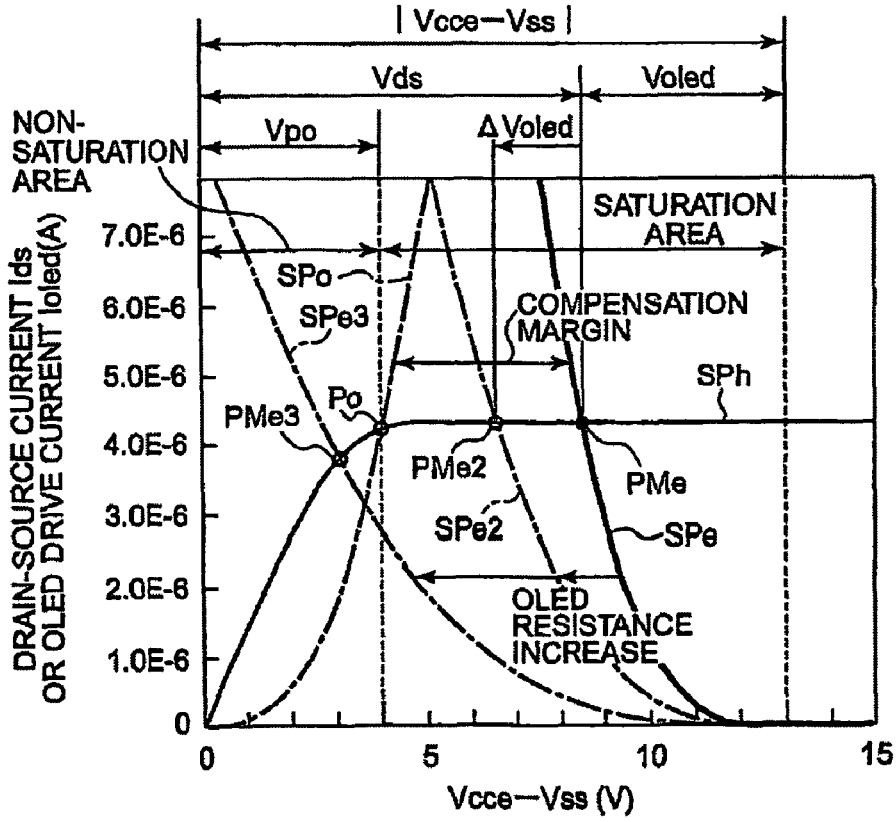

FIGS. 8A and 8B are respectively a characteristic diagram showing the operational characteristic of the drive transistor when the emission pixel is in emission operation, and a characteristic diagram showing the load characteristic of the organic EL device.

As shown in FIGS. 2 and 7A, the state where the OFF-level hold control signal Shld is applied to the control terminal TMh (state where the diode connection is released) is maintained, and the first supply voltage Vccw for writing the supply voltage Vcc at the power supply terminal TMv is switched to the second supply voltage Vcce. Consequently, the current Ids according to the gate-source voltage Vgs held in the capacitor Cx flows between the drain and source terminals of the drive transistor T1 to be supplied to the organic EL device OLED, so that the organic EL device OLED emits light at a luminance according to the value of the supplied current.

A solid line SPh shown in FIG. 8A is the characteristic curve of the drive transistor T1 when the gate-source voltage Vgs is set to a constant voltage (e.g., voltage held in the capacitor Cx from the hold operation period to the emission operation period). A solid line SPe indicates the load curve of the organic EL device OLED, which is a plot of the inverse drive voltage Voled v.s. drive current Ioled characteristic of the organic EL device OLED with the potential difference between the power supply terminal TMv and the cathode terminal TMc of the organic EL device OLED, i.e., the value of Vcce−Vss taken as a reference.

The operational point of the drive transistor T1 in the emission operation moves to PMe which is the characteristic curve SPh of the drive transistor T1 and the load curve SPe of the organic EL device OLED. As shown in FIG. 8A, the operational point PMe represents a point where the voltage Vcce−Vss, applied between the power supply terminal TMv and the cathode terminal TMc of the organic EL device OLED, is distributed between the drain and source terminals of the drive transistor T1 and the anode and cathode terminals of the organic EL device OLED. That is, at the operational point PMe, the voltage Vds is applied between the drain and source terminals of the drive transistor T1, and the drive voltage Voled is applied between the anode and cathode of the organic EL device OLED.

The operational point PMe should be kept within a saturation area on the characteristic curve in order not to change the current Ids which is let to flow between the drain and source terminals of the drive transistor T1 in the write operation mode and the drive current Ioled to be supplied to the organic EL device OLED in the emission operation mode. Voled becomes a maximum Voled(max) at the highest gradation. To keep the aforementioned PMe within the saturation area, therefore, the value of the second supply voltage Vcce should satisfy the condition given by an equation 9.

$$Vcce-Vss \geqq Vpo+Voled(\max) \tag{9}$$

If Vss is set to the ground potential of 0 V, an equation 10 is derived.

$$Vcce \geqq Vpo+Voled(\max) \tag{10}$$

<Relationship Between Variation in Characteristic of Organic EL Device and Voltage-Current Characteristic>

As shown in FIG. 4B, the resistance of the organic EL device OLED increases according to the drive history and changes in the direction of reducing the increasing ratio of the drive current Ioled with respect to the drive voltage Voled. That is, the resistance changes in the direction of reducing the inclination of the load curve SPe of the organic EL device OLED shown in FIG. 8A. FIG. 8B shows a change in the load curve SPe of the organic EL device OLED according to the drive history, and the load curve changes like SPe→SPe2→SPe3. As a result, the operational point of the drive transistor T1 shifts the characteristic curve SPh of the drive transistor T1 in the direction of PMe→PMe2→PMe3 according to the drive history.

At this time, while the operational point lies in the saturation area (PMe→PMe2), the drive current Ioled keeps the value of the expected current in the write operation mode, but when the operational point enters the saturation area (PMe3), the drive current Ioled becomes smaller than the expected current in the write operation mode, i.e., the difference between the current value of the drive current Ioled flowing to the organic EL device OLED and the current value of the expected current in the write operation mode becomes apparently different, so that the characteristic changes. In FIG. 8B, a pinch-off point Po lies between the non-saturation area and the saturation area, i.e., the potential difference between the operational point PMe and the pinch-off point Po in emission mode becomes a compensation margin for keeping the OLED drive current in emission mode with respect to achievement of high resistance of the organic EL. In other words, the potential difference on the characteristic curve SPh of the drive transistor sandwiched between the locus SPo of the pinch-off point and the load curve SPe of the organic EL device at each Ioled level, and becomes a compensation margin. As shown in FIG. 8B, the compensation margin decreases according to an increase in the value of the drive current Ioled, and increases according to an increase in the voltage Vcce-Vss applied between the power supply terminal TMv and the cathode terminal TMc of the organic EL device OLED.

<Relationship Between Variation in Characteristic of TFT Device and Voltage-Current Characteristic>

In voltage gradation control using a transistor which is adapted to the above-described emission pixel (pixel circuit section), the data voltage Vdata is set by the initially preset characteristics of the drain-source voltage Vds of the transistor and the drain-source current Ids (initial characteristics), but the threshold voltage Vth increases according to the drive history, so that the current value of the emission drive current does not correspond to emission data (data voltage), disabling an emission operation at an adequate luminance gradation. It is known that when an amorphous silicon transistor is adopted, particularly, a variation in device characteristic becomes noticeable.

The following will illustrate one example of the initial characteristic of the drain-source voltage Vds and drain-source current Ids (voltage-current characteristic) in a case where an amorphous silicon transistor having designed values shown in Table 1 performs a display operation with 256 gradation levels.

TABLE 1

| <Transistor design values> | |
|---|---|
| Gate insulating film thickness | 300 nm (3000 Å) |
| Channel width W | 500 μm |
| Channel length L | 6.28 μm |
| Threshold voltage Vth | 2.4 V |

The voltage-current characteristic of an n-channel type amorphous silicon transistor or the relationship between the drain-source voltage Vds and drain-source current Ids shown in FIG. 4A will have an increase in Vth originating from cancellation of the gate field caused by carriers trapped in the gate insulating film according to the drive history or a change with time (shifting from SPw (initial state) to SPw2 (high-voltage side)). Accordingly, given that the drain-source voltage Vds applied to the amorphous silicon transistor is constant, the drain-source current Ids decreases to reduce the luminance of an emission element.

In the change in the device characteristic, mainly the threshold voltage Vth increases, and the voltage-current characteristic (V-I characteristic) of the amorphous silicon transistor becomes substantially the parallel shift of the characteristic curve in the initial state. Therefore, the V-I characteristic curve SPw2 after the shift is approximately identical to the voltage-current characteristic in a case where a given voltage corresponding to a change ΔVth (about 2 V in FIG. 4A) in threshold voltage Vth is added to the drain-source voltage Vds of the V-I characteristic curve SPw in the initial state (i.e., in a case where the V-I characteristic curve SPw is shifted in parallel by ΔVth).

In other words, this means that in performing the operation of writing emission data into an emission pixel (pixel circuit section DCx), a data voltage (equivalent to a correction gradation voltage Vpix to be discussed later) corrected by adding a given voltage (compensation voltage Vpth) corresponding to a change ΔVth in the device characteristic (threshold voltage) of the drive transistor T1 provided at the emission pixel can be applied to the source terminal (node N2) of the drive transistor T1 to compensate for the shift of the voltage-current characteristic originating from a change in threshold voltage Vth of the drive transistor T1, thereby allowing a drive current Iem having a current value according to the emission data to flow to the organic EL device OLED and enabling an emission operation at the desired luminance gradation.

The hold operation of changing the hold control signal Shld from the ON level to the OFF level and the emission operation of changing the supply voltage Vcc from the voltage Vccw to the voltage Vcce may be executed synchronously.

The general configuration of the emission apparatus with an emission area having a two-dimensional array of emission pixels including the structure of the essential portion of the above-described pixel circuit section will be illustrated and specifically described below.

First Embodiment

Emission Apparatus

Figure 9:
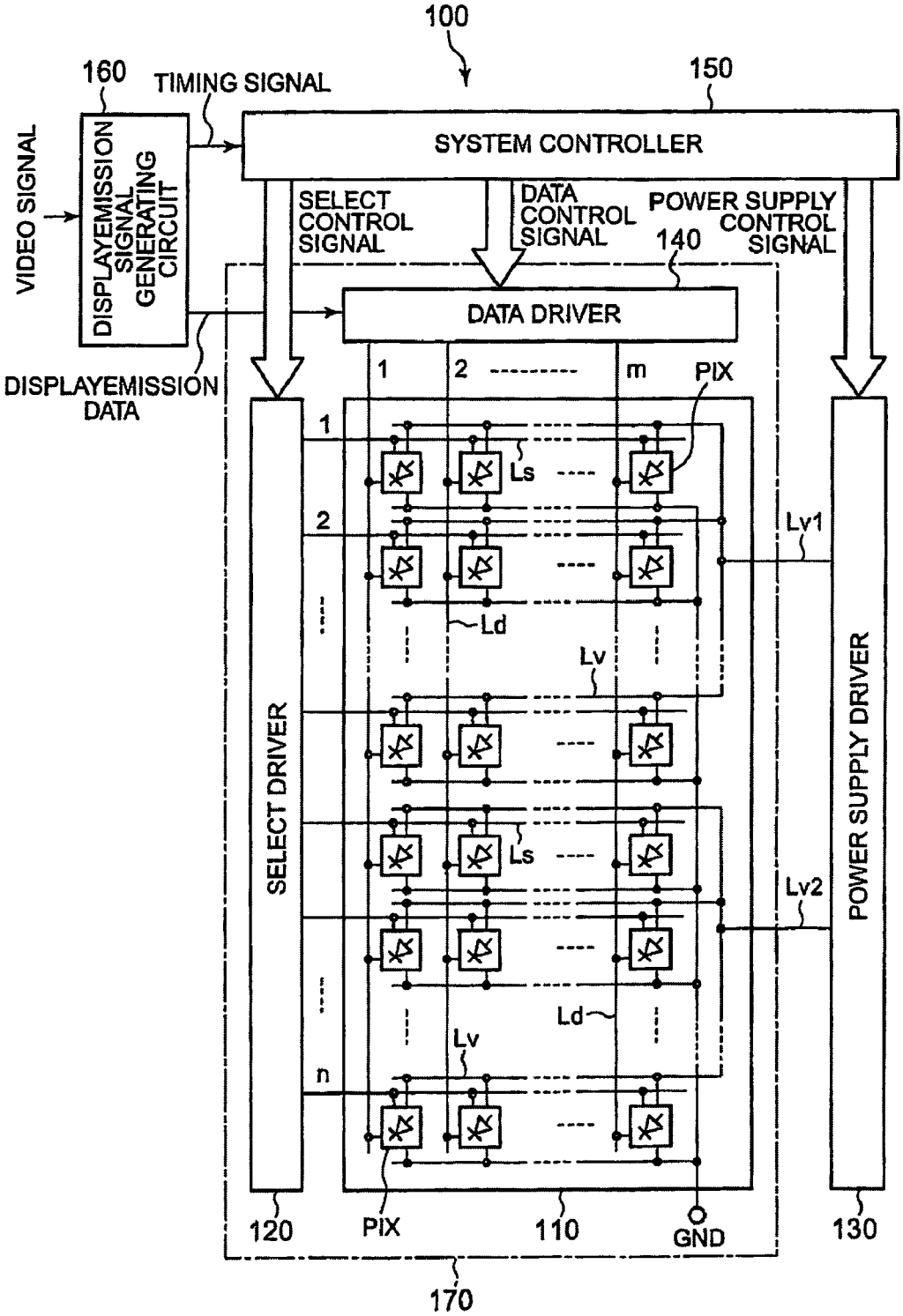
FIG. 9 is a schematic configurational diagram showing a first embodiment of the invention.

FIG. 9 is a schematic configurational diagram showing a first embodiment of the invention.

Figure 10:
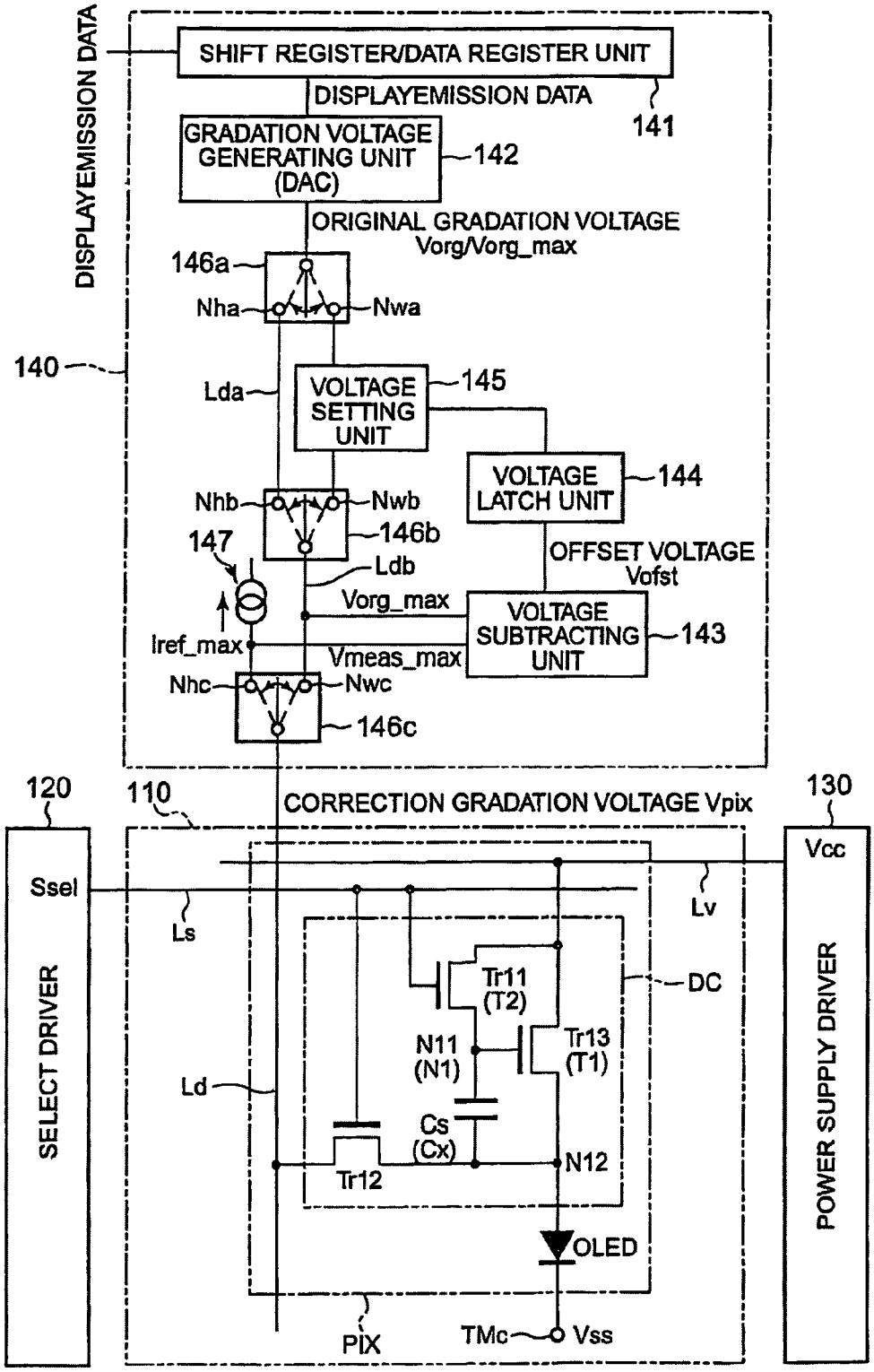
FIG. 10 is an essential configurational diagram exemplifying a data driver and an emission pixel to be applicable to the emission apparatus according to the first embodiment.

FIG. 10 is an essential configurational diagram exemplifying a data driver (emission drive apparatus) and an emission pixel (pixel circuit section and emission element) to be applicable to the emission apparatus according to the first embodiment.

In FIG. 10, reference numerals given to circuit structures corresponding to the above-described pixel circuit section DCx (see FIG. 1) are also shown. While various kinds of signals and data to be transferred among the individual components of the data driver, voltages and the like to be applied are shown for the sake of descriptive convenience, those signals, data, voltages, etc. are not necessarily be transferred or applied at the same time.

As shown in FIGS. 9 and 10, an emission apparatus 100 according to the embodiment has an emission area 110, a select driver 120, a power supply driver 130, a data driver (emission drive apparatus) 140, a system controller 150, an emission signal generating circuit 160, and an emission panel 170. The emission area 110 has an array of, for example, n rows by m columns (n and m being arbitrary positive integers) of a plurality of emission pixels PIX each including the essential structure (see FIG. 1) of the foregoing pixel circuit section DCx and provided near the intersection of each of a plurality of select lines Ls disposed in the row direction (right and left direction in the diagrams and each of a plurality of data lines Ld disposed in the column direction (up and down direction in the diagrams). The select driver 120 applies a select signal Ssel to each select line Ls at a predetermined timing. The power supply driver 130 applies a supply voltage Vcc of a predetermined voltage level to a plurality of supply voltage lines Lv, disposed in the row direction in parallel to the select lines L, at a predetermined timing. The data driver 140 supplies a gradation signal (correction gradation voltage Vpix) to each data line Ld at a predetermined timing. The system controller 150 generates and outputs a select control signal, a power supply control signal and a data control signal for controlling the operational states of at least the select driver 120, the power supply driver 130 and the data driver 140, based on a timing signal supplied from the emission signal generating circuit 160 to be described later. The emission signal generating circuit 160 generates and supplies emission data (luminance gradation data) comprised of a digital signal to the data driver 140, extracts or generates a timing signal (system clock or the like) for emitting predetermined image information on the emission area 110, and supplies the timing signal to the system controller 150, based on a video signal supplied from, for example, outside the emission apparatus 100. The emission panel 170 has a board on which the emission area 110, the select driver 120 and the data driver 140 are provided.

While the power supply driver 130 is connected outside the emission panel 170 via a film board in FIG. 9, it may be disposed on, for example, the emission panel 170. The data driver 140 may be configured so as to be partially provided at the emission panel 170 while a part of the remaining portion is connected outside the emission panel 170 via, for example, a film board. At this time, a part of the data driver 140 in the emission panel 170 may be an IC chip or may comprise transistors which are fabricated together with the individual transistors of pixel drive circuits DC (pixel circuit sections DCx) to be described later.

The select driver 120 may be an IC chip or may comprise transistors which are fabricated together with the individual transistors of the pixel drive circuits DC (pixel circuit sections DCx) to be described later.

(Emission Area)

In the emission apparatus 100 according to the embodiment, a plurality of emission pixels PIX are provided in a matrix array at the emission area 110 located at, for example, substantially the center of the emission panel 170. As shown in FIG. 9, for example, the emission pixels PIX are grouped into an upper area (upper side in the diagram) and a lower area (lower side in the diagram) of the emission area 110, and the emission pixels PIX included in each group are connected to respective branched supply voltage lines Lv. The individual supply voltage lines Lv of the upper area group are connected to a first supply voltage line Lv1, and the individual supply voltage lines Lv of the lower area group are connected to a second supply voltage line Lv2. The first supply voltage line Lv1 and the second supply voltage line Lv2 are connected to the power supply driver 130 electrically independently. That is, the supply voltage Vcc that is commonly applied to the emission pixels PIX of the first to n/2-th rows (n being an even number) in the upper area of the emission area 110 via the first supply voltage line Lv1 and the supply voltage Vcc that is commonly applied to the emission pixels PIX of the (1+n/2)-th to n-th rows in the lower area of the emission area 110 via the second supply voltage line Lv2 are independently output to the supply voltage lines Lv of different groups at different timings by the power supply driver 130.

(Emission Pixels)

The emission pixels PIX which are adopted in the embodiment are disposed near the intersections between the select lines Ls connected to the select driver 120 and the data lines Ld connected to the data driver 140. As shown in FIG. 10, for example, each emission pixel PIX has the organic EL device OLED, which is a current drive type emission element, and the pixel drive circuit DC, which includes the essential structure (see FIG. 1) of the above-described pixel circuit section DCx and generates an emission drive current for allowing the organic EL device OLED to emit light.

The pixel drive circuit DC includes a transistor Tr11 (diode-connecting transistor) which has a gate terminal connected to the select line Ls, a drain terminal connected to the supply voltage line Lv and a source terminal connected to the node N11, a transistor Tr12 (select transistor) which has a gate terminal connected to the select line Ls, a source terminal connected to the data line Ld and a drain terminal connected to the node N12, a transistor Tr13 (drive transistor) which has a gate terminal connected to the node N11, a drain terminal connected to the supply voltage line Lv and a source terminal connected to the node N12, and a capacitor Cs (capacitive element) connected between the node N11 and the node N12 (between the gate and source terminals of the transistor Tr13).

The transistor Tr13 corresponds to the drive transistor T1 in the essential structure (FIG. 1) of the pixel circuit section DCx, the transistor Tr11 corresponds to the hold transistor T2, the capacitor Cs corresponds to the capacitor Cx, and the nodes N11 and N12 respective correspond to the nodes N1 and N2. The select signal Ssel to be applied to the select line Ls by the select driver 120 corresponds to the aforementioned hold control signal Shld, and the gradation signal (correction gradation voltage Vpix) to be applied to the data line Ld by the data driver 140 corresponds to the aforementioned data voltage Vdata.

The organic EL device OLED has the anode terminal connected to the node N12 of the pixel drive circuit DC and the cathode terminal TMc to which the reference voltage Vss which is a constant voltage is applied. In the drive control operation of the emission apparatus which will be described later, in the write operation period where the gradation signal (correction gradation voltage Vpix) according to emission data is supplied to the pixel drive circuit DC, the correction gradation voltage Vpix applied by the data driver 140, the reference voltage Vss and the high-potential supply voltage Vcc (=Vcce) to be applied to the supply voltage line Lv in the emission operation period satisfy the relationships given in the equations 3 to 10, so that the organic EL device OLED is not turned on in the write operation mode.

The capacitor Cs may be a parasitic capacitor formed between the gate and source terminals of the transistor Tr13, or a capacitive element other than the transistor Tr13 formed between the node N1 and the node N2 in addition to the parasitic capacitor, or both.

The transistors Tr11 to Tr13 are not particularly limited, but an n-channel type amorphous silicon thin film transistor can be adopted for the transistors Tr11 to Tr13 if each constituted by an n-channel type field effect transistor. In this case, the pixel drive circuit DC having amorphous silicon thin film transistors with stable device characteristics (electron mobility, etc.) can be fabricated in a relatively simple fabrication process using the amorphous silicon fabrication technology already achieved. The following will describe a case where n-channel type thin film transistors are adopted for all of the transistors Tr11 to Tr13.

The circuit structure of the emission pixel PIX (pixel drive circuit DC) is not limited to the one shown in FIG. 10, and the emission pixel PIX may take another circuit structure as long as it has at least elements corresponding to the drive transistor T1, the hold transistor T2 and the capacitor Cx shown in FIG. 1, and the current path of the drive transistor T1 is connected in series to the current drive type emission element (organic EL device OLED). The emission element which is driven to emit light by the pixel drive circuit DC is not limited to the organic EL device OLED, but may be another current drive type emission element such as a light emitting diode.

(Select Driver)

The select driver 120 sets the emission pixels PIX of each row in either a selected state or an unselected state by applying the select signal Ssel of a selection level (high level for the emission pixel PIX shown in FIG. 10) to each select line Ls based on a select control signal supplied from the system controller 150. Specifically, for the emission pixels PIX of each row, during the compensation voltage acquiring operation period and write operation period to be described later, the operation of applying the select signal Ssel of the selection level (high level) to the select line Ls of that row is sequentially executed at predetermined timing row by row, thereby setting the emission pixels PIX of each row in the selected state (selection period).

The select driver 120 in use may have a shift register which sequentially outputs shift signals corresponding to the select lines Ls of the individual rows based on the select control signal supplied from the system controller 150, and an output circuit section (output buffer) which sequentially outputs the select signal Ssel to the select lines Ls of the individual rows. Some or all of the transistors included in the select driver 120 may be fabricated as amorphous silicon transistors together with the transistors Tr11 to Tr13 in the pixel drive circuit DC.

(Power Supply Driver)

Based on the power supply control signal supplied from the system controller 150, the power supply driver 130 applies the low-potential supply voltage Vcc (=Vccw; first supply voltage) to each supply voltage line Lv at least in the compensation voltage acquiring operation period and write operation period to be described later, and applies the supply voltage Vcc (=Vcce; second supply voltage) having a higher potential than the supply voltage Vccw in the write operation mode in the emission operation period.

In the embodiment, as shown in FIG. 9, the emission pixels PIX are grouped into, for example, the upper area and the lower area of the emission area 110, and the individual branched supply voltage lines Lv are laid out for each group, so that the power supply driver 130 outputs the supply voltage Vcc to the emission pixels PIX arrayed in the upper area via the first supply voltage line Lv1 in the operation period of the upper area group, and outputs the supply voltage Vcc to the emission pixels PIX arrayed in the lower area via the second supply voltage line Lv2 in the operation period of the lower area group.

The power supply driver 130 in use may have a timing generator (e.g., a shift register or the like which sequentially outputs the shift signals) which generates timing signals corresponding to the supply voltage lines Lv in each area (group), and an output circuit section which converts the timing signals to predetermined voltage levels (voltage values Vccw, Vcce) and outputs the voltage levels to the supply voltage lines Lv in each area as the supply voltage Vcc. If the number of the supply voltage lines is small like the first supply voltage line Lv1 and the second supply voltage line Lv2, the power supply driver 130 may be disposed at a part of the system controller 150, not at the emission panel 170.

(Data Driver)

The data driver 140 generates an offset voltage (compensation voltage) Vofst corresponding to a variable device characteristic (threshold voltage) of the emission driving transistor Tr13 (equivalent to the drive transistor T1) provided at each emission pixel PIX (pixel drive circuit DC) disposed in the emission area 110, performs a compensation process of adding the offset voltage Vofst to a signal voltage (original gradation voltage Vorg; gradation voltage) corresponding to the luminance gradation value included in emission data for each emission pixel PIX supplied from the emission signal generating circuit 160 to be described later, thereby generating the correction gradation voltage Vpix, and supplies the correction gradation voltage Vpix to each emission pixel PIX via the data line Ld. The device characteristic of the transistor Tr13 shows a variation characteristic of the threshold voltage which differs from one transistor Tr13 from another in the initial state, or a characteristic in which the absolute value of the threshold voltage shifts toward the high voltage side with time.

The data driver 140 according to the embodiment, as shown in FIG. 10, for example, includes a shift register/data register unit 141, a gradation voltage generating unit 142, a voltage subtracting unit 143, a voltage latch unit 144, a voltage setting unit 145, signal path changeover switches (changeover switches) 146*a*, 146*b*, 146*c*, and a current source 147. The gradation voltage generating unit 142, the voltage subtracting unit 143, the voltage latch unit 144, the voltage setting unit 145, the signal path changeover switches 146*a*, 146*b*, 146*c* and the current source 147, excluding the shift register/data register unit 141, are provided for the data line Ld of each column, and m sets of those components are provided in the data driver 140 in the emission apparatus 100 according to the embodiment.

The shift register/data register unit 141 includes, for example, a shift register which sequentially outputs shift signals based on the data control signal supplied from the system controller 150, and a data register which sequentially fetches emission data (luminance gradation data) corresponding to one row of emission pixels PIX of the emission area 110, sequentially supplied from the emission signal generating circuit 160 as serial data, and transfers the emission data in parallel to the gradation voltage generating units 142 provided for each column based on the shift signals.

The gradation voltage generating unit 142 generates and outputs an original gradation voltage Vorg_x having a voltage value for causing the organic EL device OLED to perform emission at a luminance gradation based on the emission data of each emission pixel PIX fetched via the shift register/data register unit 141, or non-emission (black display operation).

In the compensation voltage acquiring operation to be described later, the gradation voltage generating unit 142 outputs an original gradation voltage Vorg (Vorg_max) for acquiring the offset voltage, which is a theoretical voltage between the supply voltage line Lv and the data line Ld when a reference current Iref with a predetermined gradation (e.g., reference current Iref_max with the highest gradation) flows to the transistor Tr13 in the state of the V-I characteristic curve SPw, to the voltage subtracting unit 143 based on the luminance gradation value of predetermined emission data output from the shift register/data register unit 141 or without any input from the shift register/data register unit 141.

The structure that generates the original gradation voltage Vorg_x having a voltage value according to emission data can include a digital-analog converter (D/A converter) which converts a digital signal voltage of the emission data into an analog signal voltage, and an output circuit which outputs the analog signal voltages the original gradation voltage Vorg_x at a predetermined timing.

In the compensation voltage acquiring operation mode, the voltage subtracting unit 143 generates and outputs the offset voltage (compensation voltage) Vofst according to a change in the threshold voltage (equivalent to ΔVth shown in FIG. 4A) of the transistor Tr13 of each emission pixel PIX (pixel drive circuit DC) based on the result (to be described later in detail) of an operation on the original gradation voltage Vorg (Vorg_max; reference potential) output from the gradation voltage generating unit 142 and a potential (data line voltage) Vmeas_max, generated on the data line Ld as the reference current Iref with a predetermined gradation (reference current Iref_max with the highest gradation) is let to flow thereto by the current source 147 to be described later.

Specifically, the offset voltage Vofst generated by the voltage subtracting unit 143 is set to a voltage value acquired by performing a computation (subtraction) of the difference between the potential Vmeas_max input to the voltage subtracting unit 143 via the data line Ld and the original gradation voltage Vorg (Vorg_max) input to the voltage subtracting unit 143 to acquire the offset voltage, as expressed by the following equation 11.

$$Vofst = Vmeas_max - Vorg_max \quad (11)$$

The offset voltage Vofst is set, in this manner, to a voltage value equivalent to a deviation (mainly a deviation or variation in the threshold voltage of the transistor Tr13) between the potential Vorg_max preset to be the gate-source potential of the transistor Tr13 to allow the organic EL device OLED to emit light at a predetermined gradation (highest luminance gradation in this example) and the potential Vmeas_max or the potential at the voltage subtracting unit 143, which changes due to some factors, such as an increase in the resistance of the pixel drive circuit DC with time and a variation in the characteristic of the individual pixel drive circuits DC in the emission area 110, when the reference current Iref_max having a current value to allow the organic EL device OLED to emit light at the predetermined gradation is actually let to flow via the pixel drive circuit DC and the data line Ld. Accordingly, by compensating for the original gradation voltage Vorg output from the gradation voltage generating unit 142 based on the original gradation voltage Vorg and the offset voltage Vofst, not directly outputting the original gradation voltage Vorg, in the write operation, the correction gradation voltage Vpix is set to have a voltage value reflecting the corrected value of a change in the threshold voltage of the transistor Tr13 of each emission pixel PIX (pixel drive circuit DC) and the corrected value of a change in the threshold voltage of the transistor Tr12, so that the compensation gradation current approximated to the normal current value corresponding to the luminance gradation value of emission data flows between the drain and source of the transistor Tr13.

The voltage latch unit 144 holds the offset voltage Vofst output from the voltage subtracting unit 143 in the compensation voltage acquiring operation, and outputs the offset voltage Vofst to the voltage setting unit 145 to be described later in the write operation. In a period (source period) where emission pixels PIX of a specific row are set in the selected state by the select driver 120 and the compensation voltage acquiring operation and write operation is executed, the voltage latch unit 144 keeps the operation of holding the offset voltage Vofst acquired by the emission pixels PIX of that row.

In the write operation, the voltage setting unit 145 adds the original gradation voltage Vorg output from the gradation voltage generating unit 142 and the offset voltage Vofst held in the voltage latch unit 144 to generate the correction gradation voltage Vpix, and outputs the correction gradation voltage Vpix to the data line Ld laid out in the emission area 110 in the column direction thereof. Specifically, the correction gradation voltage Vpix has a value satisfying the following equation 12.

$$Vpix=Vorg+Vofst \tag{12}$$

That is, the offset voltage Vofst computed by the voltage subtracting unit 143 and held in the voltage latch unit 144 is analogically (in case where the gradation voltage generating unit 142 has a D/A converter) or digitally added to the original gradation voltage Vorg according to the luminance gradation value of emission data output from the gradation voltage generating unit 142, and a voltage component or the sum of both voltages is output to the data line Ld as the correction gradation voltage Vpix. Because the correction gradation voltage Vpix contains a potential deviation which changes due to some factors, such as an increase in the resistance of the pixel drive circuit DC with time and a variation in the characteristic of the individual pixel drive circuits DC in the emission area 110, therefore, the gate-source potential of the transistor Tr13 can accurately be set to a potential matching with the luminance gradation.

When the pixel drive circuit DC has the circuit structure shown in FIG. 10, as will be described later, the current that is let to flow to the data line Ld in the write operation mode is set in the direction of pulling the current toward the data driver 140 from the data line Ld, so that the correction gradation voltage Vpix to be generated by the voltage setting unit 145 is set to a voltage value having a negative polarity with respect to the supply voltage Vcc (=Vccw) of the supply voltage line Lv in the write operation mode so that the current flows between the drain and source of the transistor Tr13, between the drain and source of the transistor Tr12 and via the data line Ld from the supply voltage line Lv.

The signal path changeover switch 146*a* has a compensation node Nha and a write node Nwa, and selectively connects the gradation voltage generating unit 142 to either a signal line Lda on the compensation node Nha side or the voltage setting unit 145 on the write node Nwa side. The signal path changeover switch 146*b* has a compensation node Nhb and a write node Nwb, and selectively connects a signal line Ldb to either the signal line Lda on the compensation node Nhb side or the voltage setting unit 145 on the write node Nwb side. The signal path changeover switch 146*b* has a compensation node Nhc and a write node Nwc, and selectively connects the data line Ld to either the current source 147 on the compensation node Nhc side, which compels the flow of the reference current Iref_max, or the signal line Ldb on the write node Nwc side.

In other words, in the compensation voltage acquiring operation to be described later, the signal path changeover switches 146*a*, 146*b* and 146*c* are respectively set to the compensation node Nha side, the compensation node Nhb side and the compensation node Nhc side, the gradation voltage generating unit 142 is connected to the voltage subtracting unit 143 via the signal lines Lda, Ldb to fetch the original gradation voltage Vorg_max for acquiring the offset voltage output from the gradation voltage generating unit 142, and the data line Ld is connected to the current source 147, so that the potential Vmeas_max, based on the reference current Iref_max flowing to the current source 147, is fetched into the voltage subtracting unit 143. In the write operation, the signal path changeover switches 146*a*, 146*b* and 146*c* are respectively set to the compensation node Nwa side, the compensation node Nwb side and the compensation node Nwc side, and the gradation voltage generating unit 142 is connected to the voltage setting unit 145 via the signal line Ldb, so that the correction gradation voltage Vpix, generated by the voltage setting unit 145 based on the original gradation voltage Vorg_x according to the emission data and the offset voltage Vofst, is applied to the emission pixel PIX via the data line Ld.

In the compensation voltage acquiring operation, the current source 147 lets a reference current with a predetermined gradation (e.g., reference current Iref_max with the highest gradation) flow to the pixel drive circuits DC of the emission pixels PIX of a row set in the selected state via the data line Ld. The potential Vmeas_max on the current source 147 side when the reference current Iref_max is let to flow is fetched into the voltage subtracting unit 143 to generate the offset voltage Vofst.

(System Controller)

The system controller 150 supplies each of the select driver 120, the power supply driver 130 and the data driver 140 with the select control signal, the power supply control signal and the data control signal for controlling the operational states thereof to operate the individual drivers at predetermined timings to generate and output the select signal Ssel, the supply voltage Vcc, the correction gradation voltage Vpix and the reference current Iref_max having predetermined voltage levels, and to execute a sequence of drive control operations (compensation voltage acquiring operation, write operation, hold operation and emission operation) on each emission pixel PIX, thereby controlling display of predetermined image information based on a video signal on the emission area 110.

(Emission Signal Generating Circuit)

The emission signal generating circuit 160 extracts a luminance gradation signal component from a video signal supplied from, for example, outside the emission apparatus 100, and supplies the luminance gradation signal component to the data driver 140 as emission data (luminance gradation data) comprised of a digital signal for each row. When the video signal, like a TV broadcast signal (composite video signal), contains a timing signal component defining the emission signal timing for image information, the emission signal generating circuit 160 may have a function of extracting and supplying the timing signal component to the system controller 150 in addition to the function of extracting the luminance gradation signal component. In this case, the system controller 150 generates the control signals to be individually supplied to the select driver 120, the power supply driver 130 and the data driver 140 based on the timing signals supplied from the emission signal generating circuit 160.

<Drive Method for Emission Apparatus>

Next, a drive method for the emission apparatus according to the embodiment will be described.

Figure 11:
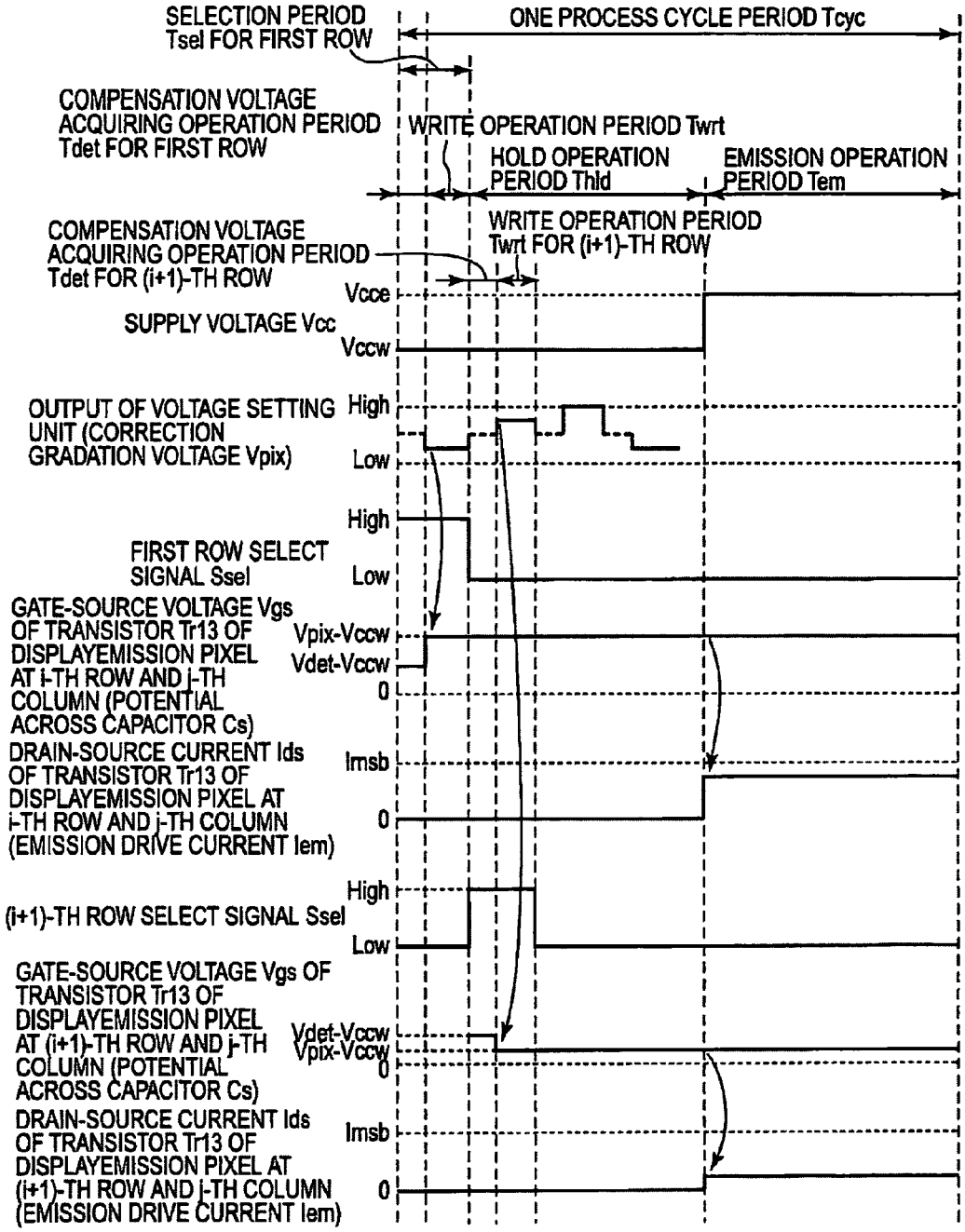
FIG. 11 is a timing chart showing one example of a drive method for the emission apparatus according to the first embodiment.

FIG. 11 is a timing chart showing one example of a drive method for the emission apparatus according to the embodiment. For the sake of descriptive convenience, FIG. 11 shows a timing chart in a case where the emission pixels PIX in the i-th row and j-th column and the (i+1)-th row and j-th column (i being a positive integer to be $1 \leqq i \leqq n$ and j being a positive integer to be $1 \leqq j \leqq m$) in the matrix array of emission pixels PIX in the emission area 110 are caused to emit light at an appropriate luminance gradation according to emission data.

As shown in FIG. 11, for example, the drive control operation of the emission apparatus 100 according to the embodiment is set to execute, within a predetermined one process cycle period Tcyc, at least the compensation voltage acquiring operation (compensation voltage acquiring operation period Tdet) for acquiring, for each emission pixel PIX, the offset voltage Vofst which changes according to the device characteristic (threshold voltage) where the transistor Tr13 (drive transistor) for emission drive of each of the emission pixels PIX (pixel drive circuits DC) arrayed in the emission area 110 increases its resistance with time or varies from another transistor Tr13 in the emission area 110 due to a variation therebetween, the write operation (write operation period Twrt) for adding the offset voltage (compensation voltage) Vofst to the original gradation voltage Vorg according to the emission data for each emission pixel PIX supplied from the emission signal generating circuit 160 to generate the correction gradation voltage Vpix, and supplying the correction gradation voltage Vpix to each emission pixel PIX via each data line Ld, the hold operation (hold operation period Thld) for charging the capacitor Cs with a voltage component according to the correction gradation voltage Vpix applied between the gate and source of the transistor Tr13 provided in the pixel drive circuit DC of the emission pixel PIX by the write operation, and the emission operation (emission operation period Tem) for compensating for the influence of a variation in the device characteristic of the transistor Tr13 based on the voltage component held in the capacitor Cs by the hold operation and letting the emission drive current Iem having a current value according to the emission data flow to the organic EL device OLED to emit light at an appropriate luminance gradation ($Tcyc \leqq Tdet+Twrt+Thld+Tem$). Those operations are executed based on the control signals supplied from the system controller 150.

The one process cycle period Tcyc adopted in the drive control operation according to the embodiment is set to, for example, a period needed for the emission pixel PIX to display one pixel of image information in one frame image. That is, in a case of emitting one frame image in the emission area 110 having a plurality of emission pixels PIX arrayed in a matrix form in the row direction and column direction, the one process cycle period Tcyc is set to a period needed for one row of emission pixels PIX to display one row of images in one frame image.

The individual operations will be specifically described below.

(Compensation Voltage Acquiring Operation)

Figure 12:
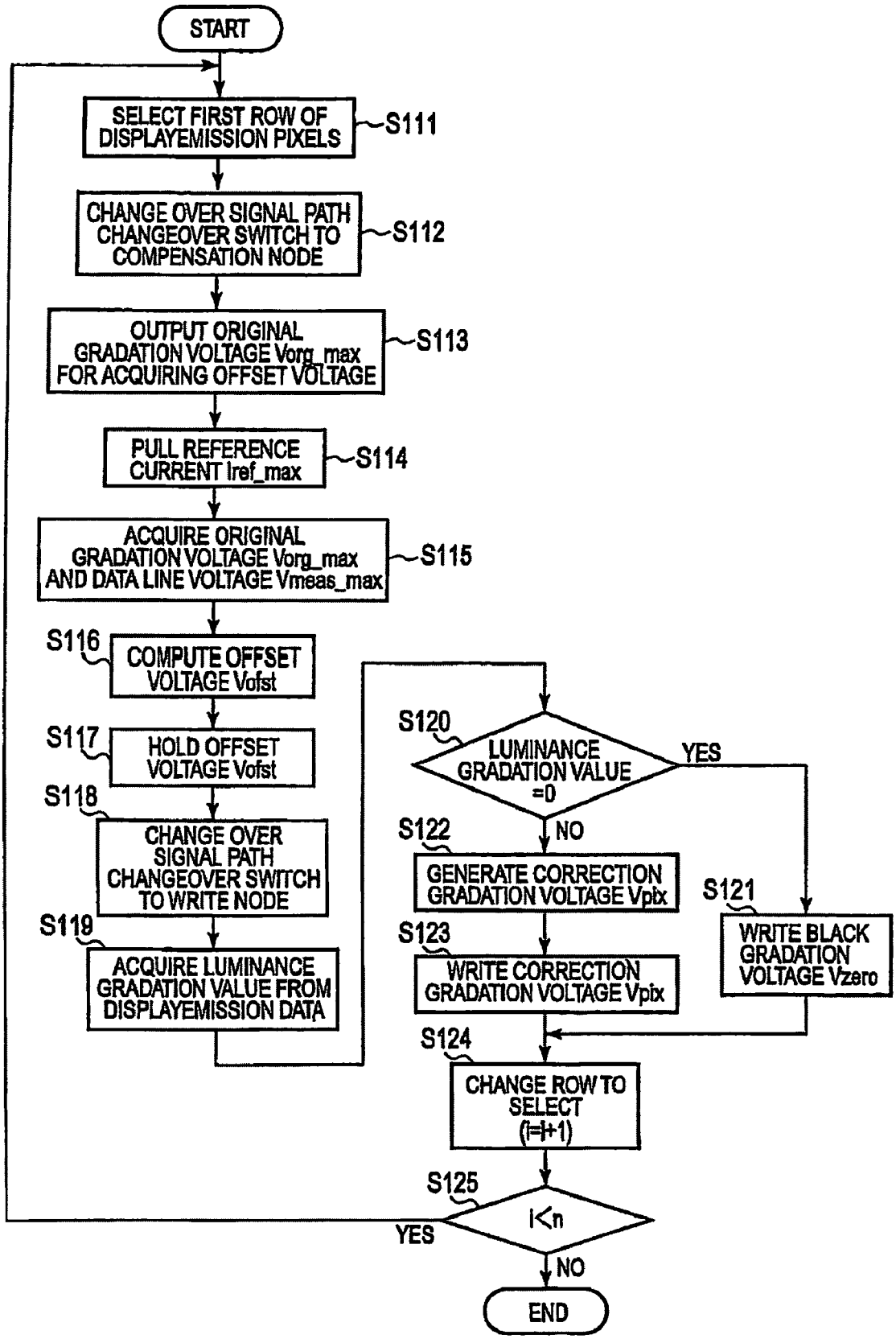
FIG. 12 is a flowchart illustrating one example of a drive method (compensation voltage acquiring operation and write operation) for the emission apparatus according to the first embodiment.
Figure 13:
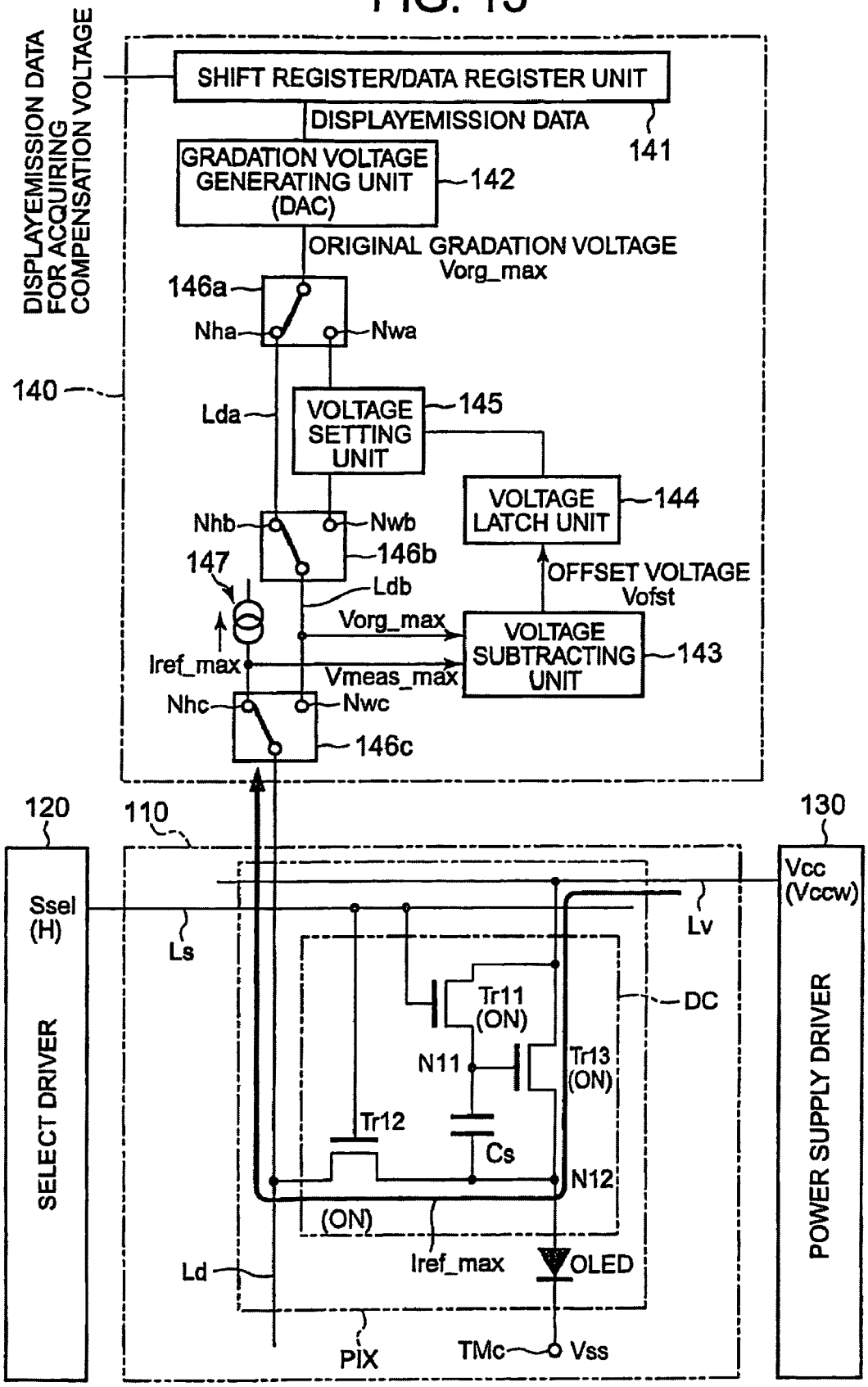
FIG. 13 is a conceptual diagram showing the compensation voltage acquiring operation of the emission apparatus according to the first embodiment.

FIG. 12 is a flowchart illustrating one example of a drive method (compensation voltage acquiring operation and write operation) for the emission apparatus according to the embodiment, and FIG. 13 is a conceptual diagram showing the compensation voltage acquiring operation of the emission apparatus according to the embodiment.

In the compensation voltage acquiring operation (compensation voltage acquiring operation period Tdet) according to the embodiment, shown in FIGS. 11 and 12, first, the select signal Ssel having the selection level (high level) is applied to the i-th select line Ls by the select driver 120 based on the power supply control signal and the select control signal output from the system controller 150 to set the emission pixels PIX of the i-th row in the selected state, with the supply voltage Vcc (=Vccw≦reference voltage Vss) with a low potential or the write level being applied by the power supply driver 130 to the supply voltage line Lv connected to the emission pixels PIX of the i-th row (positive integer to be $1 \leqq i \leqq n$) (supply voltage line Lv commonly connected to all the emission pixels PIX in the group that includes the i-th row in the emission apparatus shown in FIG. 9), as in the write operation of the pixel circuit section DCx (step S111).

This turns on each of the transistors Tr11 provided in the pixel drive circuits DC of the emission pixels PIX of the i-th row to set the transistors Tr13 (drive transistors) diode-connected, thus applying the supply voltage Vcc (=Vccw) to the drain terminal and gate terminal of the transistor Tr13 (node N11; one end of the capacitor Cs) and turning on the transistor Tr12 to electrically connect the source terminal of the transistor Tr13 (node N12; the other end of the capacitor Cs) to each data line Ld.

Next, as shown in FIGS. 12 and 13, after the signal path changeover switches 146*a* to 146*c* provided in each column (each data line Ld) are changed over to the respective compensation nodes Nha to Nhc based on the data control signal output from the system controller 150 (step S12), the original gradation voltage Vorg corresponding to a predetermined luminance gradation for acquiring the offset voltage (e.g., original gradation voltage Vorg_max corresponding to the highest luminance gradation) is output from the gradation voltage generating unit 142 to be applied to the signal line Ldb via the signal path changeover switch 146*a*, the signal line Lda and the signal path changeover switch 146*b* (step S113).

Next, in this state, the reference current Iref (e.g., reference current Iref_max corresponding to the highest gradation) that is set to match with (or equal to) the current (expected current) to flow to the emission pixels PIX by the voltage applied at the time of writing emission data with a predetermined luminance gradation in the emission pixels PIX is forced to flow to be pulled toward the data driver 140 from the data line Ld via the signal path changeover switch 146*c* by the current source 147 provided at each column (each data line Ld) (step S14). The reference current Iref flows through the pixel drive circuit DC in the selected i-th row, i.e., the transistor Tr12 and the transistor Tr13.

The value of the drain-source current Ids of the transistor Tr13 at this time matches with the value of the reference current Iref regardless of whether the transistors Tr12 and Tr13 both have the V-I characteristic SPw in the initial state or the V-I characteristic SPw2 after shifting of the threshold voltage Vth as shown in FIG. 4A. The reference current Iref preferably converges to a target current value fast, and is desirably set to a current value with the highest luminance gradation or larger than one with a luminance gradation near the highest luminance gradation. The following description will be given of a case where the reference current Iref is set to a current value according to the highest luminance gradation (reference current Iref_max).

Next, the original gradation voltage Vorg_max applied to the signal line Ldb by the gradation voltage generating unit 142 and the potential (data line voltage) generated on the data line Ld by the reference current Iref_max which is let to flow by the current source 147 are acquired (step S115), and the difference between the voltage and the potential are computed (subtraction) to acquire the offset voltage Vofst as given by the equation 11 (step S116). The offset voltage Vofst is held in the voltage latch unit 144 as shown in FIG. 13 (step S117).

The data line voltage Vmeas_max acquired by the voltage subtracting unit 143 varies according to the device characteristic which changes due to increases in the resistances of the transistors Tr12 and Tr13 between whose drain and source the reference current Iref_max flows, or the like. Particularly, the data line voltage Vmeas_max is influenced by the degree of progress of the V-I characteristic curve SPw2 where the threshold voltage Vth shown in FIG. 4A is shifted at the gate-source (or drain-source) voltage Vgs of the diode-connected transistor Tr13 and the degree of progress of the V-I characteristic curve SPw2 where the threshold voltage Vth is shifted at the gate-source voltage Vgs of the transistor Tr12. In other words, if changes in the threshold voltages Vth of the transistors Tr13 and Tr12 (Vth shift) progresses (if ΔVth becomes larger), the potential difference between the supply voltage line Lv to which the first supply voltage Vccw is applied and the potential of the data line Ld which has become the data line voltage Vmeas_max because of the flow of the reference current Iref_max becomes larger, so that the data line voltage Vmeas_max becomes lower. The shift amount of the threshold voltage of a transistor tends to become larger as the ON duration of the transistor becomes longer. Therefore, while the transistor Tr13 is in the ON state in the emission operation period Tem which has a high occupation rate in one process cycle period Tcyc and is thus likely to have its threshold voltage shifted further toward the positive voltage side, thus increasing its resistance, the transistor Tr12 is in the ON state only in a selection period Tsel which has a relatively low occupation rate in one process cycle period Tcyc and thus has a smaller shift of the threshold voltage as compared with the transistor Tr13.

In the compensation voltage acquiring operation according to the embodiment, as apparent from the above, as shown in FIG. 13, the difference between the potential Vmeas_max of the data line Ld acquired when the constant current source 147 is connected thereto to let a predetermined reference current flow there, and the original gradation voltage Vorg_max to permit the flow of the drain-source current Ids of the transistor Tr13 that is the approximation of the expected value, which is the drain-source current Ids of the transistor Tr13 at a predetermined gradation (e.g., highest luminance gradation) according to the V-I characteristic curve SPw in the initial state, in the write operation mode (i.e., the differential voltage between the original gradation voltage Vorg_max and the data line voltage Vmeas_max) is treated as the offset voltage Vofst. That is, the offset voltage Vofst is equivalent to a potential deviation which changes due to some factors, such as an increase in the resistance of the pixel drive circuit DC with time and a variation in the characteristic of each pixel drive circuit DC in the emission area 110.

In the period of the compensation voltage acquiring operation, the potentials at the individual terminals satisfy the relationships given in the equations 3 to 10, so that the current does not flow to the organic EL device OLED, disabling the in the emission operation.

Although the process of generating the original gradation voltage Vorg_max for acquiring the offset voltage output from the gradation voltage generating unit 142 has not been illustrated specifically in the foregoing description of the embodiment, the original gradation voltage Vorg_max may be generated by the gradation voltage generating unit 142 based on emission data to be supplied to each emission pixel PIX from the emission signal generating circuit 160 as shown in FIG. 13, or the original gradation voltage Vorg_max corresponding to an appropriate luminance gradation may be independently output from the gradation voltage generating unit 142 without emission data supplied from the emission signal generating circuit 160.

(Write Operation)

Figure 14:
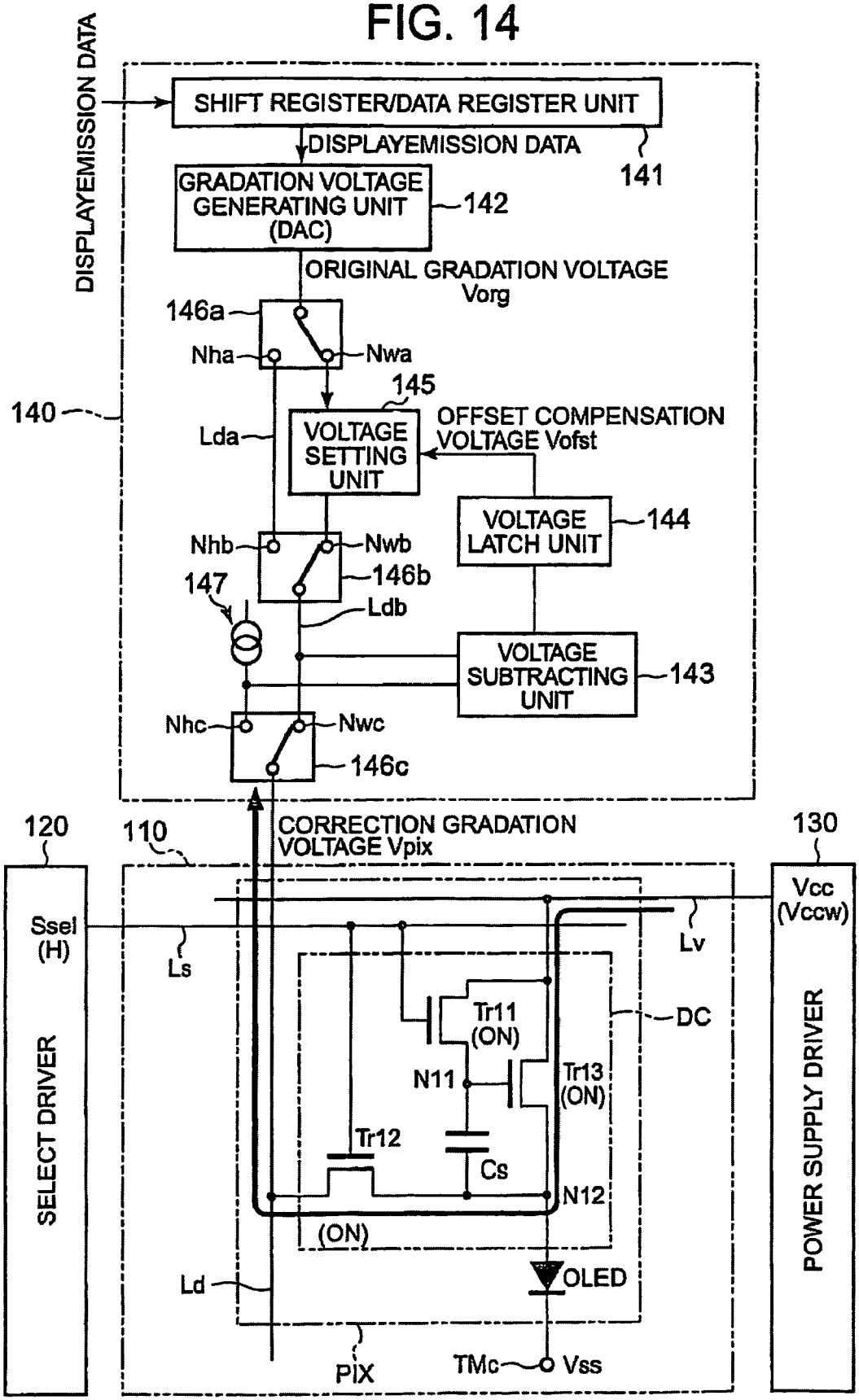
FIG. 14 is a conceptual diagram showing the write operation of the emission apparatus according to the first embodiment.

FIG. 14 is a conceptual diagram showing the write operation of the emission apparatus according to the embodiment.

As described above, for each emission pixel PIX in a row set in the selected state, after the operation of extracting the offset voltage Vofst corresponding to a change in the threshold voltage Vth of the transistor Tr13 for emission drive, provided in the pixel drive circuit DC, the operation of writing the emission data is subsequently executed as shown in FIGS. 11 and 12.

In the write operation (write operation period Twrt), as shown in FIGS. 12 and 14, the signal path changeover switches 146*a* to 146*c* are changed over to the respective compensation nodes Nwa to Nwc based on the data control signal output from the system controller 150, while holding the selected state wherein the high-level select signal Ssel and the low-potential supply voltage Vcc (=Vccw) is applied to the i-th select line Ls and supply voltage line Lv as shown in FIG. 11, as per the above-described sequential compensation voltage acquiring operation (step S118). This connects the gradation voltage generating unit 142 to the voltage setting unit 145 via the signal path changeover switch 146*a*, and connects the voltage setting unit 145 to the data line Ld via the signal path changeover switch 146*b*, the signal line Ldb and the signal path changeover switch 146*c*.

Next, the emission data supplied from emission signal generating circuit 160 is acquired via the shift register/data register unit 141, and transferred to the gradation voltage generating unit 142 provided in each column (each data line Ld), the luminance gradation value of the emission pixels PIX to be subjected to the write operation (or set in the selected state) is acquired from the emission data (step S119), and it is determined whether the luminance gradation value is "0" that is the lowest luminance gradation (no emission) (step S120).

When the luminance gradation value is "0" in the gradation value determining process in step S120, a predetermined gradation voltage (black gradation voltage) Vzero for performing a non-emission operation (or black display operation) is output from the gradation voltage generating unit 142, and is directly applied to the data line Ld without being added with the offset voltage Vofst held in the voltage latch unit 144 by the voltage setting unit 145 (i.e., without performing a compensation process on a variation in the threshold voltage of the transistor Tr12, Tr13) (step S121).

The gradation voltage Vzero for the non-emission operation is set to a voltage value (−Vzero<Vth−Vccw) having a relationship such that the voltage Vgs (≈Vccw−Vzero) to be applied between the gate and source of the diode-connected transistor Tr13 becomes lower than the threshold voltage Vth of the transistor Tr13. Further, to suppress shifting of the threshold voltage of the transistor Tr12, Tr13, it is preferable that Vzero=Vccw.

When the luminance gradation value is not "0" in the gradation value determining process in step S120 (e.g., the 150-th gradation), as shown in FIG. 14, the original gradation voltage Vorg having a voltage value according to the luminance gradation value (=gradation value "150") is generated from the gradation voltage generating unit 142 and output, and the offset voltage Vofst acquired by the compensation voltage acquiring operation and held in the voltage latch unit 144 by the voltage setting unit 145 is added to the original gradation voltage Vorg to generate the negative-potential correction gradation voltage Vpix which satisfies the equation 12 (step S122) to be applied to the data line Ld. The offset voltage Vofst is a potential deviation which changes some factors, such as an increase in the resistance of the pixel drive circuit DC with time and a variation in the characteristic of the individual pixel drive circuits DC in the emission area 110, and does not depend on the gradation of the original gradation voltage Vorg or the gradation of the original gradation voltage Vorg_max.

The correction gradation voltage Vpix generated by the voltage setting unit 145 is set to have a voltage amplitude to the negative potential side relative to the supply voltage Vcc (Vccw) of the write operation level (low potential) to be applied to the supply voltage line Lv by the power supply driver 130, and become lower on the negative potential side (the absolute value of the voltage amplitude becomes larger) as the gradation becomes higher.

Accordingly, as the correction gradation voltage Vpix corrected by adding the offset voltage Vofst according to a change in the threshold voltage Vth of the transistor Tr13 is applied to the source terminal (node N12) of the transistor Tr13, the corrected voltage Vgs is applied between the gate and source of the transistor Tr13 (across the capacitor Cs) (step S123). Such a write operation employs a scheme of applying the desired voltage to the gate terminal and source terminal of the transistor Tr13 directly, not writing a voltage component by letting the current according to emission data flow to the emission pixels PIX, thus making it possible to set the potential at each terminal or node to the desired state quickly.

In the write operation period Twrt, the voltage value of the correction gradation voltage Vpix to be applied to the node N12 on the anode terminal side of the organic EL device OLED is set lower than the reference voltage Vss to be applied to the cathode terminal TMc (i.e., the organic EL device OLED is set in a reverse biased state), so that the current does not flow to the organic EL device OLED, disabling emission.

In the embodiment, the compensation voltage acquiring operation (compensation voltage acquiring operation period Tdet) and the write operation (write operation period Twrt) are sequentially executed (Tsel≧Tdet+Twrt) in the selection period Tsel where the emission pixels PIX in the i-th row to be subjected to the write operation are set in the selected state, and the hold operation (hold operation period Thld) and the emission operation (emission operation period Tem) to be described later are executed in a non-selection period other than the selection period Tsel.

(Hold Operation)

Figure 15:
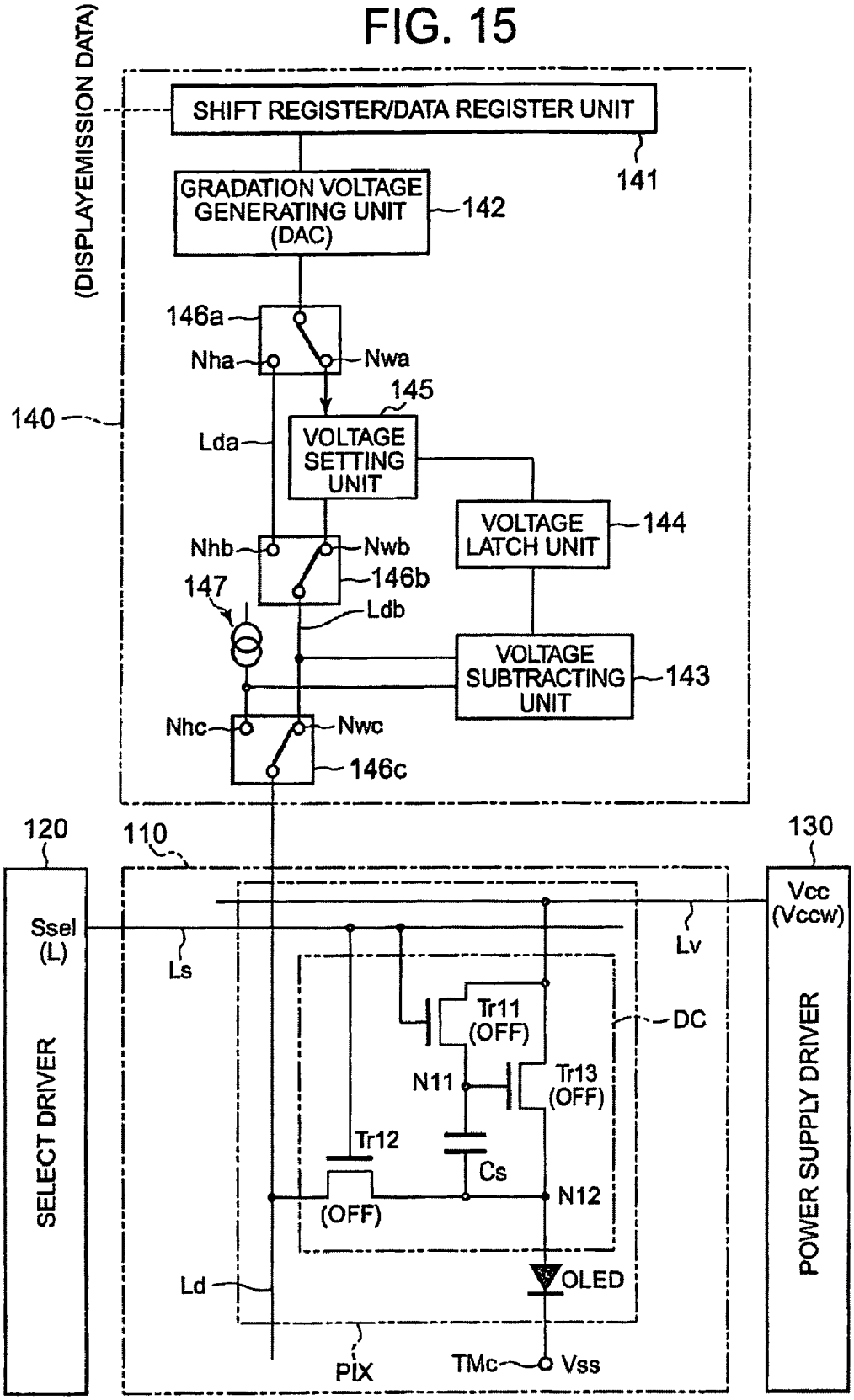
FIG. 15 is a conceptual diagram showing the hold operation of the emission apparatus according to the first embodiment.

FIG. 15 is a conceptual diagram showing the hold operation of the emission apparatus according to the embodiment.

Next, in the hold operation (hold operation period Thld) after the above-described compensation voltage acquiring operation and write operation, as shown in FIG. 11, the select signal Ssel with a non-selection level (low level) is applied to the i-th select line Ls to turn off the transistors Tr11 and Tr12 as shown in FIG. 15 to release the diode connection of the transistor Tr13 and block the application of the correction gradation voltage Vpix to the source terminal (node N12) of the transistor Tr13, whereby the voltage component (Vgs=Vpix−Vccw) applied between the gate and source of the transistor Tr13 is charged (held) in the capacitor Cs.

Next, as shown in FIG. 12, a process of incrementing a variable "i" to designate a row (i=i+1) is executed (step S124) to execute the above-described sequence of processes of acquiring the offset voltage Vofst for each emission pixel PIX in the i-th row and writing the correction gradation voltage Vpix, which is the emission data (original gradation voltage Vorg) corrected based on the offset voltage Vofst, for the next row ((i+1)-th row) of emission pixels PIX. It is then determined whether the incremented variable "i" is smaller than a digit number n set for the emission area 110 (i<n) (step S125).

When it is determined that the incremented variable "i" is smaller than the digit number n (i<n), the processes from step S111 to step S125 are performed on the (i+1)-th row of emission pixels PIX again, and the same processes are repeated until it is determined in step S125 that the incremented variable "i" is equal to the digit number n (i=n).

When it is determined in step S125 that the incremented variable "i" is equal to the digit number n (i=n), the foregoing sequence of processes is terminated, considering that the compensation voltage acquiring operation and the write operation for each row of emission pixels PIX are executed for every row.

That is, as shown in FIG. 11, in the hold operation period Thld of the i-th row of emission pixels PIX, a sequence of processes from the compensation voltage acquiring operation, the write operation and the hold operation similar to those described above is executed on the emission pixels PIX of the (i+1)-th and subsequent rows, row by row, by sequentially applying the select signal Ssel with the selection level (high level) to the select lines Ls of the (i+1)-th and subsequent rows at different timings from the select driver 120. In the hold operation period Thld of the i-th row of emission pixels PIX, therefore, the hold operation continues until the voltage component (correction gradation voltage Vpix) according to the emission data is sequentially written in emission pixels PIX in every one of the (i+1)-th and subsequent rows.

(Emission Operation)

Figure 16:
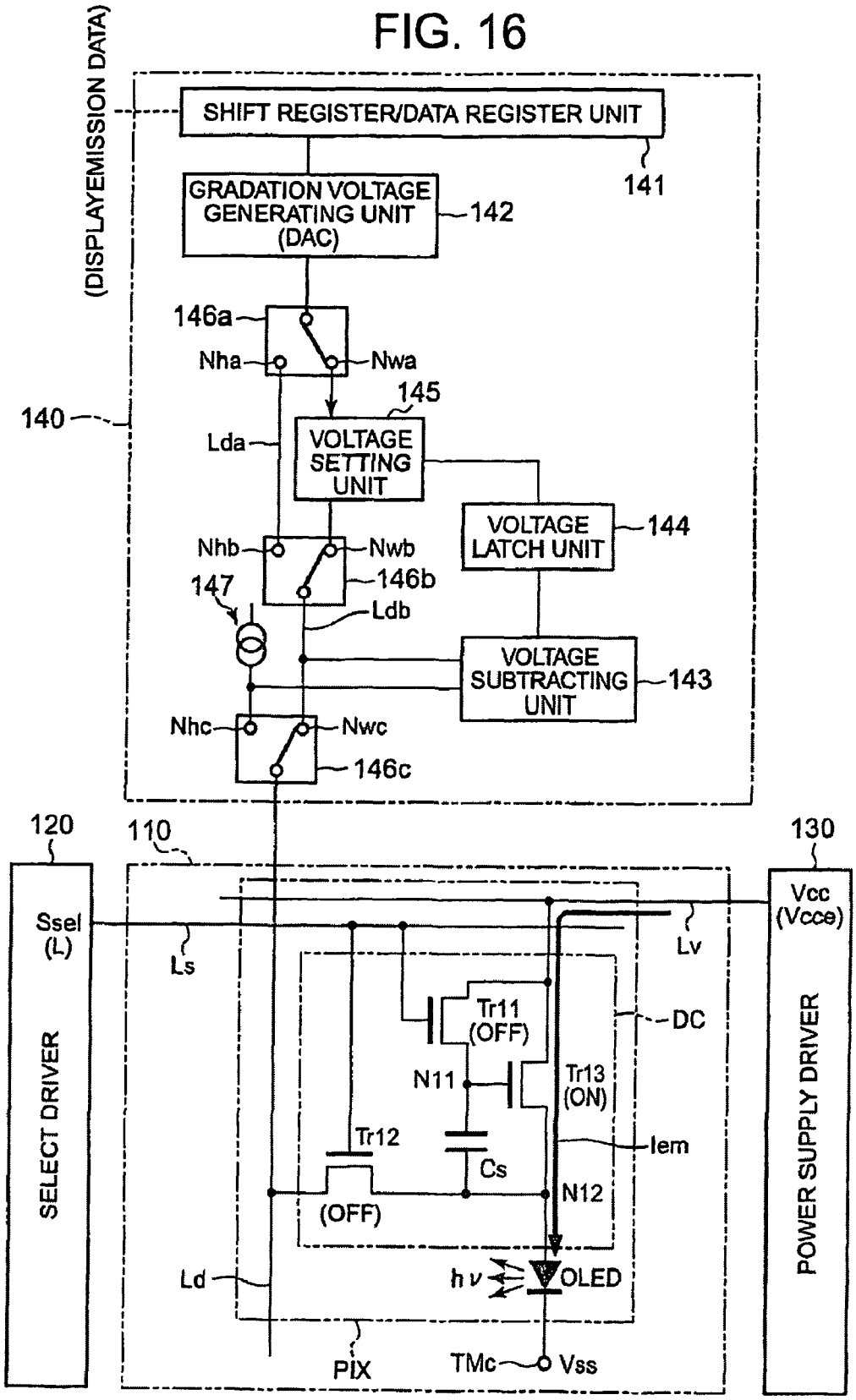
FIG. 16 is a conceptual diagram showing the emission operation of the emission apparatus according to the first embodiment.

FIG. 16 is a conceptual diagram showing the emission operation of the emission apparatus according to the embodiment.

Next, in the emission operation (emission operation period Tem) after the foregoing compensation voltage acquiring operation and write operation, as shown in FIG. 11, with the select signal Ssel with the non-selection level (low level) being applied to every select line Ls, the supply voltage Vcc (=Vcce>Vccw) with a high potential (positive potential) or the emission level is applied to the supply voltage lines Lv connected to the individual rows of emission pixels PIX.

Because the high-potential supply voltage Vcc (=Vcce) to be applied to the supply voltage line Lv is set greater than the sum of the saturation voltage (pinch-off voltage Vpo) of the transistor Tr13 and the drive voltage (Volded) of the organic EL device OLED, the transistor Tr13 operates in the saturation area as in the cases shown in FIGS. 7A, 7B, 8A and 8B. As a positive voltage according to the voltage component (|Vpix−Vccw|) applied between the gate and source of the transistor Tr13 by the write operation is applied to the anode side (node N12) of the organic EL device OLED and the reference voltage Vss (e.g., ground potential) is applied to the cathode terminal TMc, the organic EL device OLED is set in a forward bias state. As shown in FIG. 16, therefore, the drive current Iem (drain-source current Ids of the transistor Tr13) having a current value according to emission data (strictly speaking, correction gradation voltage Vpix) flows to the organic EL device OLED from the supply voltage line Lv via the transistor Tr13, enabling emission at an appropriate luminance gradation.

The emission operation is continuously executed from the application of the supply voltage Vcc (=Vccw) with a low potential (negative voltage) or the write level from the power supply driver 130 until the timing at which a next one process cycle period Tcyc starts.

Although the signal path changeover switch 146*c* is changed over to the write node Nwc side to connect the data line Ld to the signal line Ldb in the hold operation and emission operation shown in FIGS. 15 and 16, the signal path changeover switch 146*c* may be set so that the data line Ld is connected to neither the current source 147 nor the signal line Ldb.

Second Embodiment

Emission Apparatus

A second embodiment of the emission apparatus according to the present invention will be specifically described next. As the general configuration of the emission apparatus according to the second embodiment is similar to that of the first embodiment (see FIG. 9), its description will be omitted and the data driver which has a structure unique to the second embodiment will be described in detail.

Figure 17:
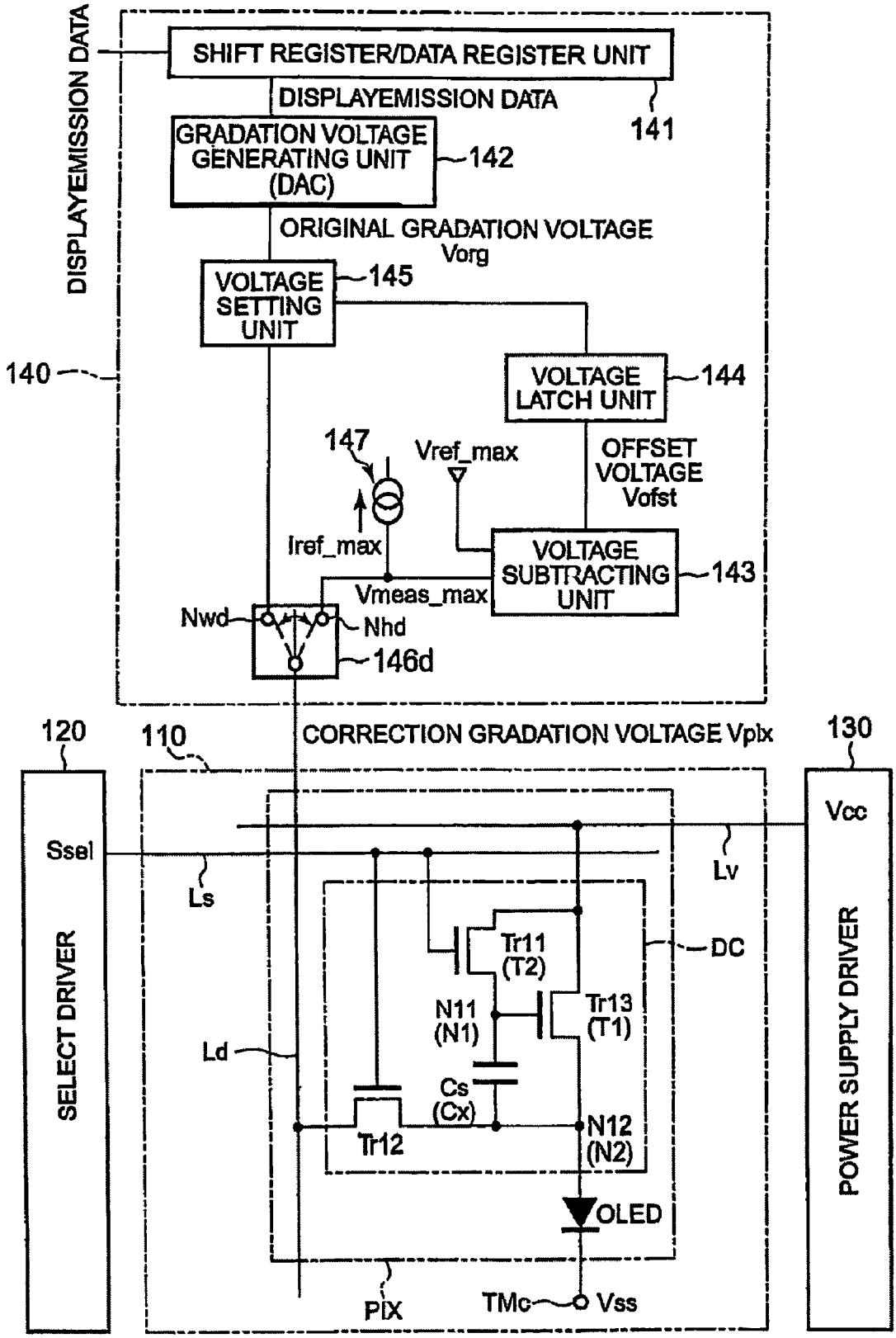
FIG. 17 is an essential configurational diagram exemplifying one example of a data driver and an emission pixel to be applicable to an emission apparatus according to a second embodiment.

FIG. 17 is an essential configurational diagram exemplifying one example of a data driver and an emission pixel to be applicable to the emission apparatus according to the second embodiment. In FIG. 17, reference numerals given to circuit structures corresponding to the above-described pixel circuit section DCx (see FIG. 1) are also shown. While various kinds of signals and data to be transferred among the individual components of the data driver, voltages and the like to be applied are also shown in FIG. 17 for the sake of descriptive convenience, those signals, data, voltages, etc. are not necessarily be transferred or applied at the same time.

The data driver 140 according to the embodiment, as shown in FIG. 17, for example, includes a shift register/data register unit 141, a gradation voltage generating unit 142, a voltage subtracting unit 143, a voltage latch unit 144, a voltage setting unit 145, a signal path changeover switch (changeover switch) 146*d*, and a current source 147. The gradation voltage generating unit 142, the voltage subtracting unit 143, the voltage latch unit 144, the voltage setting unit 145, the signal path changeover switch 146*d* and the current source 147, excluding the shift register/data register unit 141, are provided for the data line Ld of each column, and m sets of those components are provided in the data driver 140 in the emission apparatus 100 according to the embodiment.

The shift register/data register unit 141, like that of the first embodiment, sequentially acquires emission data (luminance gradation data) sequentially supplied from the emission signal generating circuit 160 based on the data control signal supplied from the system controller 150, transfers the emission data in parallel to the gradation voltage generating units 142 provided column by column. The gradation voltage generating unit 142 generates and outputs an original gradation voltage Vorg for causing the organic EL device OLED to perform emission at a luminance gradation based on the emission data or a gradation voltage Vzero for performing non-emission.

In the compensation voltage acquiring operation mode, the voltage subtracting unit 143 generates and outputs the offset voltage Vofst according to a change in the threshold voltage (equivalent to ΔVth shown in FIG. 4A) of the transistor Tr13 of each emission pixel PIX (pixel drive circuit DC) based on the result of an operation on a reference voltage Vref to be supplied via the power supply terminal and the potential Vmeas_max generated on the data line Ld by causing a reference current Iref (Vref_max) with a predetermined gradation to flow by the current source 147 to be described later.

Specifically, the offset voltage Vofst generated by the voltage subtracting unit 143 is set to a voltage value acquired by performing a computation (subtraction) of the difference between the potential Vmeas_max generated on the data line Ld and the reference voltage Vref (Vref_max) preset for acquiring the offset voltage Vofst in the compensation voltage acquiring operation, as expressed by the following equation 13.

$$Vofst = Vmeas_\mathrm{max} - Vref_\mathrm{max} \tag{13}$$

The offset voltage Vofst is set, in this manner, to a voltage value equivalent to a deviation (difference) between a preset predetermined voltage component and a voltage component generated on the data line Ld at the time of writing a predetermined gradation in the emission pixels PIX (or voltage component to be applied to the emission pixels PIX subjected to the write operation). Accordingly, by correcting the original gradation voltage Vorg output from the gradation voltage generating unit 142 based on the offset voltage Vofst in the write operation, the correction gradation voltage Vpix is set to have a voltage value reflecting the compensated value of a change in the threshold voltage of the transistor Tr13 of each emission pixel PIX (pixel drive circuit DC) and the compensated value of a change in the threshold voltage of the transistor Tr12, so that the compensation gradation current approximated to the normal current value corresponding to the luminance gradation value of emission data flows between the drain and source of the transistor Tr13.

The voltage latch unit 144 holds the offset voltage Vofst output from the voltage subtracting unit 143, and outputs the offset voltage Vofst to the voltage setting unit 145 in the write operation. In the write operation, the voltage setting unit 145 adds the original gradation voltage Vorg output from the gradation voltage generating unit 142 and the offset voltage Vofst held in the voltage latch unit 144 to generate the correction gradation voltage Vpix which satisfies the equation 12, and outputs the correction gradation voltage Vpix to the data line Ld laid out in the emission area 110 in the column direction thereof.

The signal path changeover switch 146*d* has a compensation node Nhd and a write node Nwd, and selectively connects the data line Ld to either the current source 147 on the compensation node Nhd side or the voltage setting unit 145 on the write node Nwd side. In the compensation voltage acquiring operation, the signal path changeover switch 146*d* is changed over to the compensation node Nhd side to connect the data line Ld to the current source 147 so that the potential Vmeas_max based on the reference current Iref_max flowing to the current source 147 is supplied into the voltage subtracting unit 143. In the write operation, the signal path changeover switch 146*d* is changed over to the write node Nwd side to connect the voltage setting unit 145 to the data line Ld, so that the correction gradation voltage Vpix, generated by the voltage setting unit 145 based on the original gradation voltage Vorg_x according to the emission data and the offset voltage Vofst, is applied to the emission pixels PIX via the data line Ld.

In the compensation voltage acquiring operation, the current source 147 lets a reference current with a predetermined gradation (e.g., reference current Iref_max with the highest gradation) flow to the emission pixels PIX via the data line Ld, thus causing the potential Vmeas_max generated on the data line Ld as a consequence to be supplied into the voltage subtracting unit 143 for generating the offset voltage Vofst.

<Drive Method for Emission Apparatus>

Next, a drive method for the emission apparatus according to the embodiment will be described.

The drive control operation of the emission apparatus 100 according to the embodiment, like that of the first embodiment (see FIG. 11), is set to execute, within a predetermined one process cycle period Tcyc, the compensation voltage acquiring operation (compensation voltage acquiring operation period Tdet), the write operation (write operation period Twrt), the hold operation (hold operation period Thld), and the emission operation (emission operation period Tem) (Tcyc≦Tdet+Twrt+Thld+Tem). In particular, the drive control operation is controlled to acquire the offset voltage (compensation voltage) Vofst corresponding to a change in the threshold voltage Vth of the transistor Tr13 for emission drive of each emission pixel PIX (pixel drive circuit DC).

An operation (compensation voltage acquiring operation) unique to the drive method according to the embodiment will be specifically described below.

Figure 18:
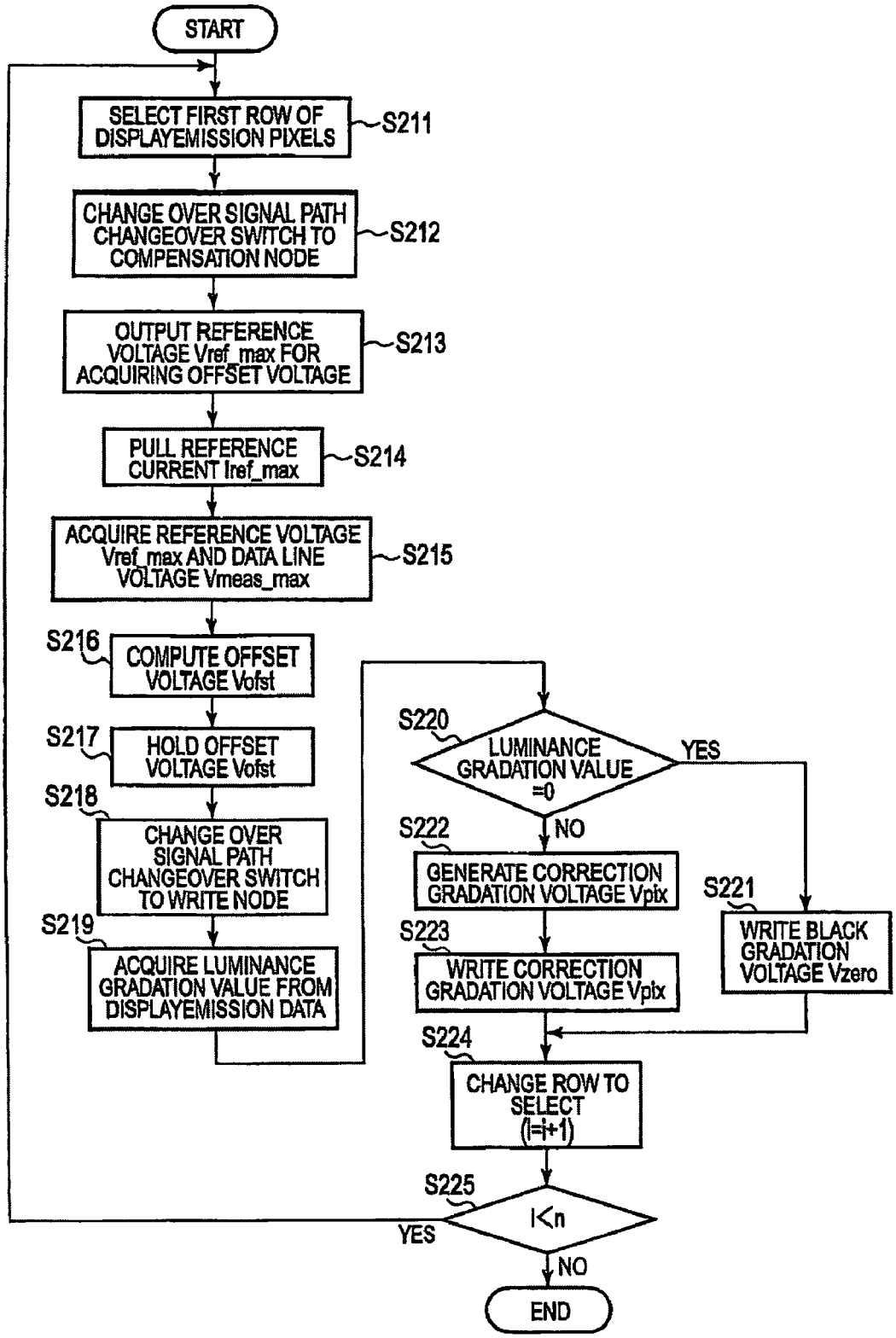
FIG. 18 is a flowchart illustrating one example of a drive method (compensation voltage acquiring operation and write operation) for the emission apparatus according to the second embodiment.
Figure 19:
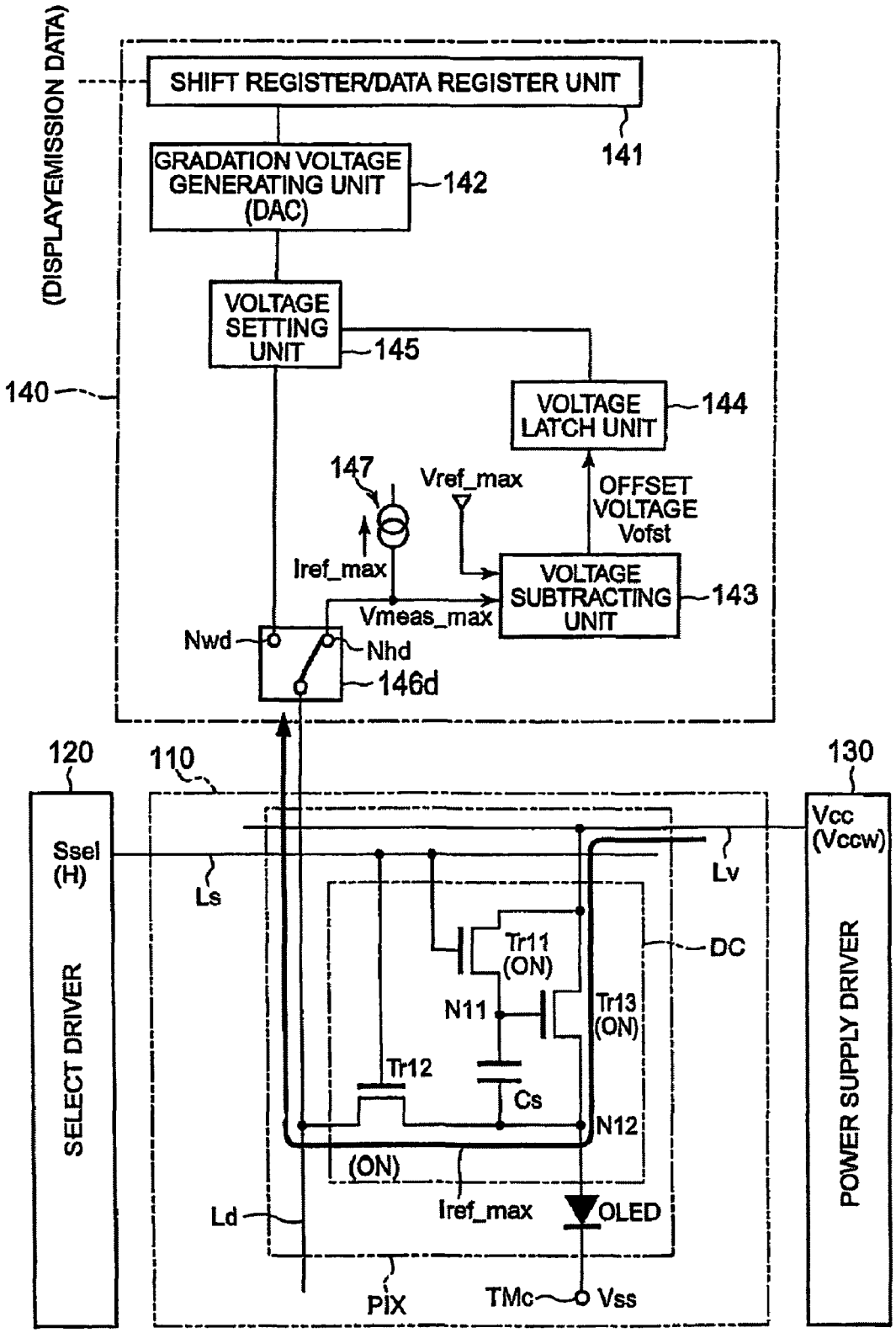
FIG. 19 is a conceptual diagram showing the compensation voltage acquiring operation of the emission apparatus according to the second embodiment.

FIG. 18 is a flowchart illustrating one example of a drive method (compensation voltage acquiring operation and write operation) for the emission apparatus according to the embodiment, and FIG. 19 is a conceptual diagram showing the compensation voltage acquiring operation of the emission apparatus according to the embodiment. Reference will be made to the timing chart for the drive method of the first embodiment (see FIG. 11) as needed, descriptions of similar processes will be omitted or simplified.

In the compensation voltage acquiring operation (compensation voltage acquiring operation period Tdet) according to the embodiment, shown in FIGS. 11 and 18, first, the select signal Ssel having the selection level (high level) is applied to the i-th select line Ls by the select driver 120 with the supply voltage Vcc (=Vccw≦Vss) with the low potential being applied to the i-th supply voltage line Lv by the power supply driver 130, setting the i-th row of emission pixels PIX in the selected state (step S211).

Next, as shown in FIGS. 18 and 19, after the signal path changeover switch 146*d* is changed over to the compensation node Nhd (step S212), the reference voltage Vref corresponding to an appropriate luminance gradation for acquiring the offset voltage (e.g., reference voltage Vref_max corresponding to the highest luminance gradation) is output from the power supply terminal to be applied to one input terminal of the voltage subtracting unit 143 (step S213).

Next, in this state, the reference current Iref (e.g., reference current Iref_max corresponding to the highest gradation) that is set to match with (or equal to) the current (expected current) to flow to the emission pixels PIX by the voltage applied at the time of writing emission data with an appropriate luminance gradation in the emission pixels PIX is forced to flow to be pulled toward the data driver 140 from the data line Ld via the signal path changeover switch 146*d* by the current source 147 (step S214). Accordingly, the value of the drain-source current Ids of the transistor Tr13 matches with the value of the reference current Iref (Iref_max).

Next, the voltage subtracting unit 143 is supplied with the reference voltage Vref_max applied to one input terminal thereof from the power supply terminal and the potential (data line voltage) generated on the data line Ld by the reference current Iref_max which is let to flow by the current source 147 and applied to the other input terminal (step S215), and computes the difference between both voltages (subtraction) to generate the offset voltage Vofst according to a change in the threshold voltage of the transistor Tr13 (equivalent to ΔVth shown in FIG. 4A) as given by the following equation 14 (step S216). The offset voltage Vofst is held in the voltage latch unit 144 as shown in FIG. 19 (step S217).

$$Vofst = Vmeas_\max - Vref_\max \tag{14}$$

In the period of the compensation voltage acquiring operation, as in the first embodiment, the current does not flow to the organic EL device OLED, disabling the emission operation.

Figure 20:
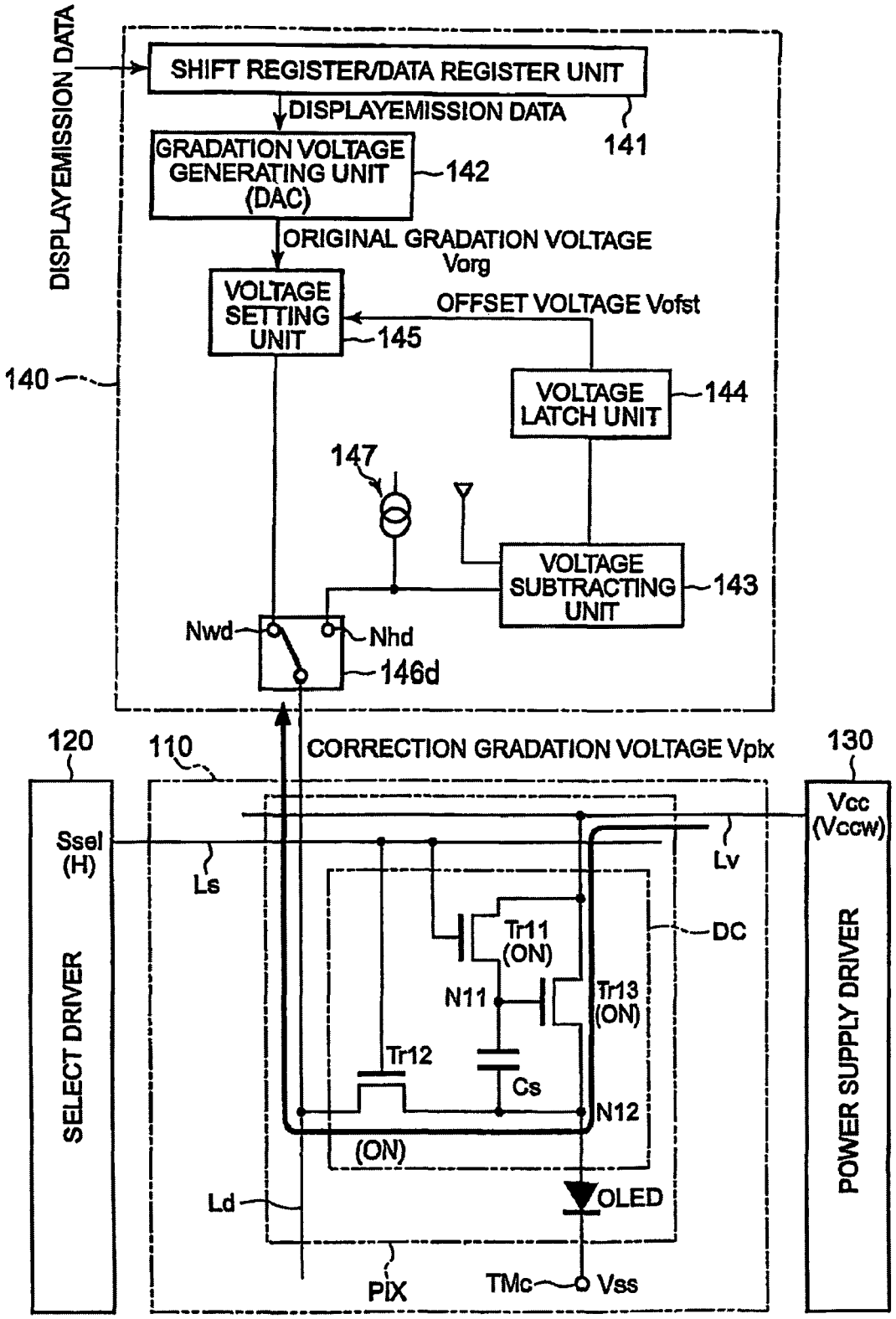
FIG. 20 is a conceptual diagram showing the write operation of the emission apparatus according to the second embodiment.

FIG. 20 is a conceptual diagram showing the write operation of the emission apparatus according to the embodiment.

Next, in the write operation (write operation period Twrt), as shown in FIGS. 18 and 20, the signal path changeover switch 146*d* is changed over to the compensation node Nwd (step S218), so that the data line Ld is connected to the voltage setting unit 145 via the signal path changeover switch 146*d*.

Next, the emission data supplied from emission signal generating circuit 160 is acquired via the shift register/data register unit 141, and transferred to the gradation voltage generating unit 142, and it is determined whether the luminance gradation value acquired from the emission data is "0" that is the lowest luminance gradation (no emission) (step S219, S220).

When the luminance gradation value is "0" and gradation display based on the emission data is black display which does not involve emission of the organic EL device OLED, a predetermined gradation voltage (black gradation voltage) Vzero for performing a non-emission operation is output from the gradation voltage generating unit 142, and is applied to the data line Ld without being added with the offset voltage Vofst held in the voltage latch unit 144 by the voltage setting unit 145 (step S221).

When the luminance gradation value is not "0" and gradation display based on emission data involves emission of the organic EL device OLED (e.g., the 150-th gradation), as shown in FIG. 20, the original gradation voltage Vorg having a voltage value according to the luminance gradation value (=gradation value "150") is generated and output from the gradation voltage generating unit 142, the offset voltage Vofst held by the compensation voltage acquiring operation is added to the original gradation voltage Vorg in the voltage setting unit 145 to generate the negative-potential correction gradation voltage Vpix which satisfies the equation 12 mentioned in the foregoing description of the first embodiment (step S222), and the correction gradation voltage Vpix is applied to the data line Ld.

Accordingly, as the correction gradation voltage Vpix corrected by adding the offset voltage Vofst according to a change in the threshold voltage Vth of the transistor Tr13 is applied to the source terminal (node N12) of the transistor Tr13, the voltage Vgs according to the correction gradation voltage Vpix is written between the gate and source of the transistor Tr13 (across the capacitor Cs) (step S223).

As the organic EL device OLED is set in a reverse bias state in the write operation period Twrt too, the current does not flow to the organic EL device OLED, disabling emission thereof.

Figure 21:
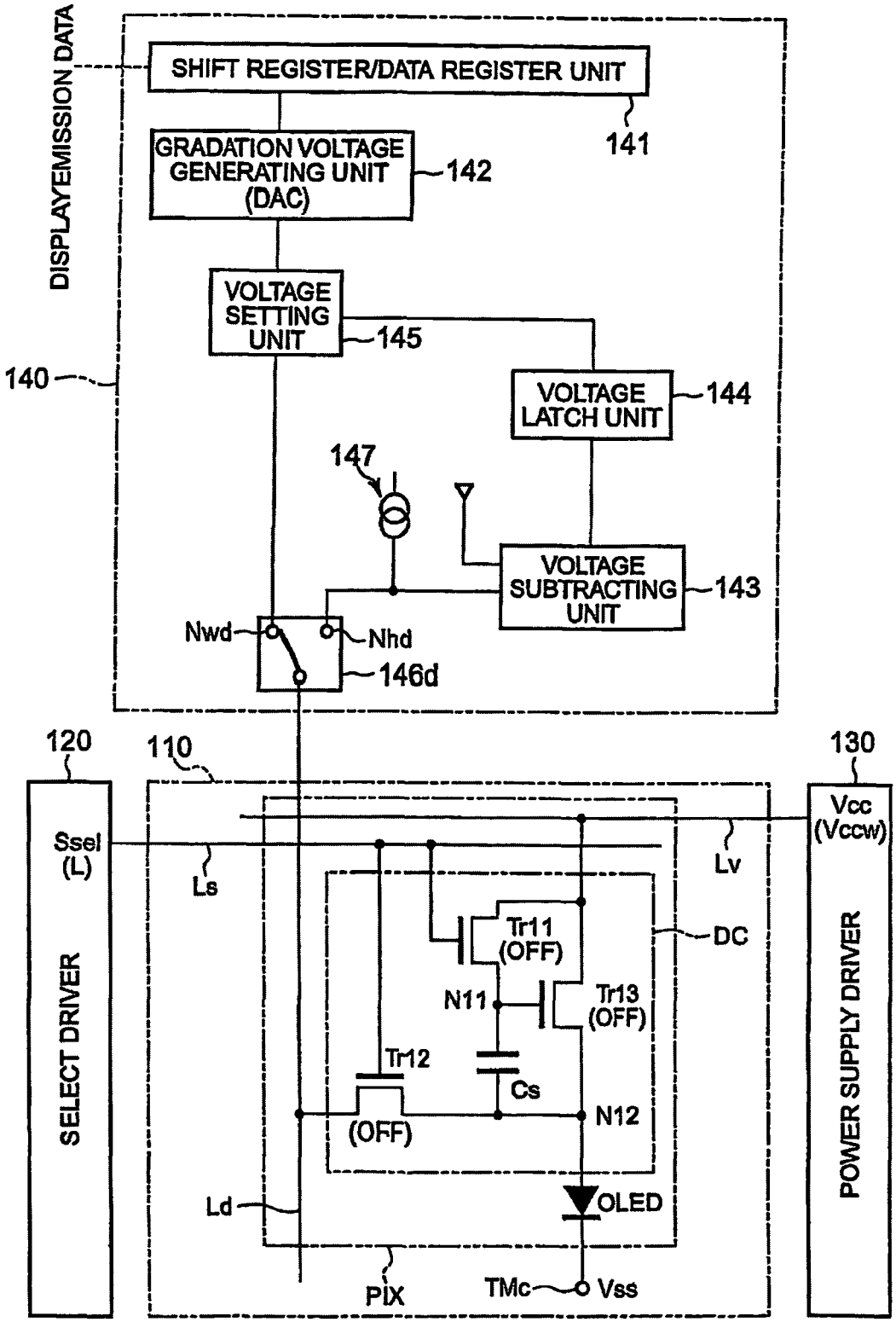
FIG. 21 is a conceptual diagram showing the hold operation of the emission apparatus according to the second embodiment.
Figure 22:
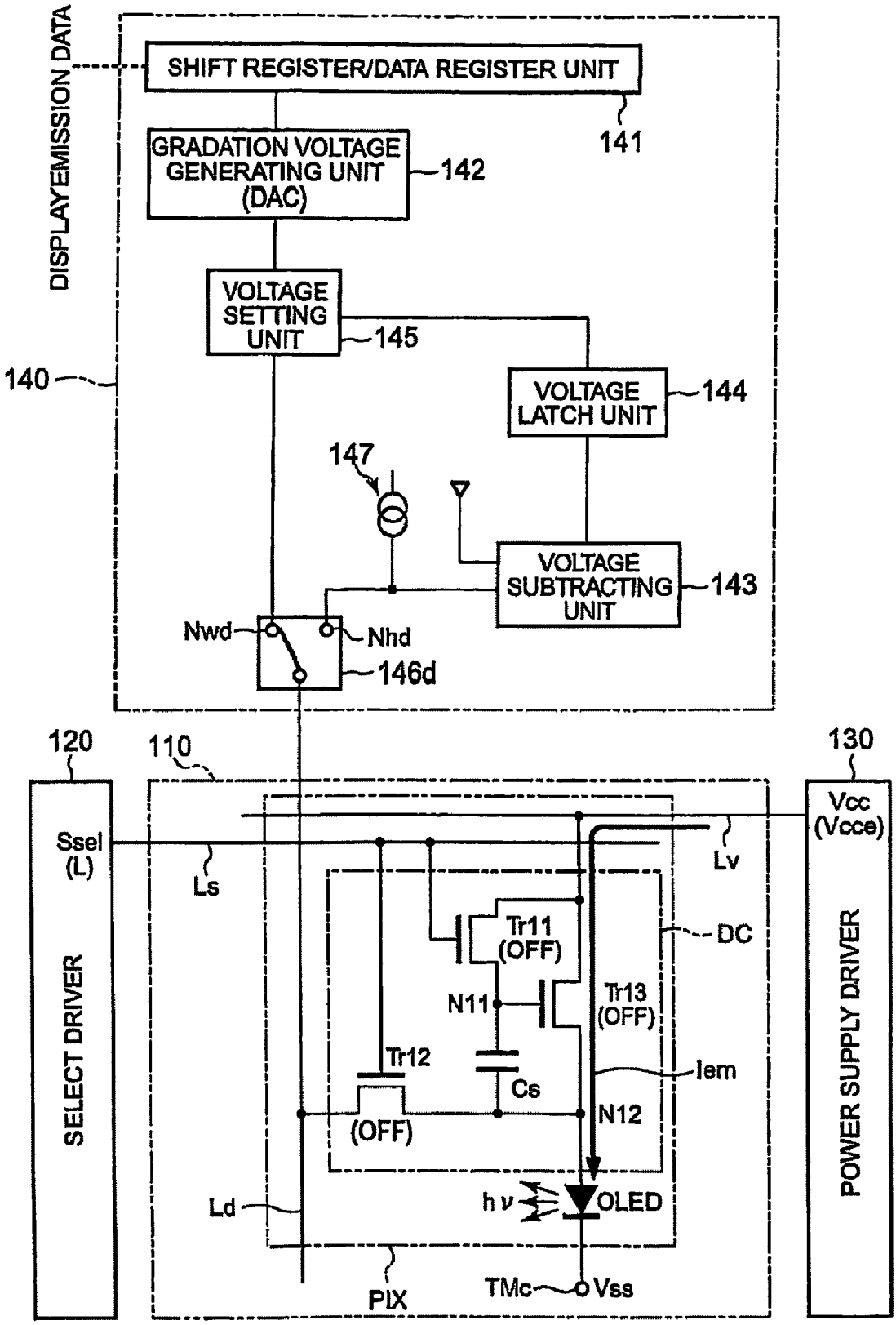
FIG. 22 is a conceptual diagram showing the emission operation of the emission apparatus according to the second embodiment.

FIG. 21 is a conceptual diagram showing the hold operation of the emission apparatus according to the embodiment, and FIG. 22 is a conceptual diagram showing the emission operation of the emission apparatus according to the embodiment.

Next, in the hold operation (hold operation period Thld), as shown in FIGS. 11 and 21, the select signal Ssel with a non-selection level (low level) is applied to the i-th select line Ls to set the i-th row of emission pixels PIX in the unselected state, so that the voltage component (Vgs=Vpix−Vccw) applied between the gate and source of the transistor Tr13 is charged (held) in the capacitor Cs.

A sequence of operations including the compensation voltage acquiring operation, the write operation and the hold operation for each of the emission pixels PIX in the i-th row is repeatedly executed for the emission pixels PIX in the (i+1)-th and subsequent rows, row by row, until the write operation is finished for every row of the emission area 110 (steps S224, S225).

Next, in the emission operation (emission operation period Tem), as shown in FIGS. 11 and 22, with each row of emission pixels PIX being set in the unselected state, the supply voltage Vcc (=Vcce>0 V) with a high potential (positive potential) or the emission level is applied to the supply voltage lines Lv connected to each row of emission pixels PIX.

Accordingly, a positive voltage according to the voltage component (|Vpix−Vccw−) written between the gate and source of the transistor Tr13 by the write operation is applied to the anode side (node N12) of the organic EL device OLED, and the reference voltage Vss (e.g., ground potential) is applied to the cathode terminal TMc. Therefore, the organic EL device OLED is set in a forward bias state, thus causing the drive current Iem having a current value according to emission data (correction gradation voltage Vpix) to flow to the organic EL device OLED from the supply voltage line Lv via the transistor Tr13, enabling emission at an appropriate luminance gradation.

Although the signal path changeover switch 146*d* being changed over to the write node Nwd side is illustrated in the hold operation and emission operation shown in FIGS. 21 and 22, the signal path changeover switch 146*d* may be set so that the data line Ld is connected to neither the voltage setting unit 145 nor the current source 147.

The sequential drive control operation according to the first embodiment or the second embodiment, as shown in FIG. 11, executes a sequence of operations of setting each row of emission pixels PIX laid out in the emission area 110 in the selected state, applying the supply voltage Vcc (=Vccw) with the write operation level to the emission pixels PIX, acquiring the offset voltage Vofst corresponding to a change in the threshold voltage of the transistor Tr13 provided in the pixel drive circuit DC of each emission pixel PIX in each row, writing the correction gradation voltage Vpix acquired by adding the offset voltage Vofst to the original gradation voltage Vorg based on the luminance gradation value of emission data, then setting that row of emission pixels PIX in the unselected state, and holding the written voltage component (|Vpix−Vccw|), and then applying the supply voltage Vcc (=Vcce) with the emission level to that row of emission pixels PIX the sequence of operations for which has been finished, so that the emission pixels PIX in the row can be caused to emit light at an appropriate luminance gradation according to the emission data.

Third Embodiment

Emission Apparatus

A third embodiment of the emission apparatus according to the present invention will be specifically described next. As the general configuration of the emission apparatus according to the second embodiment is similar to that of the first embodiment (see FIG. 9), its description will be omitted and the data driver which has a structure unique to the second embodiment will be described in detail.

Figure 23:
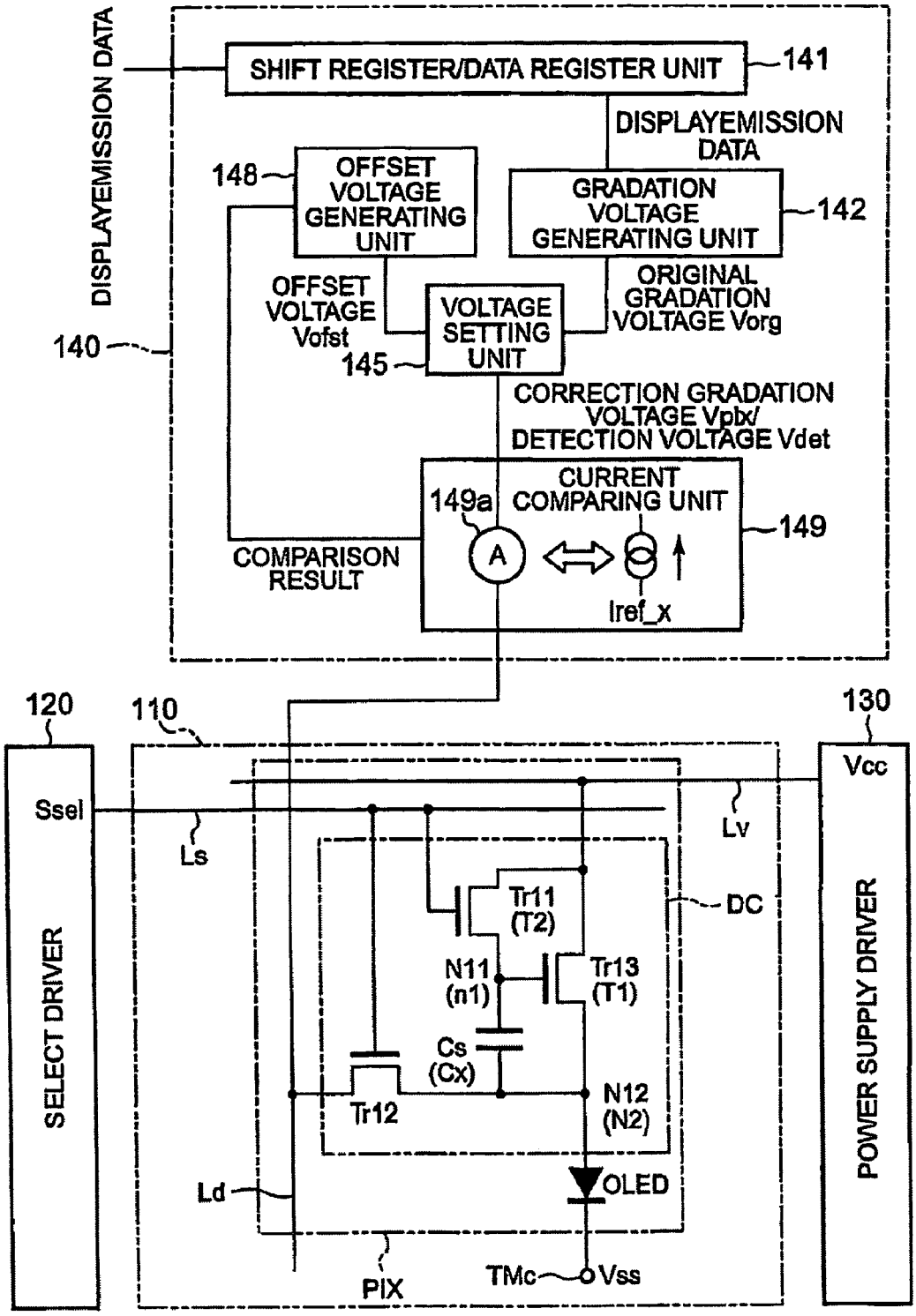
FIG. 23 is an essential configurational diagram exemplifying one example of a data driver and an emission pixel to be applicable to an emission apparatus according to a third embodiment.

FIG. 23 is an essential configurational diagram exemplifying one example of a data driver and an emission pixel to be applicable to the emission apparatus according to the third embodiment. In FIG. 17, reference numerals given to circuit structures corresponding to the above-described pixel circuit section DCx (see FIG. 1) are also shown. While various kinds of signals and data to be transferred among the individual components of the data driver, voltages and the like to be applied are shown in FIG. 23 too for the sake of descriptive convenience, those signals, data, voltages, etc. are not necessarily be transferred or applied at the same time.

The foregoing descriptions of the first and second embodiments has described the scheme of computing the difference between a potential (data line voltage) Vmeas_max generated on the data line Ld with a predetermined reference current Iref (Iref_max) pulled from the emission pixels PIX and the theoretical voltage Vorg_max at a predetermined gradation or the reference voltage Vref_max (i.e., comparing the voltages with each other) as the scheme of acquiring the offset voltage (compensation voltage) Vofst for compensating for a change in the threshold voltage of the transistor Tr13 for emission drive. However, the third embodiment includes a scheme of extracting correction data which defines the offset voltage Vofst by comparing the detection current Idet, which actually flows to an emission pixel PIX having a predetermined gradation x while the detection voltage Vdet preset so that the emission pixel PIX has the predetermined gradation x is applied to the data line Ld, with the reference current (reference current value) Iref_x with the predetermined gradation x which, should theoretically flow on the data line Ld without a variation in threshold voltage and without shifting of the threshold voltage.

The data driver (emission drive apparatus) 140 according to the embodiment, as shown in FIG. 23, for example, includes a shift register/data register unit 141, a gradation voltage generating unit 142, a voltage setting unit 145, an offset voltage generating unit (compensation voltage generating unit) 148, and a current comparing unit 149. The gradation voltage generating unit 142, the voltage setting unit 145, the offset voltage generating unit 148 and the current comparing unit 149, excluding the shift register/data register unit 141, are provided for the data line Ld of each column, and m sets of those components are provided in the data driver 140 in the emission apparatus 100 according to the embodiment.

The shift register/data register unit 141, like those of the first and second embodiments, sequentially acquires emission data (luminance gradation data) sequentially supplied from the emission signal generating circuit 160 based on the data control signal supplied from the system controller 150, transfers the emission data in parallel to the gradation voltage generating units 142 provided column by column. The gradation voltage generating unit 142 generates and outputs an original gradation voltage Vorg for causing the organic EL device OLED to perform emission at a luminance gradation based on the emission data or a gradation voltage Vzero for performing non-emission.

The voltage setting unit 145 adds the original gradation voltage (gradation voltage) Vorg output from the gradation voltage generating unit 142 and the offset voltage (compensation voltage) Vofst output from the offset voltage generating unit 148 to be described later to generate the detection voltage Vdet or the correction gradation voltage Vpix to be output to the data line Ld laid out in the emission area 110 in the column direction thereof via the current comparing unit 149 to be described later.

Specifically, in the correction data acquiring operation to be described later, the offset voltage Vofst which is generated based on an offset set value to be optimized by modulation performed as needed is analogically added to the original gradation voltage Vorg_x corresponding to a predetermined gradation (x gradation) output from the gradation voltage generating unit 142, and a voltage component which is the sum of both voltages is output to the data line Ld as the detection voltage Vdet.

In the write operation, as expressed by the equation 12, the offset voltage Vofst which is generated by the offset voltage generating unit 148 based on correction data (optimized offset set value) extracted by the correction data acquiring operation is analogically added to the original gradation voltage Vorg according to emission data output from the gradation voltage generating unit 142, and a voltage component which is the sum of both voltages is output to the data line Ld as the correction gradation voltage Vpix.

The offset voltage generating unit 148 generates the offset voltage (compensation voltage) Vofst according to a change (equivalent to ΔVth shown in FIG. 4A) in the threshold voltage Vth of the transistor Tr13 of each emission pixel PIX (pixel drive circuit DC) based on the result of comparison (to be described later specifically) output from the current comparing unit 149, and outputs the offset voltage Vofst to the voltage setting unit 145. As in the first and second embodiments, the offset voltage Vofst is set in such a way that the current flows from the supply voltage line Lv to the data driver 140 between the drain and source of the transistor Tr13, between the drain and source of the transistor Tr12 and via the data line Ld, and is specifically to a value satisfying the following equation 15.

$$Vofst = Vunit \times Minc \tag{15}$$

where Vunit is a unit voltage which is a preset minimum voltage unit and a negative potential and Minc is an offset set value which is adequately modulated and set in the offset voltage generating unit 148.

Then, the offset voltage Vofst is a voltage acquired by correcting a change in the threshold voltage Vth of the transistor Tr13 of each emission pixel PIX (pixel drive circuit DC) and a change in the threshold voltage Vth of the transistor Tr12 by the correction gradation voltage Vpix, so that the correction gradation current approximated to a current value at a normal gradation flows between the drain and source of the transistor Tr13. It is to be noted that while the transistor Tr13 is in the ON state in the emission operation period Tem which is a relatively long time and is thus likely to shift the threshold voltage toward the positive voltage side with time to increase its resistance, the transistor Tr12 is in the ON state only in the relatively short selection period Tsel and thus has a smaller amount of shift in the threshold voltage with time as compared with the transistor Tr13.

That is, in the correction data acquiring operation, optimization is carried out by adequately changing the value of the offset set value (variable) Minc by which the unit voltage Vunit is multiplied until the offset set value (variable) Minc becomes a proper value. Specifically, the offset voltage Vofst according to the value of the initial offset set value Minc is generated, and the offset set value Minc is extracted as correction data based on the result of comparison output from the current comparing unit 149. In the operation of writing emission data, the unit voltage Vunit is multiplied by the extracted correction data (optimized offset set value Minc) to generate the offset voltage Vofst as a compensation voltage. The offset voltage Vofst is a voltage equivalent to a potential deviation which change due to some factors, such as an increase in the resistance of the pixel drive circuit DC with time and a variation in the characteristic of the individual pixel drive circuits DC in the emission area 110, and does not depend on the gradation of the original gradation voltage Vorg or the original gradation voltage Vorg_max.

Such an offset set value (variable) Minc can be set by, for example, providing, in the voltage subtracting unit 143, a counter which operates at a predetermined clock frequency and counts up the count value by one when a signal with a predetermined voltage value fetched at the timing of a clock frequency CK and sequentially modulating (e.g., increasing) the count value based on the result of the comparison.

While the unit voltage Vunit can be set to any given voltage, the voltage difference between the unit voltage Vunit and the offset voltage Vofst can be made smaller as the absolute value of the unit voltage Vunit is set smaller. Therefore, the offset voltage Vofst approximated by a change in the threshold voltage of the transistor Tr13 of each emission pixel PIX (pixel drive circuit DC) can be generated in the write operation, so that the gradation signal can be corrected more delicately and adequately.

It is preferable that the unit voltage Vunit be set to the smallest potential difference in the potential differences acquired by subtracting a gate-source voltage Vgs_k+1 (=drain-source voltage Vds_k+1 (>Vds_k)) of the transistor Tr13 at the (k+1)-th gradation from a gate-source voltage Vgs_k (=drain-source voltage Vds_k (positive voltage value) at the k-th gradation (where k is an integer which provides a higher luminance gradation as k becomes greater). If a thin film transistor (TFT) like the transistor Tr13, particularly, an amorphous silicon TFT, is combined with an organic EL device OLED whose emission luminance linearly increases with respect to the density of the flowing current, generally, the higher the gradation is, i.e., the higher the gate-source voltage Vgs_k is (in other words, the greater the drain-source current Ids is), the smaller the potential difference between the gate-source voltages Vgs at adjoining gradations is likely to become. That is, in executing the voltage gradation control of 256 gradations (0-th gradation being non-emission), the potential difference between the gate-source voltage Vgs of the transistor Tr13 at highest luminance gradation (e.g., 255-th gradation) and the gate-source voltage Vgs of the transistor Tr13 at the 254-th gradation is the smallest one among potential differences between adjoining gradations. It is therefore preferable that the unit voltage Vunit should take a value obtained by subtracting the gate-source voltage Vgs at highest luminance gradation (or gradation close thereto) from the gate-source voltage Vgs at a luminance gradation lower by one than the highest luminance gradation (or gradation close thereto).

The current comparing unit 149 has an ammeter 149*a* which measures the value of the detection current Idet flowing to the data line Ld from the potential difference between the detection voltage Vdet generated by the voltage setting unit 145 and the supply voltage Vcc (=Vccw) applied to the supply voltage line Lv. The current comparing unit 149 compares the current value with a reference current Iref_x having a predetermined current value (e.g., current value needed for the organic EL device OLED to emit light at the highest luminance gradation) at a preset predetermined gradation x (e.g., highest luminance gradation), and outputs the level relationship (comparison result) to the offset voltage generating unit 148.

The reference current Iref_x corresponds to the value of the drain-source current Ids of the transistor Tr13 when a voltage acquired by subtracting the unit voltage Vunit from the detection voltage Vdet is applied to the data line Ld when the transistor Tr13 for emission drive of the pixel drive circuit DC is in the initial state and a variation in the device characteristic (threshold voltage) originating from the drive history has hardly occurred. When the voltage difference between the drain-source voltages Vds at adjoining gradations is used as the unit voltage Vunit, for example, the reference current Iref is the current Ids flowing between the drain and source of the transistor Tr13 keeping the initial characteristic when a gradation voltage lower by one gradation than the detection voltage Vdet is applied to the data line Ld.

Because the value of the reference current Iref can be a fixed value, it may be prestored in a memory provided in, for example, the current comparing unit 149 or the data driver 140, or may be supplied from, for example, the system controller 150 or the like to be temporarily stored in a register provided in the data driver 140. In the write operation mode, while the correction gradation voltage Vpix generated by the voltage setting unit 145 is applied to the emission pixels PIX via the data line Ld, measurement of the detection current or the comparison thereof with the reference current in the current comparing unit 149 is not performed. Therefore, for example, a structure which bypasses the current comparing unit 149 in the write operation mode may further be provided.

<Drive Method for Emission Apparatus>

Next, a drive method for the emission apparatus according to the embodiment will be described.

The drive control operation of the emission apparatus 100 according to the embodiment is set in such a way that the "compensation voltage acquiring operation" in the first embodiment (see FIG. 11) is read as "correction data acquiring operation", and the correction data acquiring operation (correction data acquiring operation period Tdet), the write operation (write operation period Twrt), the hold operation (hold operation period Thld), and the emission operation (emission operation period Tem) are executed in a predetermined one process cycle period Tcyc, (Tcyc≦Tdet+Twrt+Thld+Tem). The correction data acquiring operation is controlled in such a way that the detection current Idet which flows to an emission pixel PIX with a detection voltage Vdet being applied to the emission pixel PIX is compared with a predetermined reference current Iref_x to acquire correction data which defines the offset voltage Vofst corresponding to a change in the threshold voltage Vth of the transistor Tr13 for emission drive.

An operation (correction data acquiring operation and write operation) unique to the drive method according to the embodiment will be specifically described below.

Figure 24:
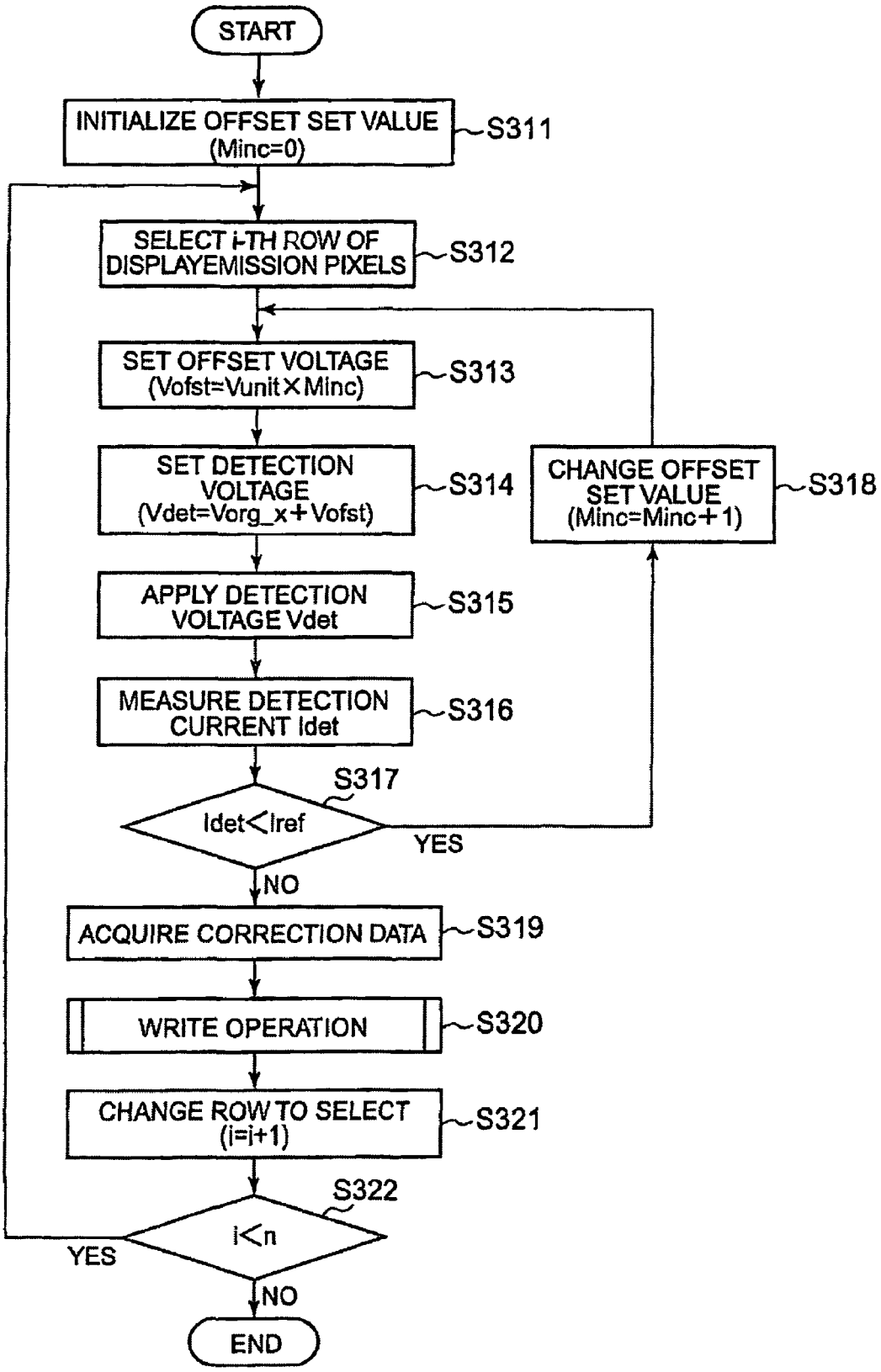
FIG. 24 is a flowchart illustrating one example of a drive method (compensation data acquiring operation) for the emission apparatus according to the third embodiment.
Figure 25:
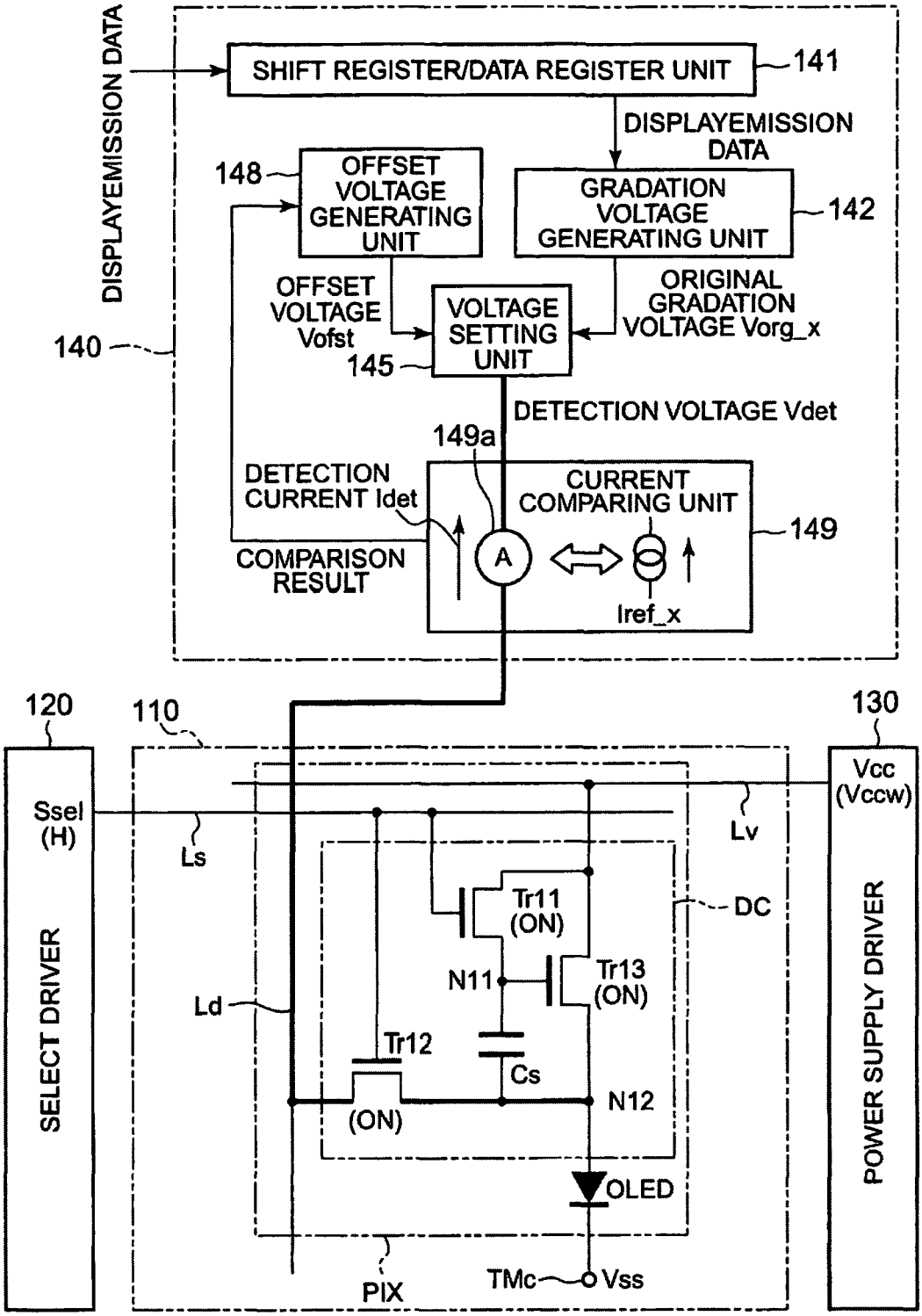
FIG. 25 is a conceptual diagram showing the compensation data acquiring operation of the emission apparatus according to the third embodiment.

FIG. 24 is a flowchart illustrating one example of a drive method (compensation data acquiring operation) for the emission apparatus according to the embodiment, and FIG. 25 is a conceptual diagram showing the compensation data acquiring operation of the emission apparatus according to the embodiment. Because a timing chart illustrating the drive method according to the embodiment is similar to that of the first embodiment, reference will be made to FIG. 11 as needed, and the description will be simplified. It is to be noted that in the embodiment, the "compensation voltage acquiring operation" in the timing chart shown in FIG. 11 should be read as "correction data acquiring operation".

(Correction Data Acquiring Operation)

In the correction data acquiring operation (correction data acquiring operation period Tdet) according to the embodiment, as shown in FIGS. 11 and 24, first, the offset set value Minc set in the register in the offset voltage generating unit 148 is initialized (step S311) after which with the supply voltage Vcc (=Vccw) having a write operation level being applied to the supply voltage line Lv connected to the i-th row of emission pixels PIX, the select signal Ssel having the selection level (high level) is applied to the i-th select line Ls to set the i-th row of emission pixels PIX in the selected state (step S312).

Next, after the offset voltage Vofst is set as given by the foregoing equation 15 based on the offset set value Minc in the offset voltage generating unit 148 (step S313), the offset voltage Vofst is added to the original gradation voltage Vorg_x with a predetermined gradation (e.g., x gradation) output from the gradation voltage generating unit 142 as given by the following equation 16 by the voltage setting unit 145 to generate the detection voltage Vdet(p) (step S314), and the detection voltage Vdet is applied to each data line Ld laid out in the column direction of the emission area 110 via the current comparing unit 149 (step S315).

$$Vdet(p)=Vorg_x+Vofst(p) \tag{16}$$

where p in Vdet(p) and Vofst(p) is a natural integer indicating the number of settings of the offset voltage Vofst in the correction data acquiring operation given by the equation 15, and sequentially increases as the offset set value Minc to be described later is changed. In particularly, Vdet(p) is a negative voltage value whose absolute value increases according to the value of Vofst(p) or as p becomes large.

Accordingly, the detection voltage Vdet is applied to the source terminal (node N12) of the diode-connected transistor Tr13 via the transistor Tr12 and the low-potential supply voltage Vccw is applied to the gate terminal (node N11) and drain terminal of the transistor Tr13. As a result, the voltage (|Vdet−Vccw|) equivalent to the difference between the detection voltage Vdet and the supply voltage Vccw is written between the gate and source of the transistor Tr13 (across the capacitor Cs), thus turning on the transistor Tr13. As described above, the detection voltage Vdet is set to have a negative-polarity voltage value with respect to the supply voltage Vccw having the write operation level (low potential) applied to the emission pixels PIX from the power supply driver 130 (Vdet=Vofst+Vorg<Vccw≦0).

Then, with the detection voltage Vdet being applied to the data line Ld from the voltage setting unit 145, the ammeter 149*a* provided in the current comparing unit 149 measures the value of the detection current Idet flowing on the data line Ld (step S316). Because the voltage relationship for the emission pixels PIX is such that the detection voltage Vdet having a lower potential than the low-potential supply voltage Vccw to be applied to the supply voltage line Lv is applied to the data line Ld, the detection current Idet flows toward the data driver 140 (voltage setting unit 145) from the supply voltage line Lv via the diode-connected transistor Tr13, the transistor Tr12 and the data line Ld.

Next, the current comparing process is performed to compare the value of the detection current Idet measured in the current comparing unit 149 with the designed value (reference current Iref_x) of the current Ids flowing between the drain and source of the transistor Tr13 when the emission pixel PIX (organic EL device OLED) is caused to emit light at the predetermined gradation (x gradation), and the comparison result (level relationship) is output to the offset voltage generating unit 148 (step S317). In the comparison of the detection current Idet with the reference current Iref_x in the current comparing unit 149, for example, it is determined whether the detection current Idet is smaller than the reference current Iref_x (Idet<Iref_x).

When the detection current Idet is smaller than the reference current Iref_x in the current comparing process in step S317, if the detection voltage Vdet (=Vdet(p)) is directly applied to the data line Ld as the correction gradation voltage Vpix in the write operation mode, the current with a lower gradation than the intended gradation to be displayed may flow between the drain and source of the transistor Tr13 due to the influences of the shifting of the threshold voltage according to the V-I characteristic curve SPw2 of the transistor Tr12 and the transistor Tr13 and a variation in the threshold voltage of the transistor Tr12.

When the detection current Idet is determined to be smaller than the reference current Iref_x in the voltage setting unit 145, therefore, the comparison result (e.g., positive voltage signal) of incrementing the count value of the counter provided in the offset voltage generating unit 148 by one is output to the counter of the offset voltage generating unit 148.

When the counter in the offset voltage generating unit 148 increments the count value by one, the offset voltage generating unit 148 adds "1" to the value of the offset set value Minc (step S318), and repeats the step S313 again based on the added offset set value Minc to generate the offset voltage Vofst(p+1). Therefore, the offset voltage Vofst(p+1) will have a value which satisfies the following equation 17.

$$Vofst(p+1)=Vofst(p)+Vunit \quad (17)$$

Thereafter, the processes at and after step S314 are executed again, and repeated until the measured detection current Idet becomes greater than the reference current Iref_x in step S317.

When the voltage setting unit 145 determines in step S317 that the detection current Idet is greater than the reference current Iref_x, the comparison result (e.g., negative voltage signal) of not incrementing the count value of the counter in the offset voltage generating unit 148 by one is output to the counter of the offset voltage generating unit 148.

When the comparison result (e.g., negative voltage signal) is fetched into the counter, the offset voltage generating unit 148 considers that the detection voltage Vdet(p) has corrected the potential corresponding to the shift of the threshold voltage according to the V-I characteristic curve SPw2 of the transistor Tr13, holds the then gradation offset set value Minc as correction data in the register or the like provided in the offset voltage generating unit 148 in such a way as to set the detection voltage Vdet(p) to the correction gradation voltage Vpix to be applied to the data line Ld, and terminates the operation of acquiring (or extracting) the correction data (step S319). As the data to be held in the register is the temporarily held gradation offset set value Minc of the emission pixel PIX, and is initialized in step S311 for the next row of emission pixels PIX, the register itself can be made considerably small.

In the correction data acquiring operation, the potentials at the individual terminals satisfy the relationships given in the equations 3 to 10, so that the current does not flow to the organic EL device OLED, disabling the emission operation.

In the correction data acquiring operation, as apparent from the above, as shown in FIG. 25, the detection current Idet flowing when the detection voltage Vdet is applied to the data line Ld is measured, the offset voltage Vofst for allowing the drain-source current Ids of the transistor Tr13 which is approximated to an expected value in the write operation mode given that the expected value is the drain-source current Ids_x (equivalent to the reference current Iref_x) of the r13 at the x gradation according to the V-I characteristic curve SPw in the initial state, and the gradation offset set value Minc with the offset voltage Vofst is extracted as correction data.

That is, the negative-potential offset voltage Vofst(p) according to the offset set value Minc output from the offset voltage generating unit 148 and the negative-potential original gradation voltage Vorg_x at the x gradation output from the gradation voltage generating unit 142 are added in the voltage setting unit 145 as given by the equation 16 to generate the detection voltage Vdet(p), and when the detection voltage Vdet(p) is corrected in such a way as to be approximated to the drain-source current Ids_x which is to be the expected value of the transistor Tr13 in the write operation mode, the offset set value Minc which defines the detection voltage Vdet(p) is extracted so that the potential of the detection voltage Vdet(p) is treated as the correction gradation voltage Vpix to be applied to the data line Ld.

In the embodiment, as in the first embodiment, the gradation voltage generating unit 142 may independently output the original gradation voltage Vorg_x corresponding to an appropriate luminance gradation without being supplied with emission data from the emission signal generating circuit 160 in the correction data acquiring operation (in the compensation voltage acquiring operation in the first embodiment) given that the original gradation voltage Vorg_x for generating the offset voltage Vofst corresponding to a change in the threshold voltage of the transistor Tr13 is a fixed value.

(Write Operation)

Figure 26:
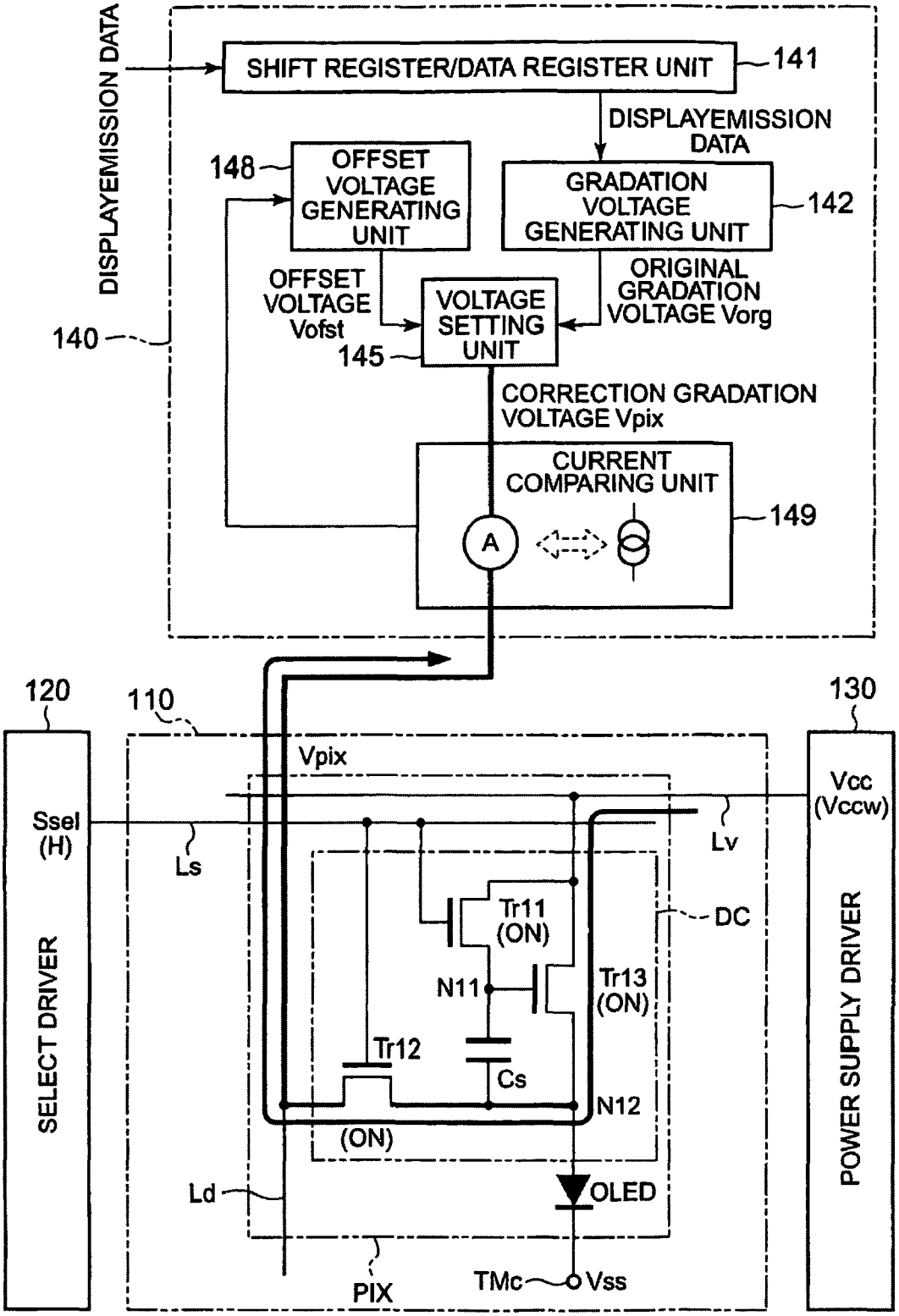
FIG. 26 is a conceptual diagram showing the write operation of the emission apparatus according to the third embodiment.

FIG. 26 is a conceptual diagram showing the write operation of the emission apparatus according to the embodiment. Because a flowchart illustrating the write operation according to the embodiment is similar to those of the first and second embodiments, reference will be made to FIG. 12 or FIG. 18 as needed, and the description will be simplified.

Next, in the write operation (write operation period Twrt) in step S320, as shown in FIG. 11, with the i-th row of emission pixels PIX being held in the selected state, emission data supplied from the emission signal generating circuit 160 is fetched via the shift register/data register unit 141, and is transferred to the gradation voltage generating unit 142 in each row, and it is determined whether the luminance gradation value acquired from the emission data is "0" or not.

When the luminance gradation value is "0", the black gradation voltage Vzero for performing non-emission is output from the gradation voltage generating unit 142, and is applied to the data line Ld directly without executing a correcting process. When the luminance gradation value is not "0", on the other hand, the negative-potential offset voltage Vofst generated according to the luminance gradation value and the negative-potential offset voltage Vofst (=Vunit×Minc) generated based on correction data (offset set value Minc) extracted in the correction data acquiring operation are added by the gradation voltage generating unit 142 to generate the correction gradation voltage Vpix (=Vorg+Vofst=Vorg+Vunit×Minc) to be applied to the data line Ld.

Accordingly, as the correction gradation voltage Vpix corrected according to a change in threshold voltage Vth is applied to the source terminal (node N12) of the transistor Tr13, as shown in FIG. 26, the voltage Vgs according to the correction gradation voltage Vpix is written between the gate and source of the transistor Tr13 (across the capacitor Cs).

As the organic EL device OLED is set in a reverse bias state in the write operation period Twrt too, as in the first and second embodiments, the current does not flow to the organic EL device OLED, disabling emission thereof.

(Hold Operation)

Figure 27:
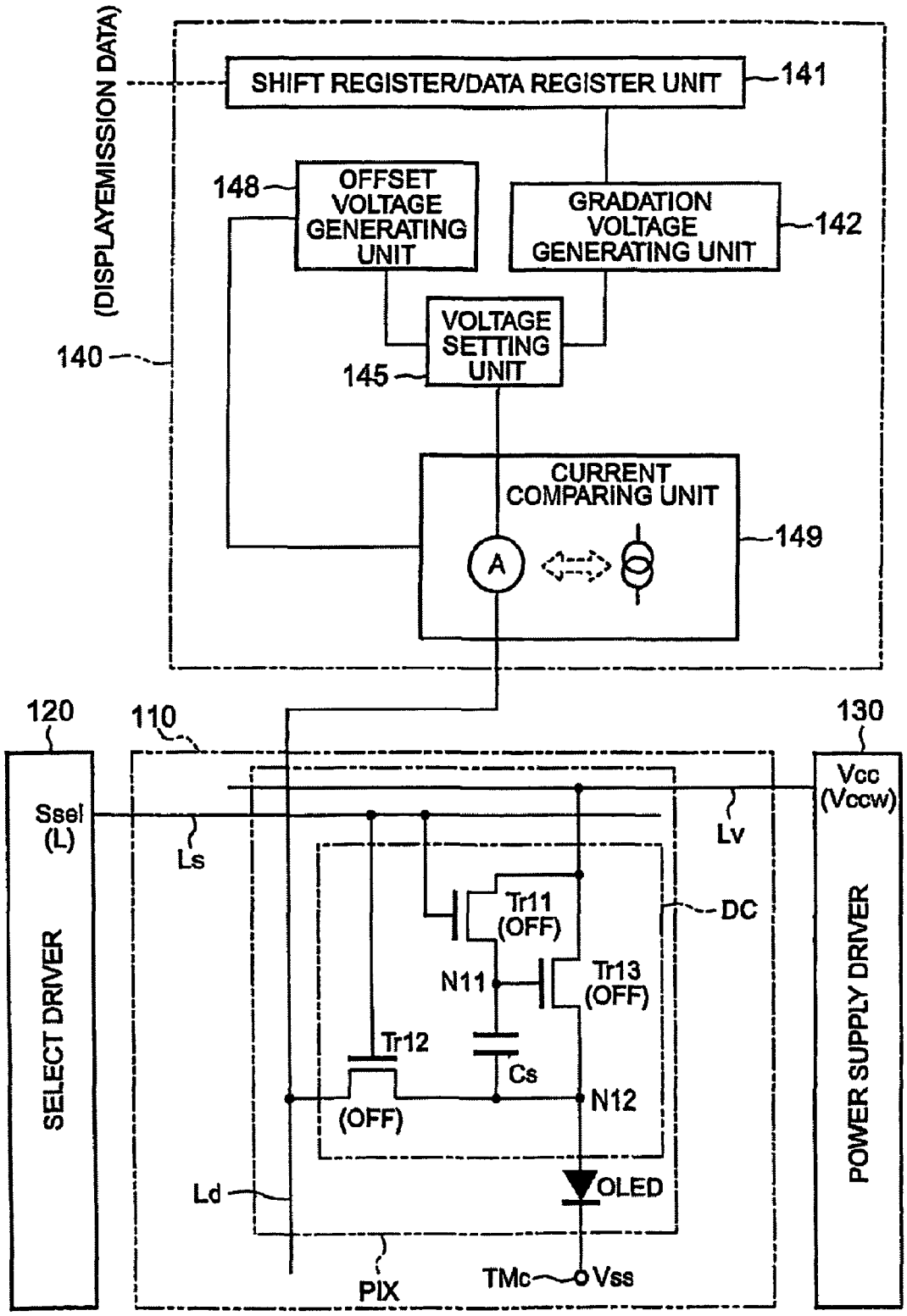
FIG. 27 is a conceptual diagram showing the hold operation of the emission apparatus according to the third embodiment.

FIG. 27 is a conceptual diagram showing the hold operation of the emission apparatus according to the embodiment.

Next, in the hold operation (hold operation period Thld), as in the first and second embodiments, as shown in FIGS. 11 and 27, the select signal Ssel with a non-selection level (low level) is applied to the i-th select line Ls to set the i-th row of emission pixels PIX in the unselected state, so that the voltage component (Vgs=Vpix−Vccw) applied between the gate and source of the transistor Tr13 according to the write operation is charged (held) in the capacitor Cs.

A sequence of operations including the correction data acquiring operation, the write operation and the hold operation for the i-th row of emission pixels PIX is repeatedly executed for each of the (i+1)-th and subsequent rows of emission pixels PIX until the write operation is carried out for every row of the emission area 110 (steps S321, S322).

(Emission Operation)

Figure 28:
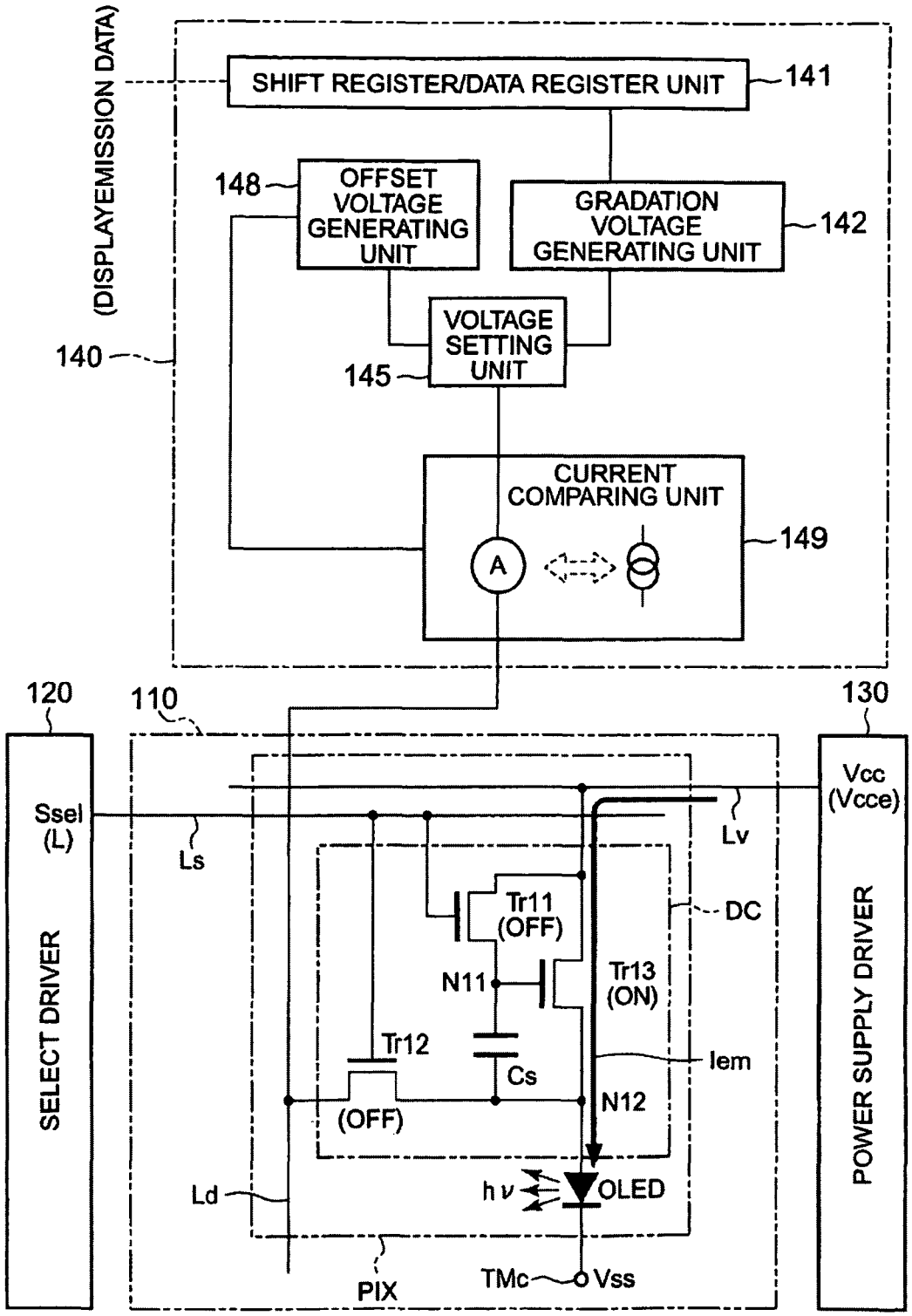
FIG. 28 is a conceptual diagram showing the emission operation of the emission apparatus according to the third embodiment.

FIG. 28 is a conceptual diagram showing the emission operation of the emission apparatus according to the embodiment.

Next, in the emission operation (emission operation period Tem), as shown in FIGS. 11 and 28, with each row of emission pixels PIX being set in the unselected state, the supply voltage Vcc (=Vcce>0 V) having a high potential (positive voltage) or the emission level is applied to the supply voltage line Lv connected to each row of emission pixels PIX, the drive current Iem (drain-source current Ids of the transistor Tr13) having a current value according to the voltage component (|Vpix−Vccw|) written between the gate and source of the transistor Tr13 flows to the organic EL device OLED, thus enabling emission at an appropriate luminance gradation.

According to the sequential drive control operations according to the first to third embodiments, it is possible to set a plurality of emission pixels PIX arrayed in the emission area 110 in the selected state row by row, repeatedly execute a sequence of operations including the compensation voltage acquiring operation (in the case of the first and second embodiments) of acquiring the offset voltage (compensation voltage) Vofst corresponding to the device characteristic of each emission pixel PIX (a change in the threshold voltage of the transistor Tr13 provided in the pixel drive circuit DC), or the correction data acquiring operation (in the case of the third embodiment) of acquiring correction data (offset set value Minc) which defines the offset voltage Vofst, and the write operation of writing the correction gradation voltage Vpix acquired by correcting the original gradation voltage Vorg according to emission data based on the offset voltage Vofst, and set each row of emission pixels PIX in the unselected state at a predetermined timing and apply the supply voltage Vcc (=Vcce) having the emission level after the sequence of operations is terminated, thus allowing that row of emission pixels PIX to emit light at the luminance gradation according to the emission data. It is therefore possible to determine a change ΔVth in the threshold voltage Vth in the pixel drive circuit DC with time and a variation in the threshold voltage which differs from one pixel drive circuit DC from another in the initial state and reflect the change ΔVth display and the variation, for all the emission pixels PIX and in the selection period, at the time of subsequent writing without being saved in a frame memory, thus ensuring display at an accurate luminance gradation.

Although the foregoing descriptions of the first to third embodiments have been given of the current pull type emission apparatus in which in the compensation voltage acquiring operation or the correction data acquiring operation, and in the write operation, the drain-source current Ids of the transistor Tr13 flows to the data driver 140 from the emission pixel PIX (transistor Tr13) via the data line Ld, the present invention may be adapted to a current pushing type emission apparatus in which the drain-source current Ids of a transistor connected in series to the emission pixels PIX flows toward that transistor from the data driver 140.

According to the drive method according to each of the first to third embodiments, the hold operation (hold operation period Thld) of writing a voltage component according to the emission data (correction gradation voltage Vpix) between the gate and source of the transistor Tr13 (across the capacitor Cs) of each emission pixel PIX and holding the voltage component there for a given period is provided between the write operation and the emission operation, for example, when performing the drive control of causing all the emission pixels PIX in each group set in the emission area 110 to perform emission at a time after writing to every row of emission pixels PIX in that group is finished as will be described later. In this case, the length of the hold operation period Thld differs from one row to another. When such drive control is not executed, the hold operation may be skipped.

In the emission apparatus 100 shown in FIG. 9, the emission pixels PIX arrayed in the emission area 110 are separated into two groups respectively having the upper area and lower area of the emission area 110, and the independent supply voltage Vcc is applied to the groups via the individual supply voltage lines Lv, so that a plurality of emission pixels PIX included in each group can perform an emission operation at a time. The following will described a specific drive control operation in this case.

<Specific Example of Drive Method>

Figure 29:
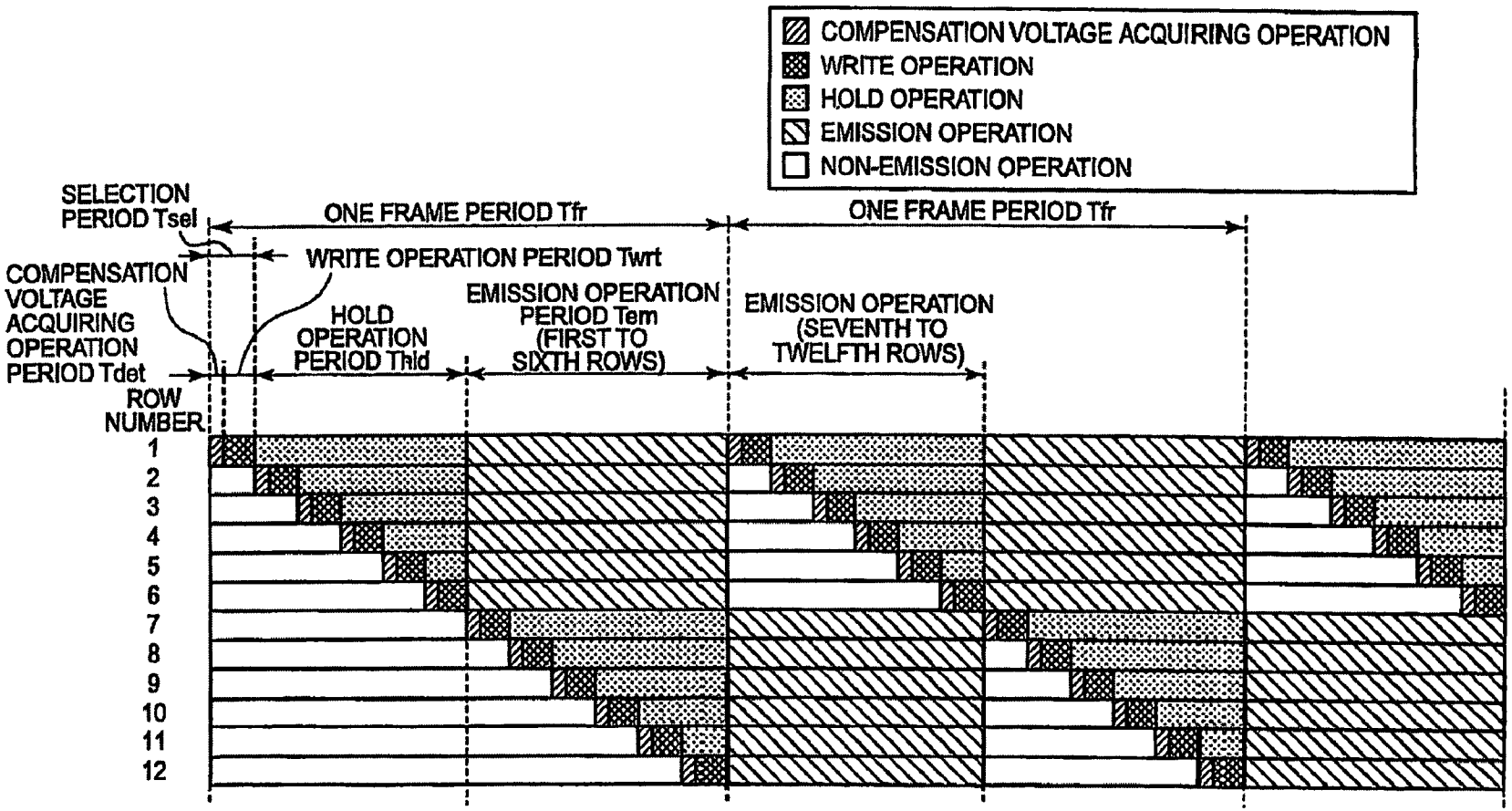
FIG. 29 is an operational timing chart exemplarily showing a specific example of the drive methods for the emission apparatuses having emission areas according to the first to third embodiments.

FIG. 29 is an operational timing chart exemplarily showing a specific example of the drive method for the emission apparatus having the emission area shown in FIG. 9. FIG. 29 shows an operational timing chart in a case where 12 rows (n=12; first to twelfth rows) of emission pixels PIX are arrayed in the emission area 110 for the sake of descriptive convenience, the emission pixels PIX are grouped into a set of the first to sixth rows (corresponding to the upper area) of emission pixels PIX and a set of the seventh to twelfth rows (corresponding to the lower area) of emission pixels PIX.

In the drive control operation of the emission apparatus 100 having the emission area 110 shown in FIG. 9, as shown in FIG. 29, while a sequence of processes of consecutively performing the compensation voltage acquiring operation or the correction data acquiring operation, and the write operation for each row of emission pixels PIX of the emission area 110 is repeated row by row within one frame period Tfr, the process of causing the first to sixth rows and the seventh to twelfth rows of emission pixels PIX (organic EL devices OLED), previous separated into two groups, to perform an emission operation at a luminance gradation according to emission data at a time is repeated for each group at the timing when the write operation to the first to sixth rows and the seventh to twelfth rows of emission pixels PIX (organic EL devices OLED) is finished, thus displaying image information for one screen of the emission area 110.

Specifically, as shown in FIG. 25, with the low-potential supply voltage Vcc (=Vccw) being applied to the emission pixels PIX arrayed in the emission area 110 in the group having the first to sixth rows of emission pixels PIX via a supply voltage line Lv1 commonly connected to the emission pixels PIX in the group, a sequence of processes including the compensation voltage acquiring operation (compensation voltage acquiring operation period Tdet) or the compensation voltage acquiring operation (compensation voltage acquiring operation period Tdet), the write operation (write operation period Twrt), and the hold operation (hold operation period Thld) are repeatedly executed row by row in order from the first row of emission pixels PIX.

As a result, for each row of emission pixels PIX, the offset voltage corresponding to a change in the threshold voltage of the transistor Tr13 provided in the pixel drive circuit DC or correction data which defines the offset voltage is acquired, and the correction gradation voltage Vpix acquired by adding the original gradation voltage Vorg generated based on emission data and the offset voltage Vofst (compensation voltage) is written in each emission pixel PIX (pixel drive circuit DC).

Then, as the high-potential supply voltage Vcc (=Vcce) is applied via the supply voltage line Lv1 in the group at the timing when writing to the sixth row of emission pixels PIX is finished, the six rows of emission pixels PIX are caused to perform an emission operation at a time at a luminance gradation based on the emission data (correction gradation voltage Vpix) written in the emission pixels PIX. This emission operation continues for the first row of emission pixels PIX until the timing at which the next compensation voltage acquiring operation or correction data acquiring operation starts (emission operation period Tem for the first to sixth rows).

At the timing when writing to the first to sixth rows of emission pixels PIX is finished (or the timing when writing to the first to sixth rows of emission pixels PIX has started), with the low-potential supply voltage Vcc (=Vccw) being applied to the emission pixels PIX in the group having the seventh to twelfth rows of emission pixels PIX via a supply voltage line Lv2 commonly connected to the emission pixels PIX in the group, a sequence of processes including the compensation voltage acquiring operation (compensation voltage acquiring operation period Tdet) or the compensation voltage acquiring operation (compensation voltage acquiring operation period Tdet), the write operation (write operation period Twrt), and the hold operation (hold operation period Thld) are repeatedly executed row by row in order from the seventh row of emission pixels PIX. Then, as the high-potential supply voltage Vcc (=Vcce) is applied via the supply voltage line Lv2 in the group at the timing when writing to the twelfth row of emission pixels PIX is finished, the six rows of emission pixels PIX are caused to perform an emission operation at a time at a luminance gradation based on the emission data (correction gradation voltage Vpix) written in the emission pixels PIX (emission operation period Tem for the seventh to twelfth rows). In the period during which the compensation voltage acquiring operation or the correction data acquiring operation, the write operation and the hold operation are performed on the seventh to twelfth rows of emission pixels PIX, as described above, the operation of causing the first to sixth rows of emission pixels PIX to emit light at a time is continued.

In this manner, drive control of all the emission pixels PIX arrayed in the emission area 110 is executed in such a way that the sequence of processes including the compensation voltage acquiring operation or the correction data acquiring operation, the write operation and the hold operation is sequentially executed at a predetermined timing for each row of emission pixels PIX and when writing to every row of emission pixels PIX included in each of the preset groups is finished, all the emission pixels PIX in that group are caused to perform an emission operation at a time.

According to the drive method for the emission apparatus, therefore, in a period (selection period) in one frame period Tfr where the compensation voltage acquiring operation or the correction data acquiring operation, the write operation and the hold operation are performed on each row of emission pixels in the same group, it is possible to disable execution of the emission operation of all the emission pixels (emission elements) in the group and set a non-emission state (black display state). In the operational timing chart shown in FIG. 29, for example, the twelve rows of emission pixels PIX constituting the emission area 110 are separated into two groups and are controlled so as to perform an emission operation at a time at a timing different from one group to another, so that the ratio (black insertion ratio) of the black display period where the non-emission operation takes place in one frame period Tfr can be set to 50%. To ensure clear visibility of a moving image without blurring or bleeding with the human visual sense, generally, the tentative black insertion ratio is about 30%. Therefore, the drive method of the present invention can realize an emission apparatus having a relatively good display image quality.

Although FIG. 9 shows the case where a plurality of emission pixels PIX in the emission area 110 are grouped into two sets containing consecutive rows, the present invention is not limited to this case but the emission pixels PIX may be grouped into sets each of which does not contain consecutive rows, like odd rows or even rows, or may be grouped into an arbitrary number of sets, such as three sets or four sets. This modification can allow the emission time and the ratio of the black display period (black display state) to be arbitrarily set according to the number of sets, and can thus improve the display image quality.

The emission pixels PIX may be caused to perform an emission operation row by row by laying (connecting) power supply lines for the respective rows without grouping the emission pixels PIX and independently applying the supply voltage Vcc thereto at different timings, or all the emission pixels PIX for one screen of the emission area 110 may be caused to perform an emission operation at a time by applying a common supply voltage Vcc to all the emission pixels PIX for one screen of the emission area 110 at a time.

According to the emission apparatus according to each embodiment and drive method therefor, as described above, it is possible to adopt a voltage designating type (or voltage applying type) gradation control method of holding a predetermined voltage component between gate and source of the drive transistor (transistor Tr13) (in the capacitor Cs) by directly applying the correction gradation voltage Vpix designating a voltage value according to emission data and a change in the device characteristic (threshold voltage) of the drive transistor between gate and source of the drive transistor (transistor Tr13) in the emission-data write operation period, and controlling the drive current Iem which is let to flow to the emission element (organic EL device OLED) based on the voltage component to thereby ensure emission at a desired luminance gradation.

Therefore, as compared with the current designating type gradation control method that performs a write operation by supplying emission pixels (pixel drive circuits) with a current having a value according to emission data, a gradation signal (correction gradation voltage) according to emission data can be written in each emission pixel quickly and reliably even in a case where the emission area is enlarged or designed to have higher definition or in a case of performing low gradation display. This makes it possible to suppress occurrence of insufficient writing of emission data and permit emission at an adequate luminance gradation according to emission data, thus achieving an excellent display image quality.

Further, prior to in the operation of writing emission data into emission pixels (pixel drive circuits), it is possible to acquire a compensation voltage corresponding to a change in the threshold voltage of the drive transistor or correction data defining the compensation voltage, and generate and apply a corrected gradation signal (corrected gradation voltage) for each emission pixel based on the compensation voltage at the time of performing the write operation. This makes it possible to compensate for the influence of a change in the threshold voltage (shift of the voltage-current characteristic of the drive transistor) and allow the emission pixels (emission elements) to emit light at an adequate luminance gradation according to emission data and suppress a variation in the emission characteristic of each emission pixel, thereby improving the emitting image quality.

The emission apparatus can be applied to not only a display panel but an exposure panel of printer or the other emitting apparatus.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

This application is based on Japanese Patent Application No. 2007-078394 filed on Mar. 26, 2007 and including specification, claims, drawings and summary. The disclosure of the above Japanese Patent Application is incorporated herein by reference in its entirety.

What is claimed is:

1. An emission apparatus comprising:

an emission element;

a pixel drive circuit connected to the emission element;

a data line connected to the pixel drive circuit; and an emission drive apparatus that, in a selection period: (i) lets a reference current with a predetermined current value flow to the pixel drive circuit via the data line, (ii) derives a compensation voltage which is a difference between a potential that varies according to a unique characteristic of the pixel drive circuit and a predetermined reference potential, and (iii) generates a correction gradation voltage to be applied to the pixel drive circuit based on the compensation voltage for causing the emission element to emit light at an appropriate luminance gradation, the emission drive apparatus comprising:

a current source that lets the reference current flow into the pixel drive circuit;

a voltage subtracting unit that derives the compensation voltage by computing the difference between the potential which is generated at the data line when the reference current is let to flow into the pixel drive circuit and the predetermined reference potential;

a switch that selectively connects the current source and the voltage subtracting unit to the data line;

a voltage latch unit that temporarily holds the compensation voltage computed by the voltage subtracting unit;

a gradation voltage generation unit that generates a gradation voltage according to emission data; and a voltage setting unit that computes the correction gradation voltage by adding the gradation voltage generated by the gradation voltage generation unit and the compensation voltage held by the voltage latch unit, when recognizing that a luminance gradation of the emission data is not a luminance gradation of no emission, wherein the voltage setting unit outputs the gradation voltage generated by the gradation voltage generation unit without adding the compensation voltage held by the voltage latch unit, when recognizing that the luminance gradation of the emission data is the luminance gradation of no emission.

2. The emission apparatus according to claim 1, further comprising an emission area where a plurality of emission pixels are arrayed, each of the plurality of emission pixels including the emission element and the pixel drive circuit.

3. The emission apparatus according to claim 1, wherein the pixel drive circuit includes a drive transistor connected in series to the emission element.

4. The emission apparatus according to claim 3, wherein the pixel drive circuit further includes a select transistor connected between the drive transistor and the data line, and a diode connecting transistor that sets the drive transistor in a diode connected state.

5. A drive method for an emission apparatus including: (i) an emission element, (ii) a pixel drive circuit connected to the emission element, (iii) an emission drive apparatus, and (iv) a data line connecting the emission drive apparatus to the pixel drive circuit, wherein the emission drive apparatus comprises: (A) a current source that lets a reference current with a predetermined current value flow into the pixel drive circuit, (B) a voltage subtracting unit that derives a compensation voltage by computing a difference between a potential generated at the data line when the reference current is let to flow into the pixel drive circuit and a predetermined reference potential, (C) a switch that selectively connects the current source and the voltage subtracting unit to the data line, (D) a voltage latch unit that temporarily holds the compensation voltage computed by the voltage subtracting unit, (E) a gradation voltage generation unit that generates a gradation voltage according to emission data, and (F) a voltage setting unit that computes a correction gradation voltage by adding the gradation voltage generated by the gradation voltage generation unit and the compensation voltage held by the voltage latch unit, when recognizing that a luminance gradation of the emission data is not a luminance gradation of no emission, the drive method comprising:

in a selection period, causing the voltage subtracting unit to derive the compensation voltage which is the difference between the potential that varies according to a unique characteristic of the pixel drive circuit and the predetermined reference potential, when the reference current with the predetermined current value is let to flow to the pixel drive circuit via the data line;

in the selection period, causing the voltage setting unit to derive the correction gradation voltage in accordance with both of the gradation voltage corresponding to the emission data and the compensation voltage, when recognizing that the luminance gradation of the emission data is not the luminance gradation of no emission, and causing the voltage setting unit to output the gradation voltage generated by the gradation voltage generation unit without adding the compensation voltage held by the voltage latch unit, when recognizing that the luminance gradation of the emission data is the luminance gradation of no emission; and causing the emission element to emit light by applying the correction gradation voltage to the pixel drive circuit via the data line.

* * * * *